US005186766A

United States Patent [19]

Iriyama et al.

[11] Patent Number: 5,186,766

[45] Date of Patent: Feb. 16, 1993

[54] MAGNETIC MATERIALS CONTAINING RARE EARTH ELEMENT IRON NITROGEN AND HYDROGEN

[75] Inventors: Takahiko Iriyama; Kurima Kobayashi; Hideaki Imai, all of Fuji, Japan

[73] Assignee: Asahi Kasei Kogyo Kabushiki Kaisha, Osaka, Japan

[21] Appl. No.: 788,436

[22] Filed: Nov. 6, 1991

Related U.S. Application Data

[63] Continuation of Ser. No. 323,910, Mar. 15, 1989, abandoned.

[30] Foreign Application Priority Data

Sep. 14, 1988 [JP] Japan ..... 63-228547
Nov. 14, 1988 [JP] Japan ..... 63-285741

[51] Int. Cl.[5] ..... H01F 1/053
[52] U.S. Cl. ..... 148/301; 420/83
[58] Field of Search ..... 148/301, 302; 420/83; 252/62.55; 75/252, 255

[56] References Cited

U.S. PATENT DOCUMENTS 3,795,541 3/1974 Lee et al. .

FOREIGN PATENT DOCUMENTS 0251233 1/1988 European Pat. Off. .
0369097 5/1990 European Pat. Off. .
58-22301 2/1983 Japan .
58-48607 3/1983 Japan .
60-131949 12/1983 Japan .
60-144906 1/1984 Japan .
60-144907 1/1984 Japan .
60-144908 1/1984 Japan .
60-144909 1/1984 Japan .
60-176202 2/1984 Japan .
60-204862 3/1984 Japan .
61-9551 6/1984 Japan .
61-166945 1/1985 Japan .
62-136550 12/1985 Japan .
62-136551 12/1985 Japan .
62-136553 12/1985 Japan .
62-136558 12/1985 Japan .
62-156247 12/1985 Japan .
62-156248 12/1985 Japan .
62-158852 12/1985 Japan .
62-158854 12/1985 Japan .
62-170454 1/1986 Japan .
62-177101 1/1986 Japan .
62-177146 1/1986 Japan .
62-177147 1/1986 Japan .
62-177150 1/1986 Japan .
62-177158 1/1986 Japan .

OTHER PUBLICATIONS

Coey et al., Journal of Magnetism and Magnetic Materials, No. 87, 1990, pp. 251-254.

(List continued on next page.)

*Primary Examiner*—John P. Sheehan
*Attorney, Agent, or Firm*—Finnegan, Henderson, Farabow, Garrett & Dunner

[57] ABSTRACT

Magentic materials represented by the formula $$R_{60}Fe_{(100-\alpha-\beta-\gamma)}N_{\beta}H_{\gamma} \quad (I)$$

or $$R_{\alpha}Fe_{(100-\alpha-\beta-\gamma-\delta)}N_{\beta}H_{\gamma}M_{\delta} \quad (II)$$

wherein

R is at least one rare earth element inclusive of Y,

M is at least one additive selected from the group consisting of Sn, Ga, In, Bi, Pb, Zn, Al, Zr, Cu, Mo, Ti, Si, MgO, $Al_2O_3$, $Sm_2O_3$, $AlF_3$, $ZnF_2$, SiC, TiC, AlN and $Si_3N_2$, $\alpha$ is 5 to 20 atomic percent, $\beta$ is 5 to 30 atomic percent, $\gamma$ is 0.01 to 10 atomic percent and $\delta$ is 0.1 to 40 atomic percent, sintered magnets and bonded magnets obtained from the magnetic materials.

22 Claims, 37 Drawing Sheets

OTHER PUBLICATIONS

A. Kianvash et al., Journal of Materials Science, vol. 20, No. 2, Feb. 1985, London GB, pp. 682–688.

Chemical Abstracts, vol. 109, No. 14, Oct. 3, 1988, p. 769.

Chemical Abstracts, vol. 104, No. 12, Mar. 24, 1986, p. 835.

Chemical Abstracts, vol. 103, No. 26, Dec. 30, 1985, p. 243.

Handbook on the Physics and Chemistry of Rare Earths, vol. 2, Alloys and Intermetallics, Karl A. Gschneidner, Jr. and Leroy Eyring, Eds., North-Holland Publ. Co. 1979, pp. 6 and 155.

Iron—Binary Phase Diagrams, Ortrud Kubaschewski, Springer-Verlag, 1982, pp. 101, 102, 104, 105.

International Tables for Crystallography, vol. A—Space-Group Symmetry, Theo Hahn, Ed., D. Riedel Publ. 1983, Table 5.1.

S. Higano et al., "Magnetic Properties of RE-TM-N System", IEEE Transactions on Magnetics, vol. MAG-23, No. 5, 1987, pp. 3098–3100.

K. H. J. Buschow, "Hydrogen Absorption and Its Effect on the Magnetic Properties of Rare-Earth Iron Intermetallics", Solid State Commun. 19, No. 5, Jul. 1976, pp. 421–423.

P. M. Gualtieri et al., "Magnetic Properties of the Hydride of Selected Rare-Earth Intermetallic Compounds with Transition Metals", AIP Conf. Proc. 34, 1976, pp. 219–221.

S. K. Malik et al., "Effect of Absorbed Hydrogn on the Magnetic Properties of $GdFe_3$, $DyFe_3$ and $HoFe_3$", Magnetism Letters, vol. 1, 1976, pp. 33–39.

H. H. van Mal et al., "Hydrogen Absorption of Rare--Earth (3d) Transition Intermetallic Compounds", Journal of the Less Common Metals 49, 1976, pp. 473–475.

A. R. Miedema et al., "Which Intermetallic Compounds of Transition Metals Form Stable Hydrides?", Journal of the Less Common Metals 49, 1976, pp. 463–472.

K. H. J. Buschow, "Changes of the Magnetic Properties upon Hydrogen Absorption in Rare-Earth Iron Compounds", Physica, 86–88B, 1977, pp. 79–80.

A. M. van Diepen et al., "Hydrogen Absorption in $CeFe_2$ and $ThFe_3$", Solid State Comm. 22, 1977, pp. 113–115.

H. Oesterreicher et al., "Hydriding Characteristics and Magnetic Properties of Hydrides in $Y_6(Mn_{1-x}Fe_x)_{23}$", Physica Status Solidi (a)41, 1977, pp. K101–105.

W. E. Wallace, "Magnetism of Hydrogenated Intermetallic Compounds Containing d-transition Metals", Z. Phys. Chem. N.F. 115, 1979, pp. S.219–237.

G. E. Fish et al., "Effects of Hydrogen on Sublattice Magnetization of Laves-Phase Rare Earth Iron Compounds", J. Appl. Phys. 50(3), 1979, pp. 2003–2006.

P. J. Viccaro et al., "Magnetic Properties of $DyFe_2H_2$ from $^{57}Fe$, $^{161}Dy$ Mossbauer Effect and Magnetization Measurements", J. Appl. Phys. 50(3), 1979, pp. 2051–2052.

B. D. Dunlap et al., "Mossbauer Effect Investigations of the Electronic and Magnetic Properties of Rare Earth Metal and Intermetallic Hydrides", J. Appl. Phys. 50(11), 1979, pp. 7682–7686.

D. Niarchos et al., "Magnetic and Structural Properties of $ErFe_3H_x$ Hydrides", J. Appl. Phys. 50(11), 1979, pp. 7690–7692.

P. J. Viccaro et al., "Electronic and Structural Studies of the Hydrides of $ErFe_2$ from $^{57}Fe$ and $^{166}Er$ Mossbauer Spectroscopy", J. de Physique 40, 1979, pp. C2-198–201.

K. H. J. Buschow et al., "Moment Formation upon Hydrogen Absorption in $Hf_2Fe$", Solid State Comm. 31, 1979, pp. 469–471.

G. E. Fish et al., "Neutron Scattering Studies of Hydrides of the Laves Phase Rare Earth Compounds $RFe_2$", Rare Earths Mod. Sci. Technol. 2, 1980, pp. 569–570.

K. H. J. Buschow et al., "Changes in Magnetic Properties upon $H_2$ Absorption in Various 3d Intermetalic Compounds", J. Magnetism and Magnetic Materials 15–18, 1980, pp. 1261–1263.

H. Oesterreicher et al., "Magnetic Properties of Hydrides of $YMn_{2-x}Fe_x$", J. Magnetism and Magnetic Materials 15–18, 1980, pp. 1264–1266.

D. Niarchos et al., "Structural and Magnetic Properties of $DyFe_3$ Hydrides", J. Less-Common Metals 73, 1980, pp. 283–290.

F. Pourarian et al., "$DyFe_2$-$H_2$ System: Magnetism and Pressure-Composition Isotherms to 1400 Atm", J. Less-Common Metals 74, 1980, pp. 161–165.

P. C. M. Gubbens et al., "Magnetic Properties and $^{57}Fe$ Mossbauer Effect in $Lu_6Fe_{23}$ and $Lu_6Fe_{23}H_8$", Solid State Commun. 37, 1981, pp. 635–639.

E. B. Boltich et al., "Influence of Hydrogen on Structure and Magnetic Properties of $Ho_6Fe_{23}$ and $Er_6Fe_{23}$", Solid State Commun. 40, 1981, pp. 117–120.

(List continued on next page.)

OTHER PUBLICATIONS

F. Pourarian et al., "Magnetic Characteristics of $RCo_{2-x}Fe_x$ Hydrides (R=Tb,Dy)", J. Less-Common Metals 83, 1982, pp. 95-103.

F. Pourarian et al., "Magnetic Behavior of Laves Phase $RCo_{2-x}Fe_x$ (R=Ho, Er) Compounds and Their Hydrides", J. Magnetism and Magnetic Materials 25, 1982, pp. 299-306.

K. Fujiwara et al., "NMR Study of $R(Fe_{1-x}Co_x)_3$-Hydride", Journal Magnetism and Magnetic Materials, 31-34, 1983, pp. 707-708.

S. K. Malik et al., "Magnetization Behavior of $RFe_3$-Hydrides (R=Tb, Er and Tm)", J. Magnetism and Magnetic Materials 40, 1983, pp. 27-31.

G. K. Shenoy et al., "Magnetic Properties of Intermetallic Hydrides", J. Less-Common Metals 94(1), 1983, pp. 37-44.

H. Drulis et al., "Magnetic Properties and Electron Paramagnetic Resonance Studies of the $GdXAlH_x$ (X=Fe, Ni) Hydrides", J. Less-Common Metals 101, 1984, pp. 229-237.

K. H. J. Buschow, "Hydrogen Absorption in Intermetallic Compounds", Handbook on the Physics and Chemistry of Rare Earths, 6, 1984, pp. 1, 53-111.

D. W. Forester et al., "Hydrogen in Amorphous Magnetic Rare Earth-Transition Metal Alloys", J. Non--Crystalline Solids, 61-62, 1984, pp. 685-690.

G. Bayer et al., "Thermodynamic kinetic, Structural, and Surface Studies of $Y_6Fe_{23-x}Mn_x$ Alloys and Their Hydrides", J. Physical Chemistry 88, 1984, pp. 3220-3224.

Y. Berthier et al., "Magnetic Interactions and Structural Properties of Ternary Hydrides $TbFe_2H_x$", Physica B+C (Amsterdam), 130(1-3), 1985, pp. 520-523.

D. Fruchart et al., "Effects of Rhombohedral Distortion on the Magnetic Properties of $REFe_2$ Hydrides (RE=Er, Tb)", J. Less-Common Metals 130, 1987, pp. 89-95.

G. Wiesinger, "On the Breakdown of the Iron Sublattic Long-Range Magnetic Order in RFeAl Hydrides (R=Rare Earth)", J. Less-Common Metals 130, 1987, pp. 181-186.

H. Bo-Ping et al., "Effect of Hydrogen on the Curie Temperature of $Nd_2(Fe_{15}M_2)$; M=Al, Si, Co", J. Less-Common Metals 142, 1988, pp. 295-300.

W. Xiang-Zhong et al., "Hydrogen Absorption and Desorption in $Nd_2Fe_{17}$ and $Sm_2Fe_{17}$", J. Material Science 23, 1988, pp. 329-331.

B. Rupp et al., "Phase Relations and Hydrogen Absorption of Neodymium-Iron-(Boron) Alloys", J. Material Science 23, 1988, pp. 2133-2141.

B. Rupp et al., "Magnetic and Structural Properties of a Novel Ternary Hydride $Nd_2Fe_{17}H_x$ ($0<x<5$)", J. Magnetism and Magnetic Materials 71, 1988, pp. 269-278.

FIG. 2-(a)
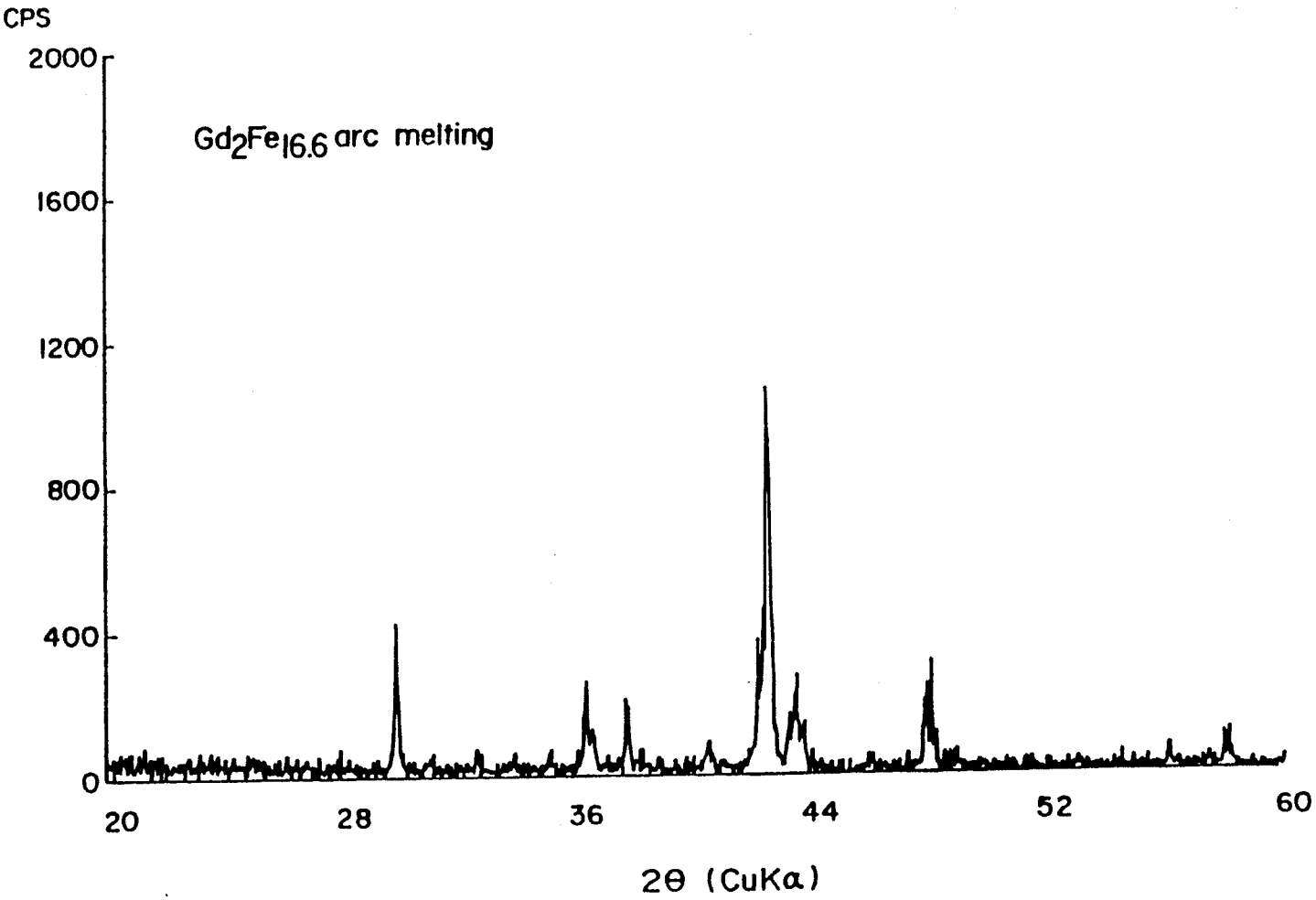

FIG. 2-(b)
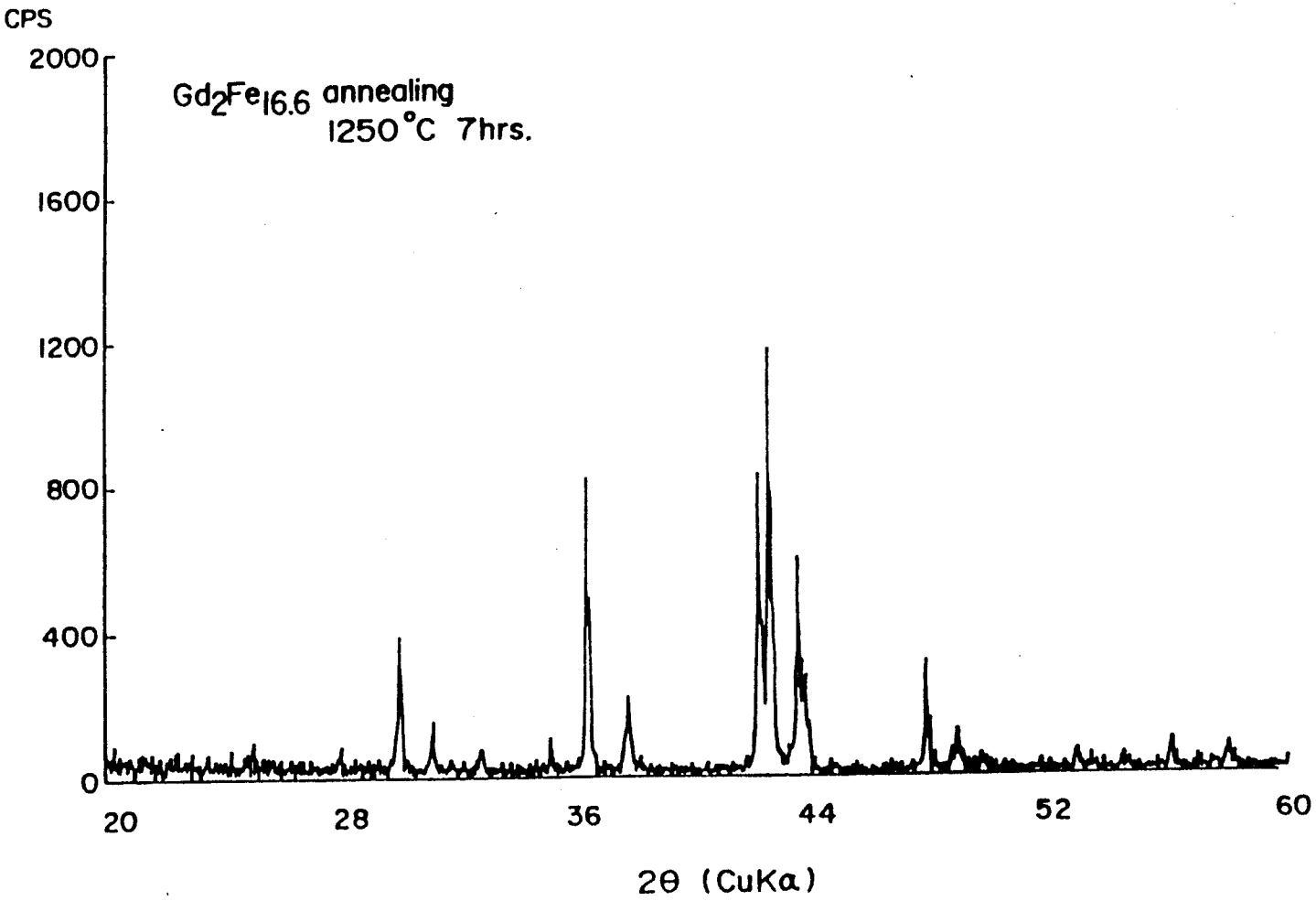

FIG. 2-(c)
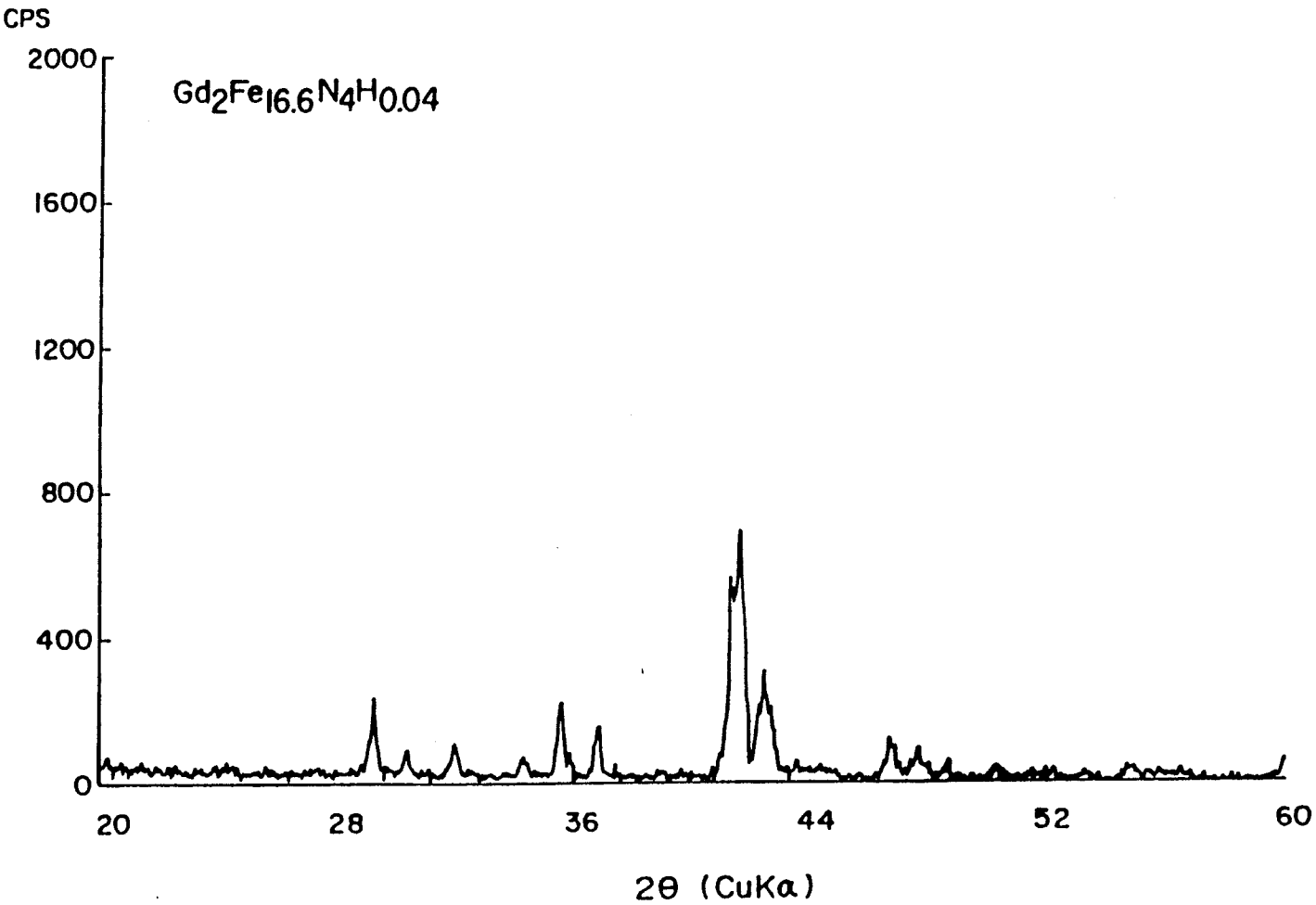

FIG. 3-(a)
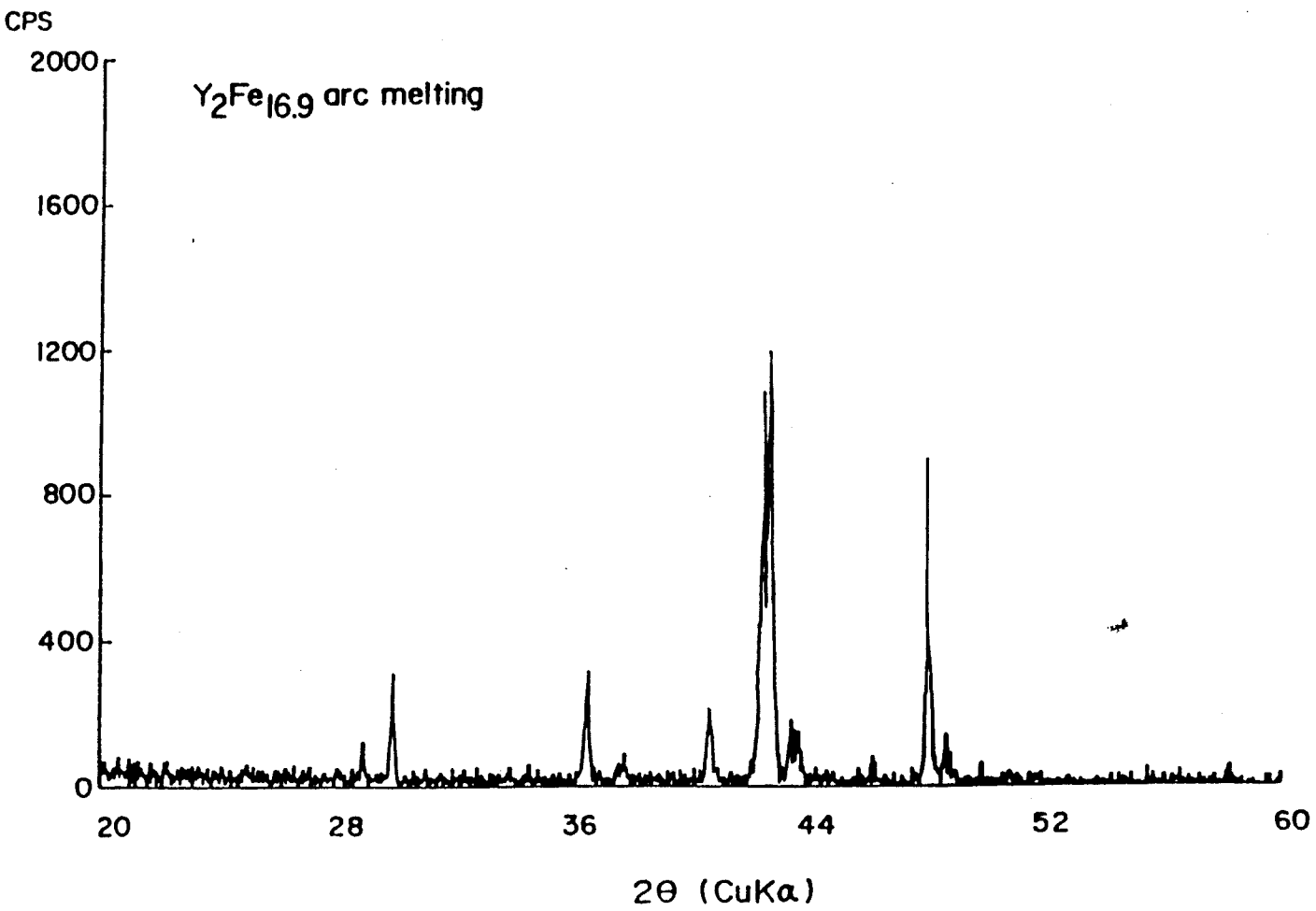

FIG. 3-(b)
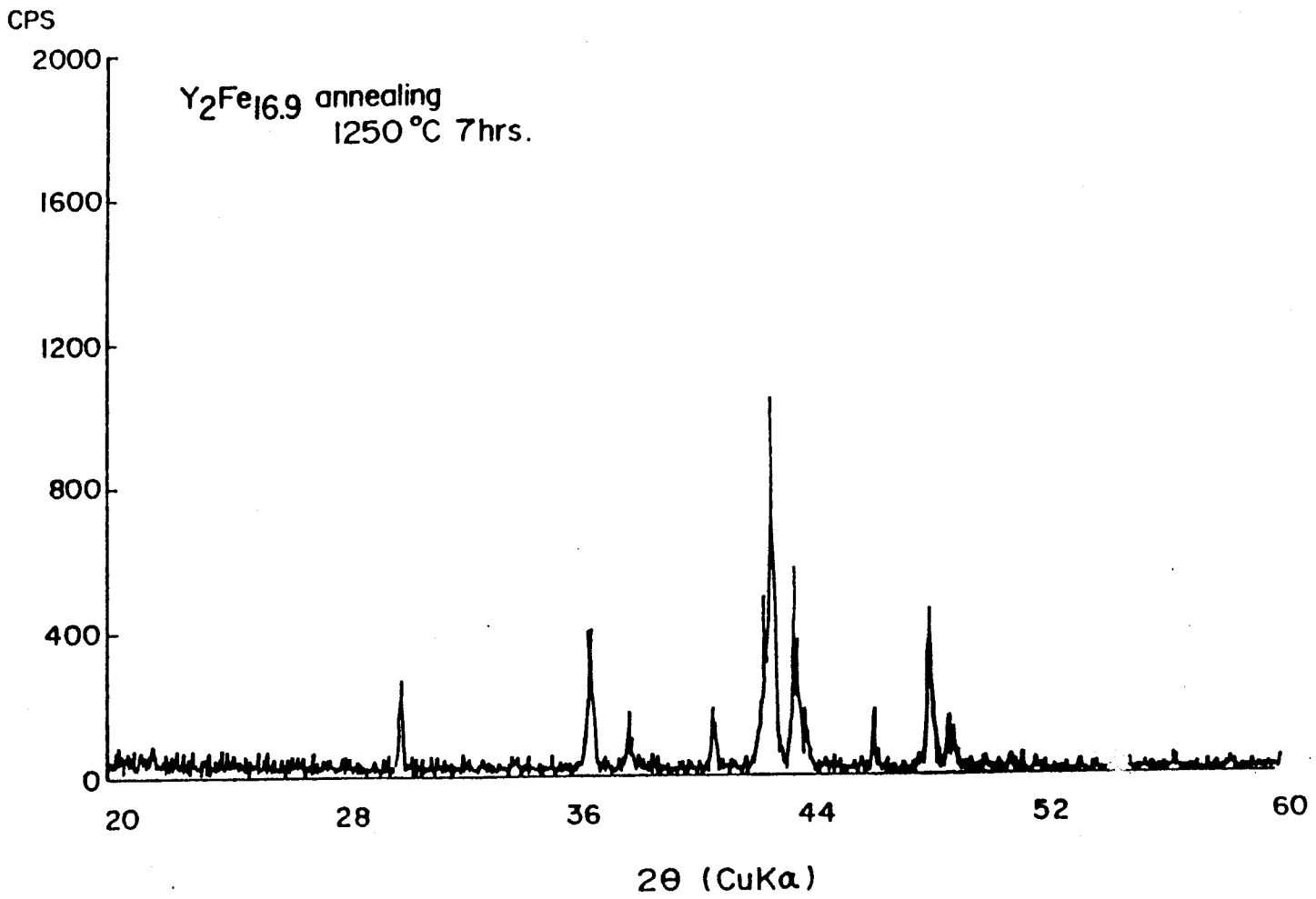

FIG. 3-(c)
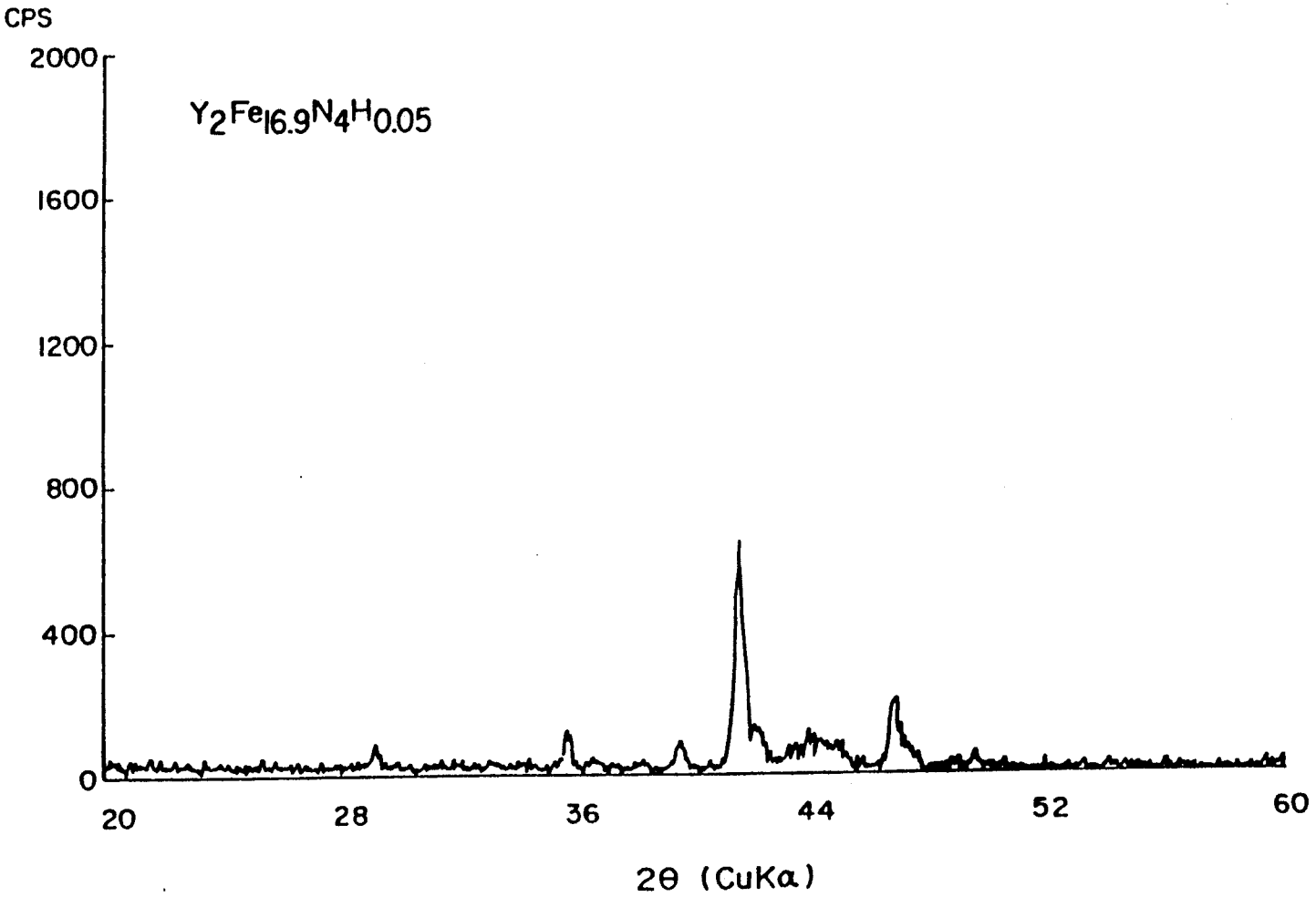

FIG. 4-(a)
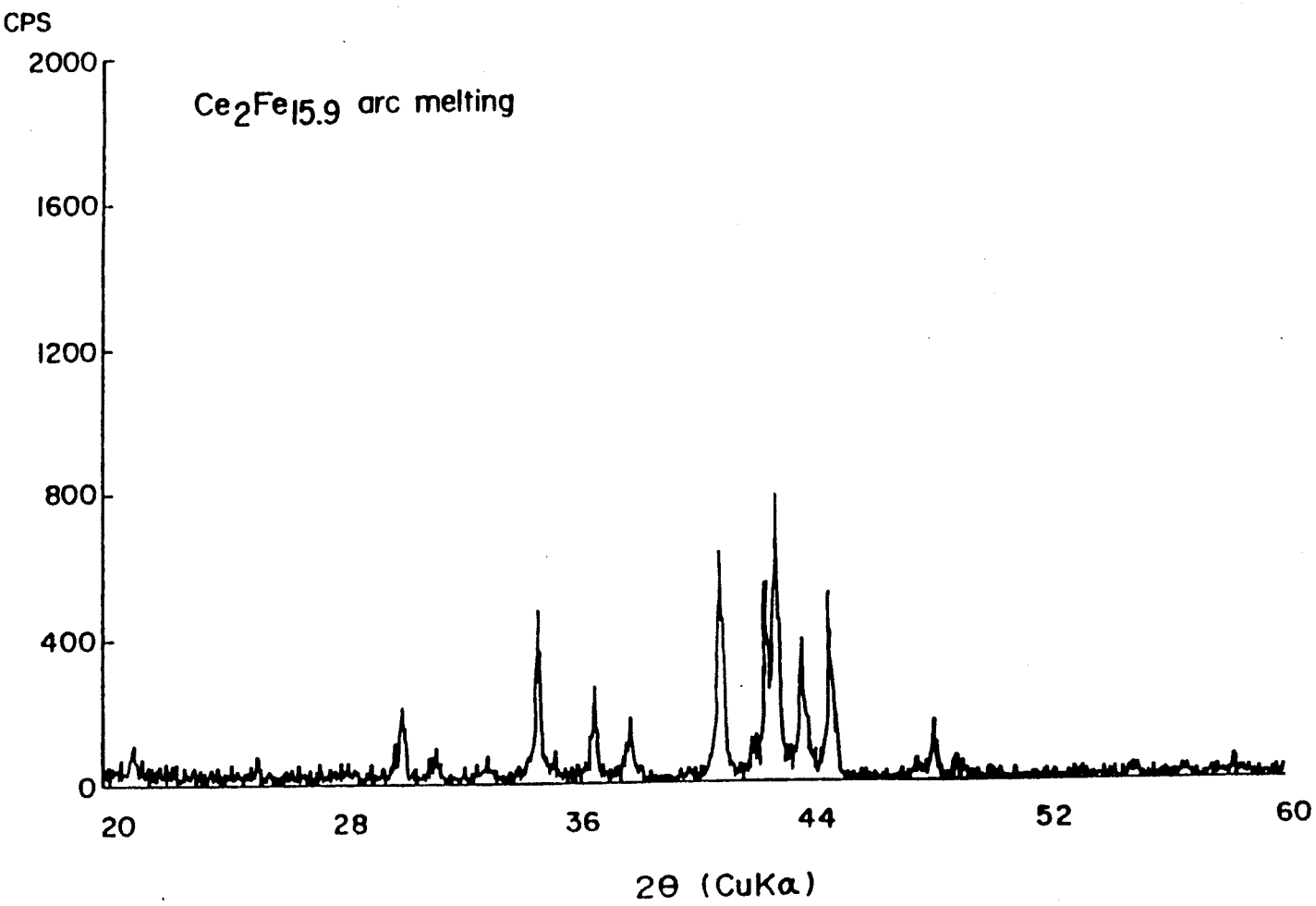

FIG. 4-(b)
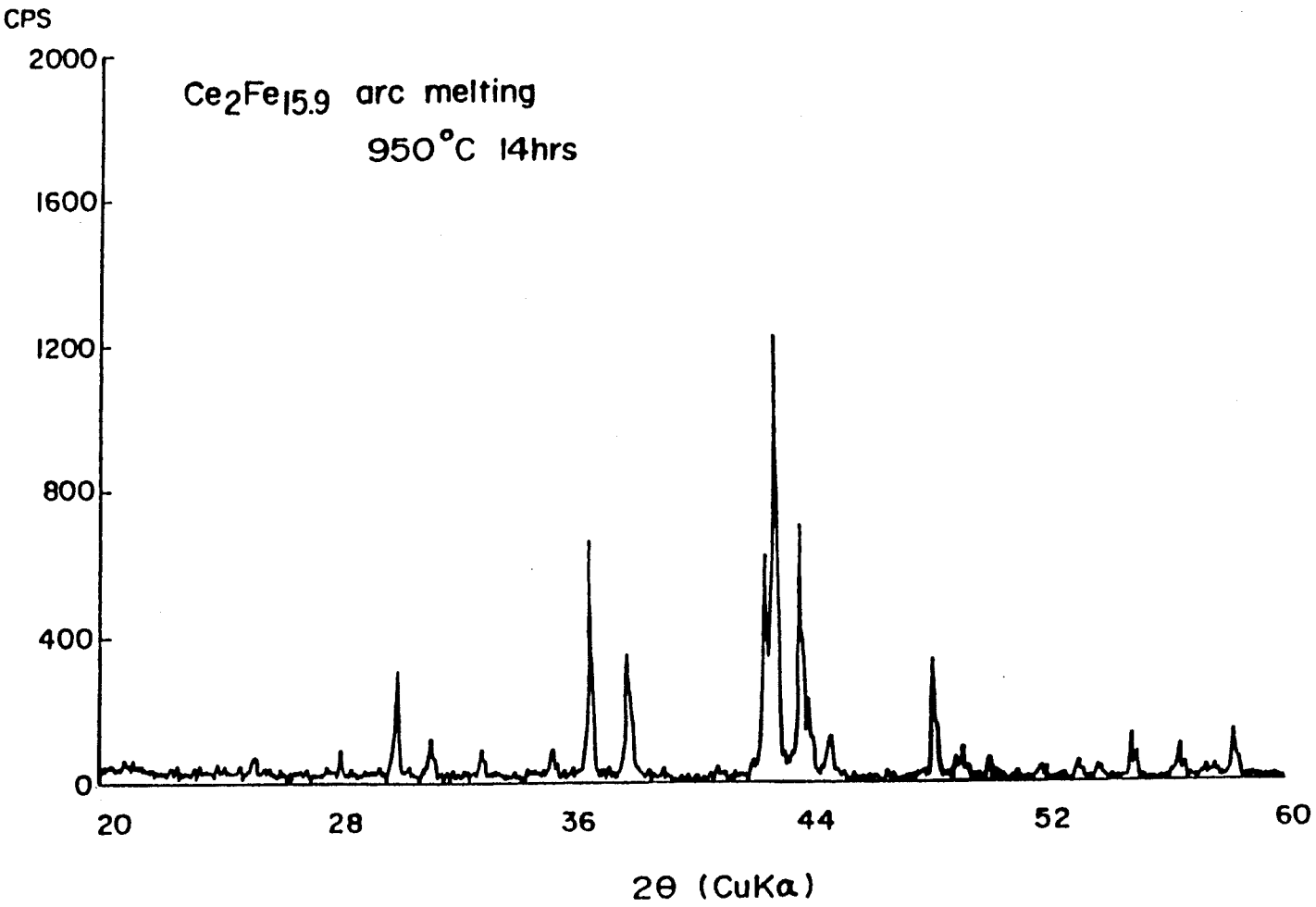

FIG. 4-(c)
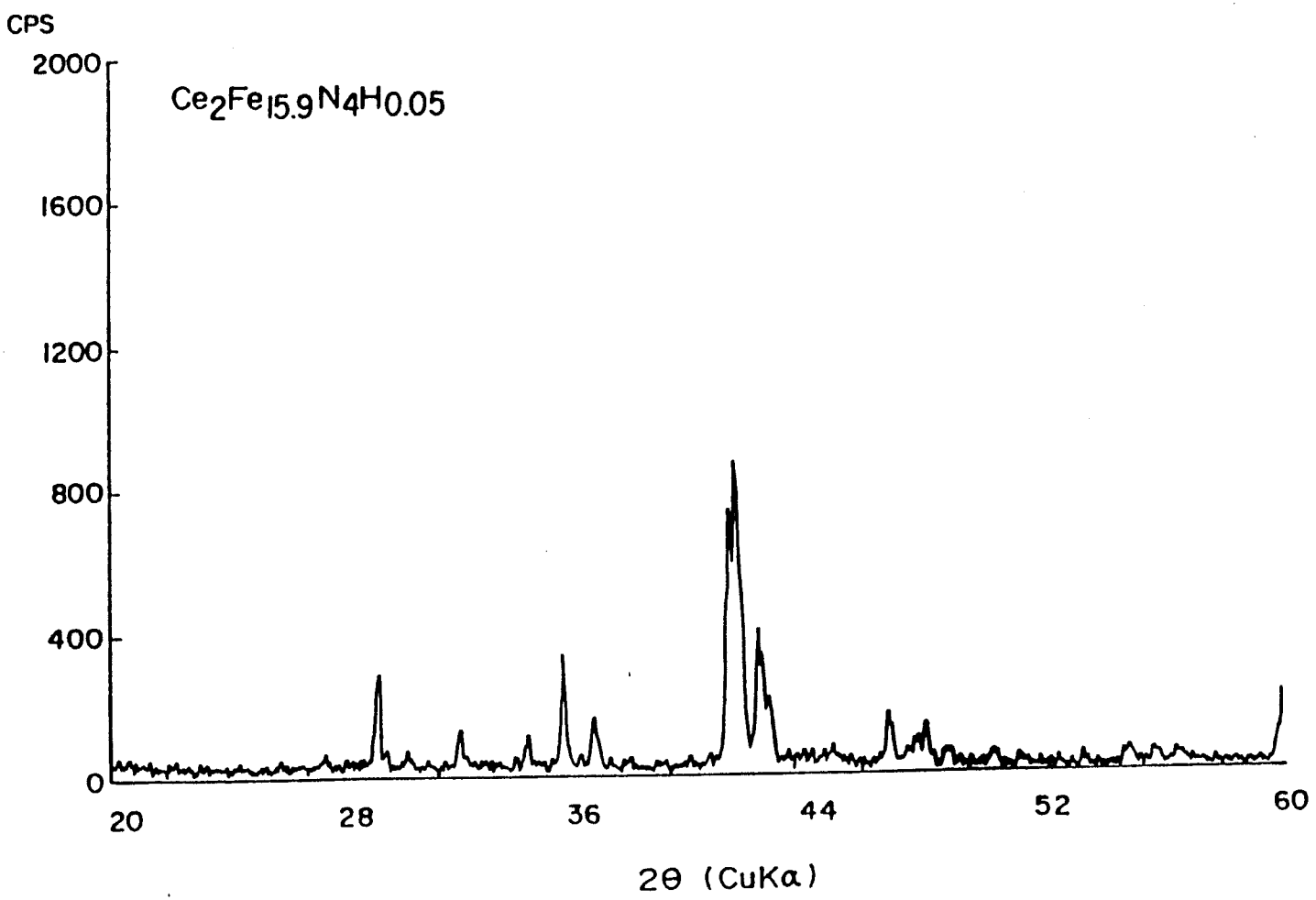

FIG. 5-(a)
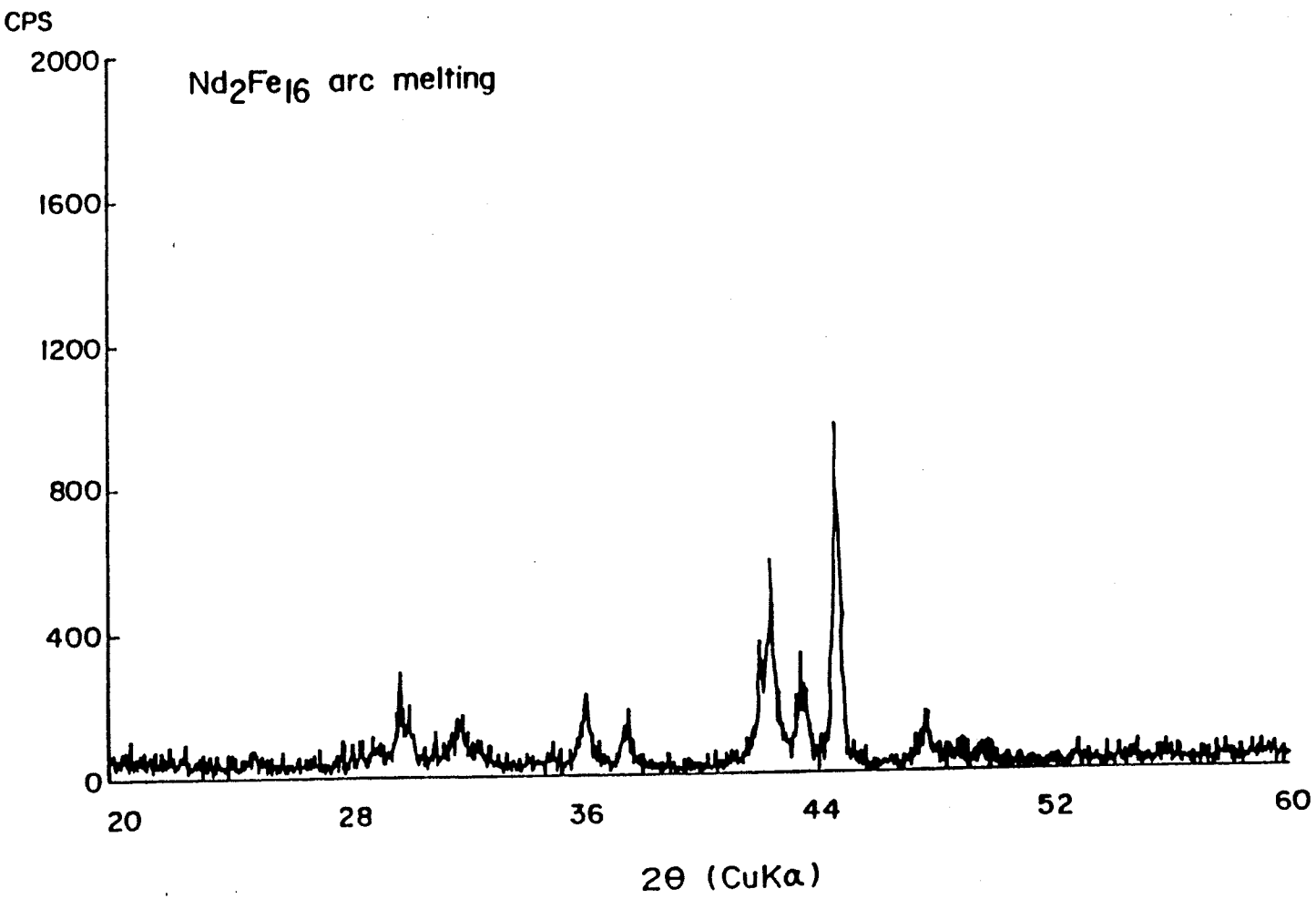

FIG. 5-(b)
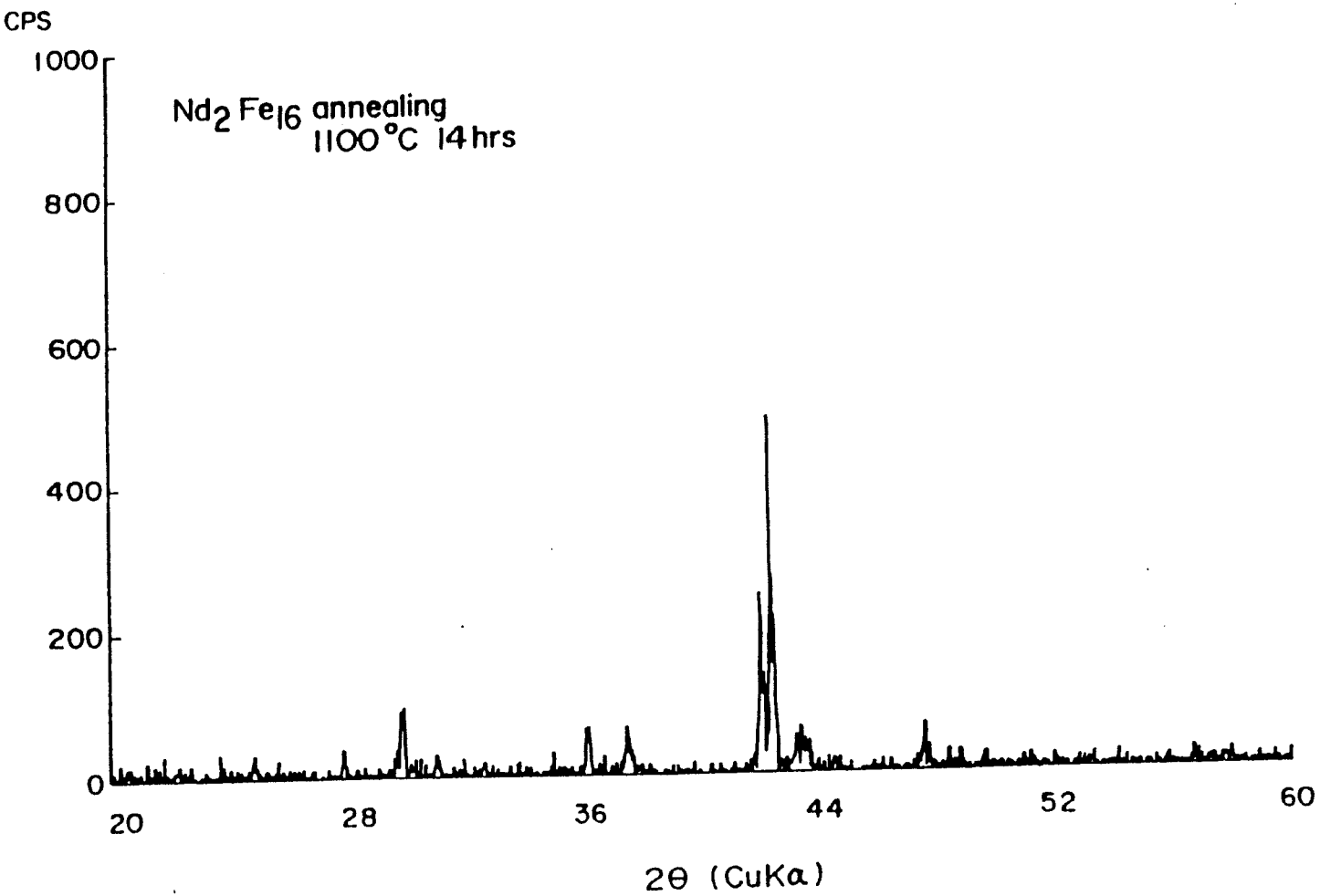

FIG. 5-(c)
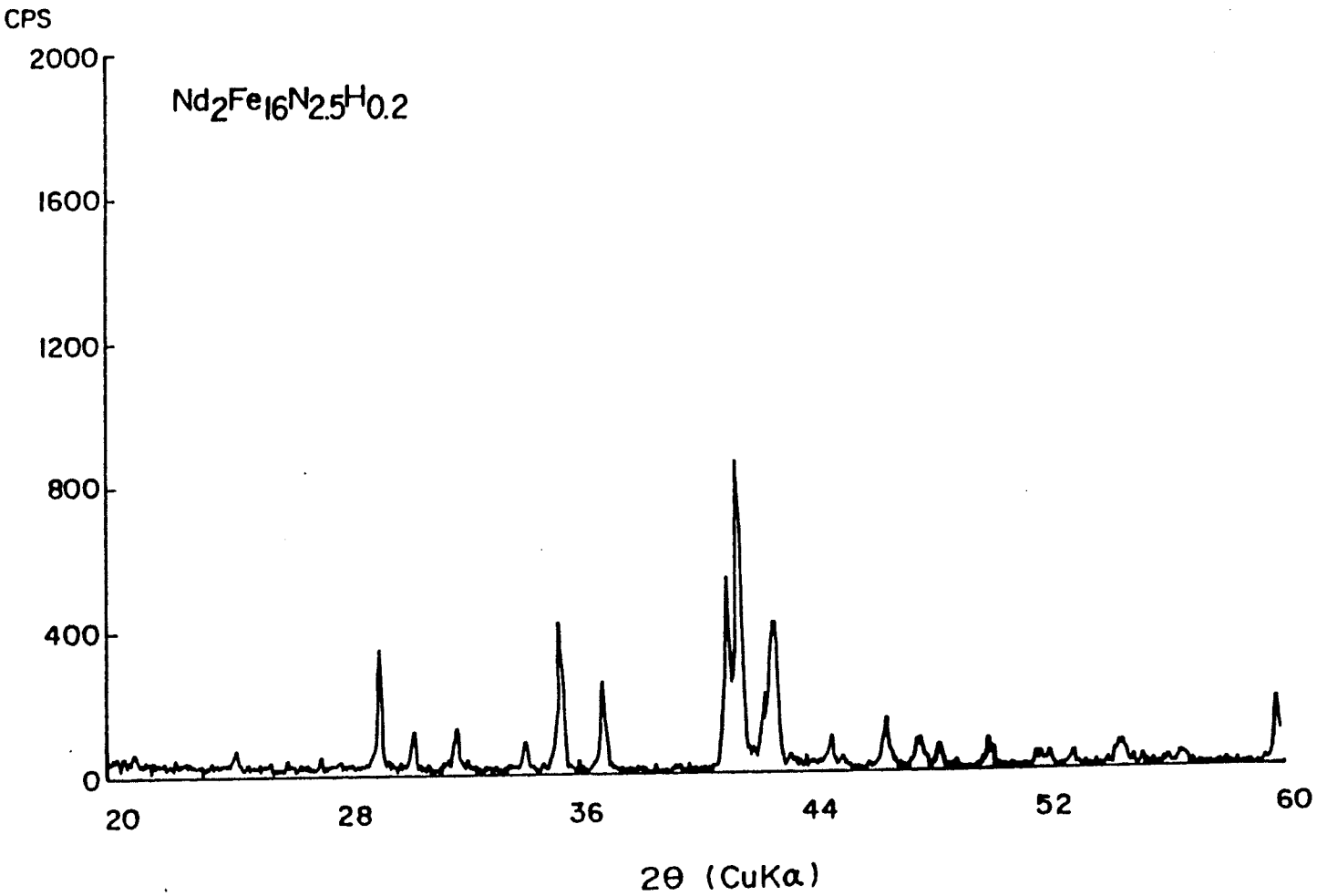

FIG.6-(a)
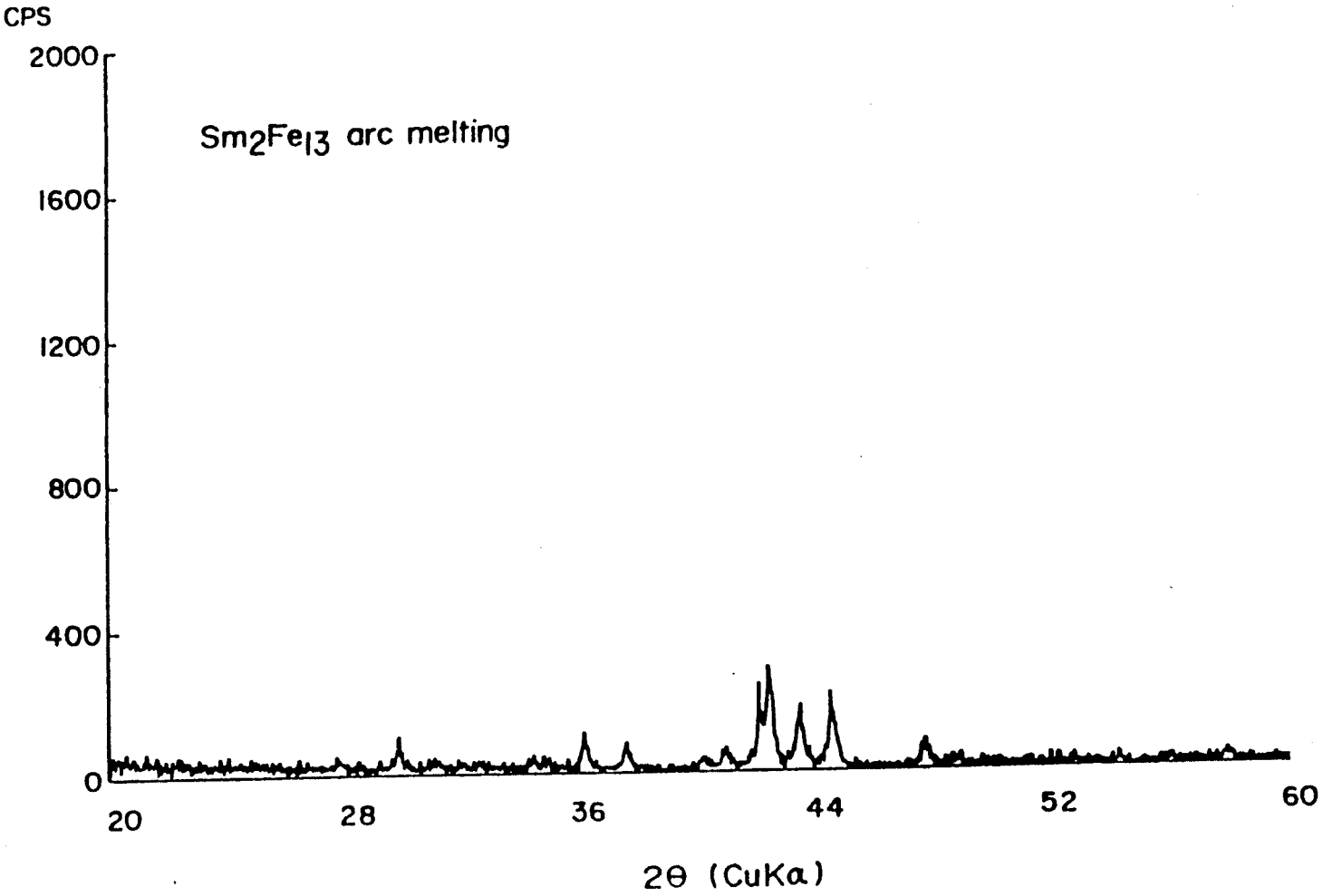

FIG. 6-(b)
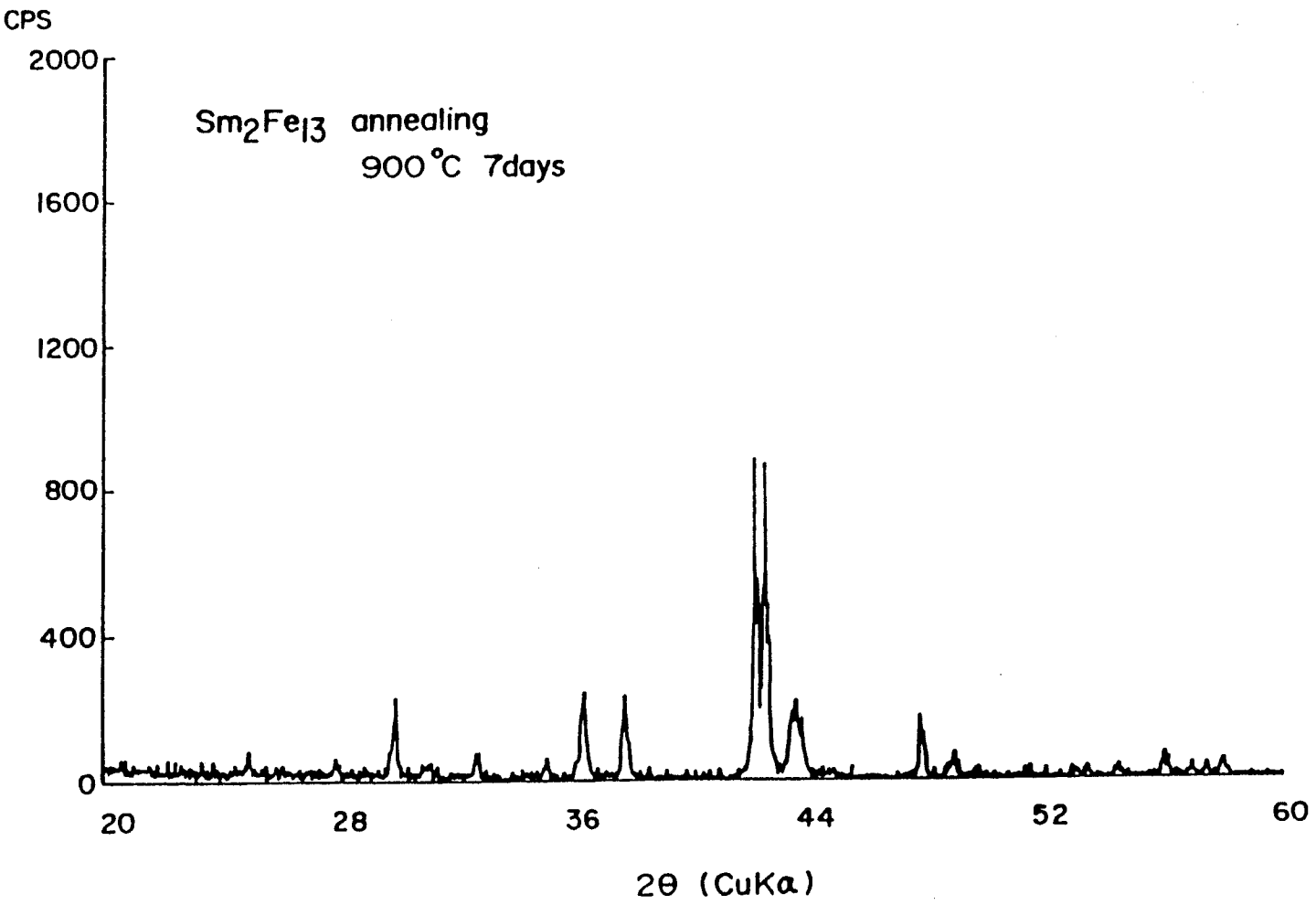

FIG. 6-(c)
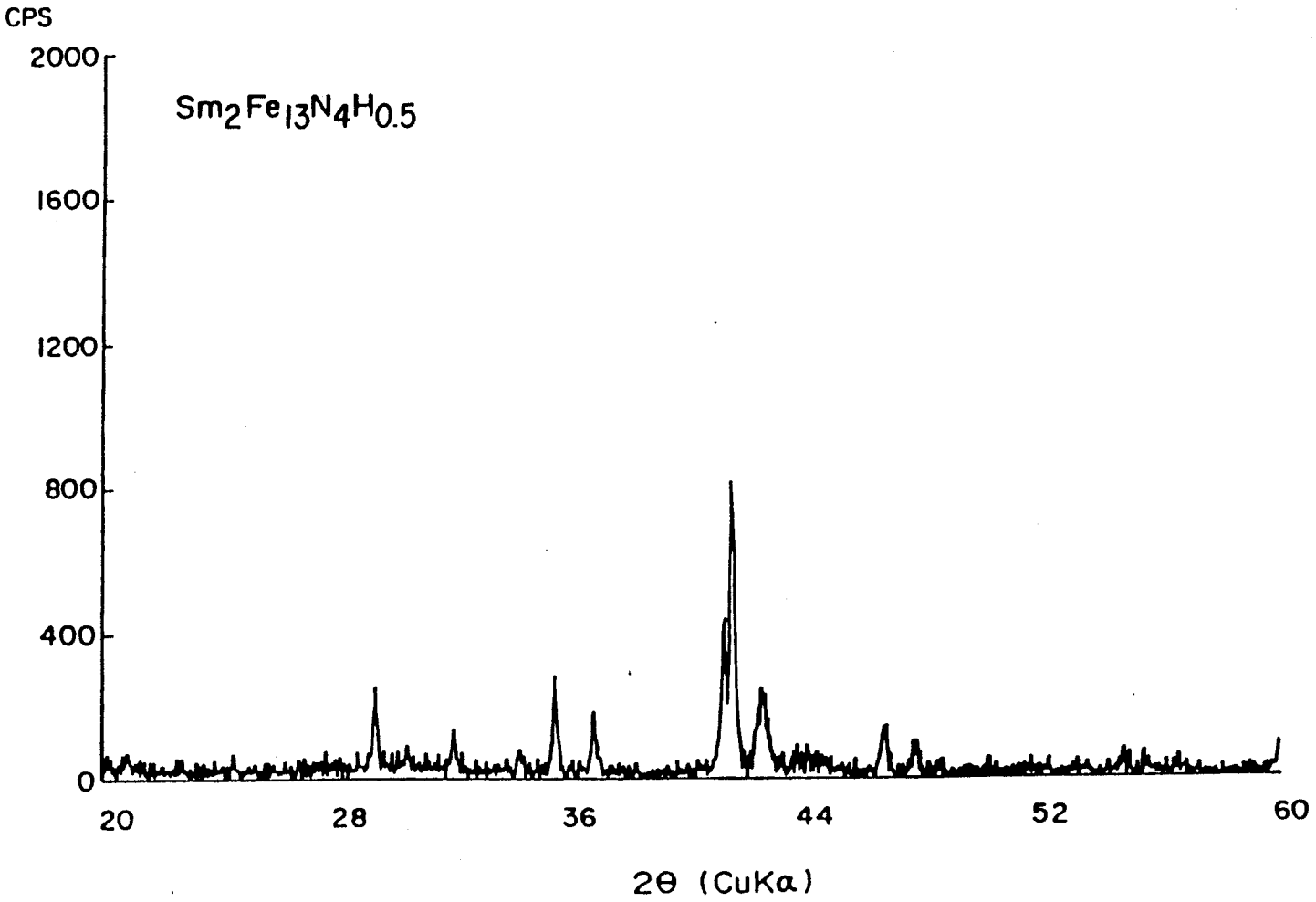

CRYSTAL STRUCTURE OF $R_2Fe_{17}$

FIG.8-(a)
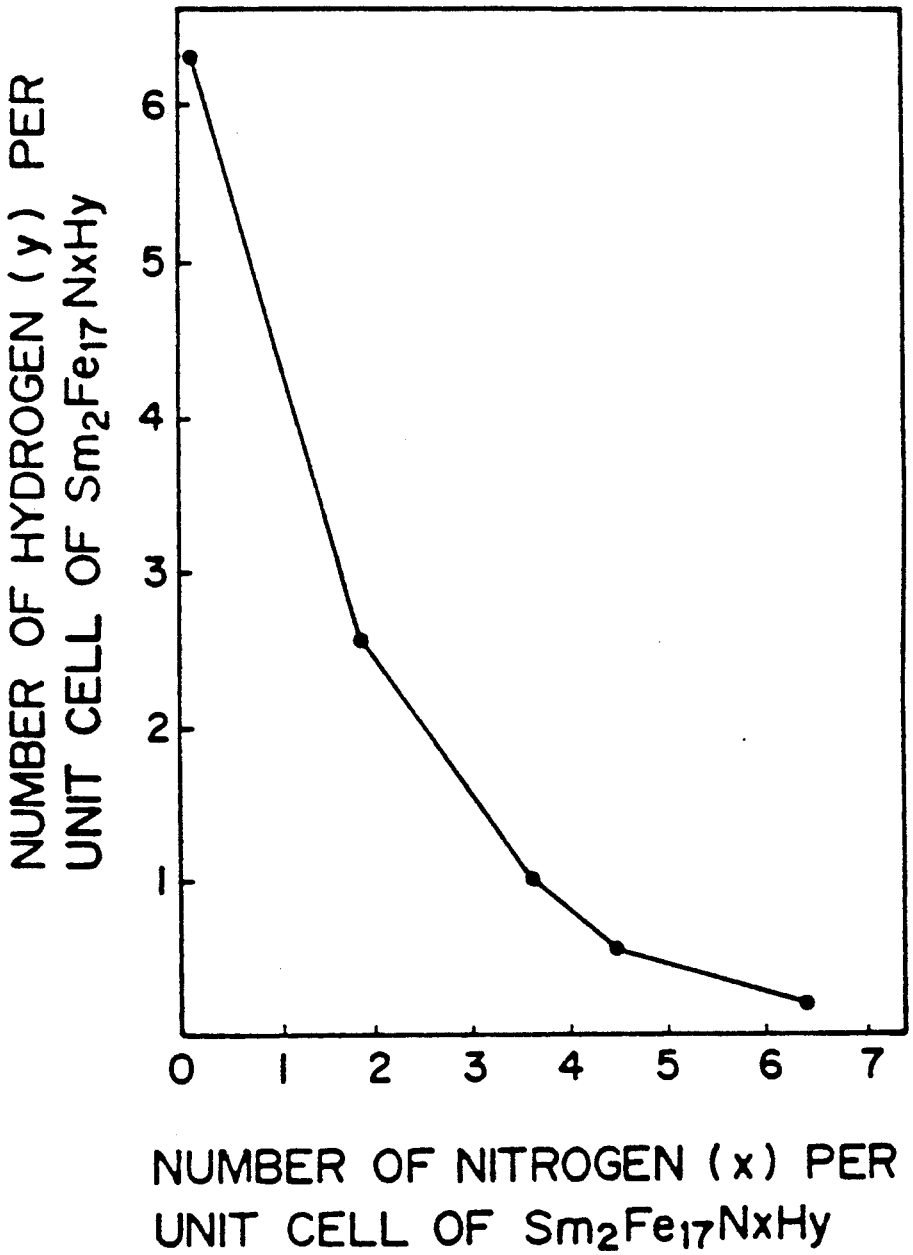

FIG. 8-(b)
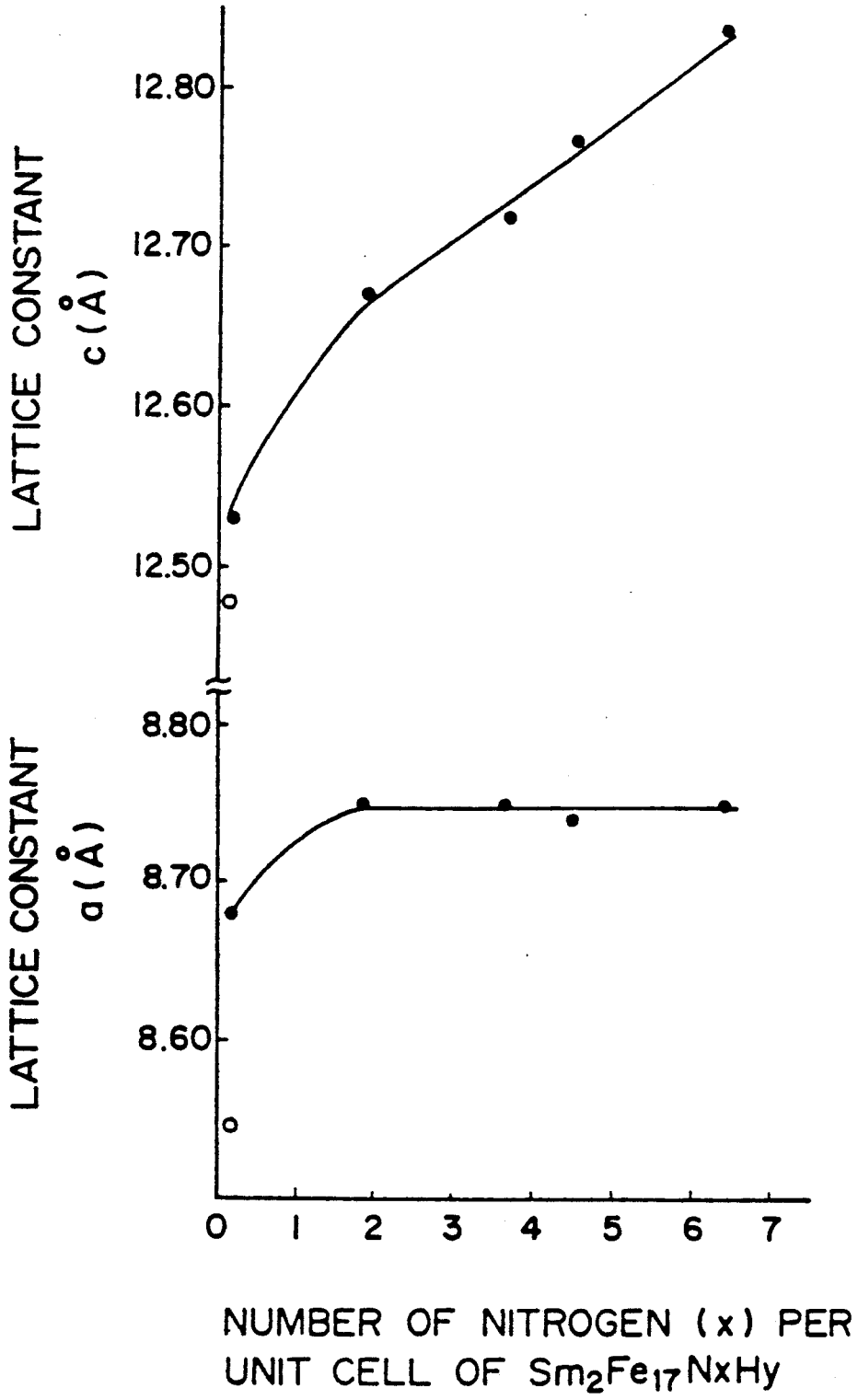

FIG. 8-(c)
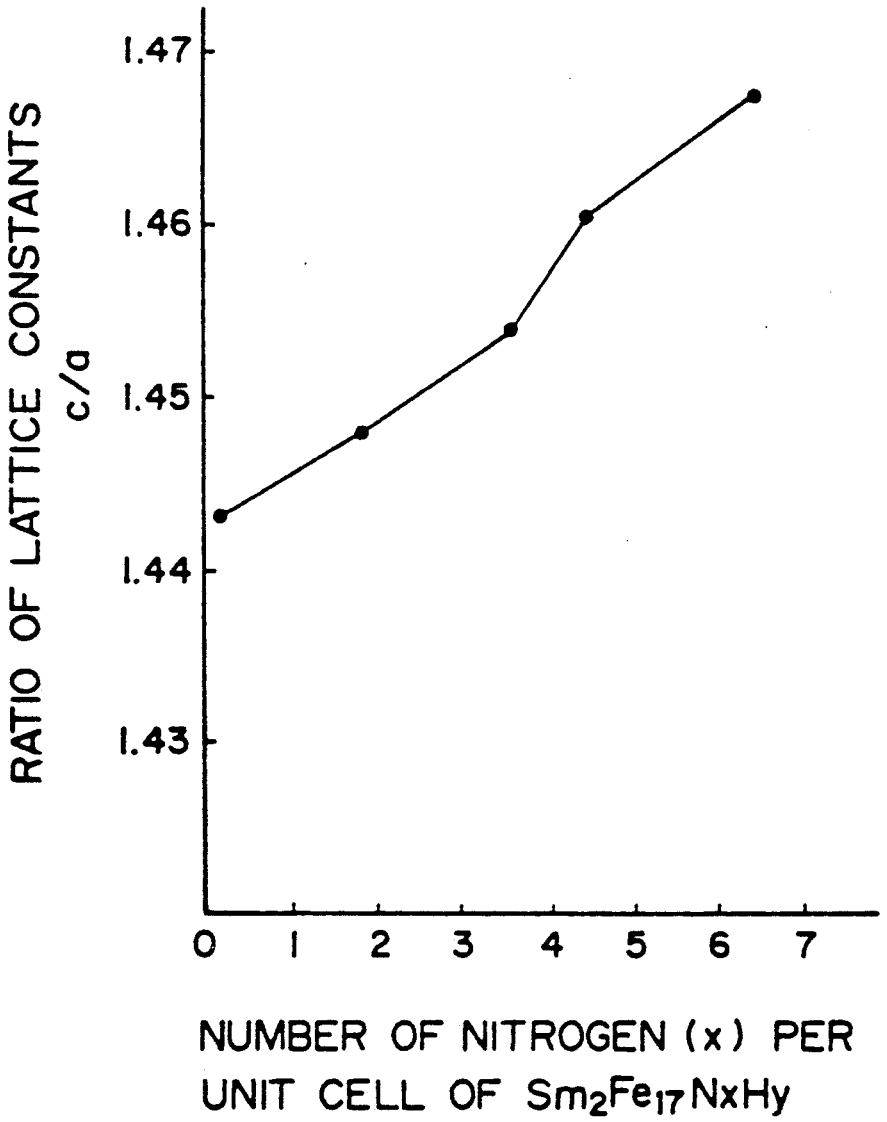

FIG.8-(d)
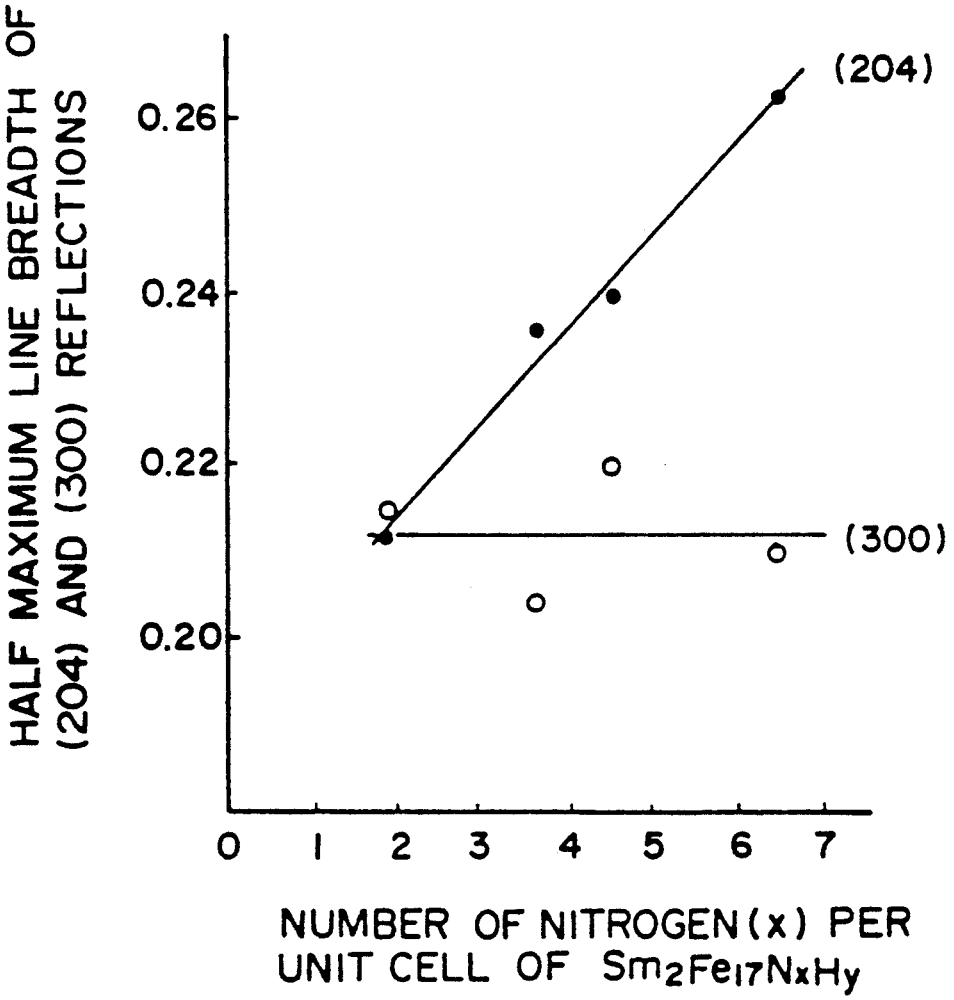

FIG. 8-(e)
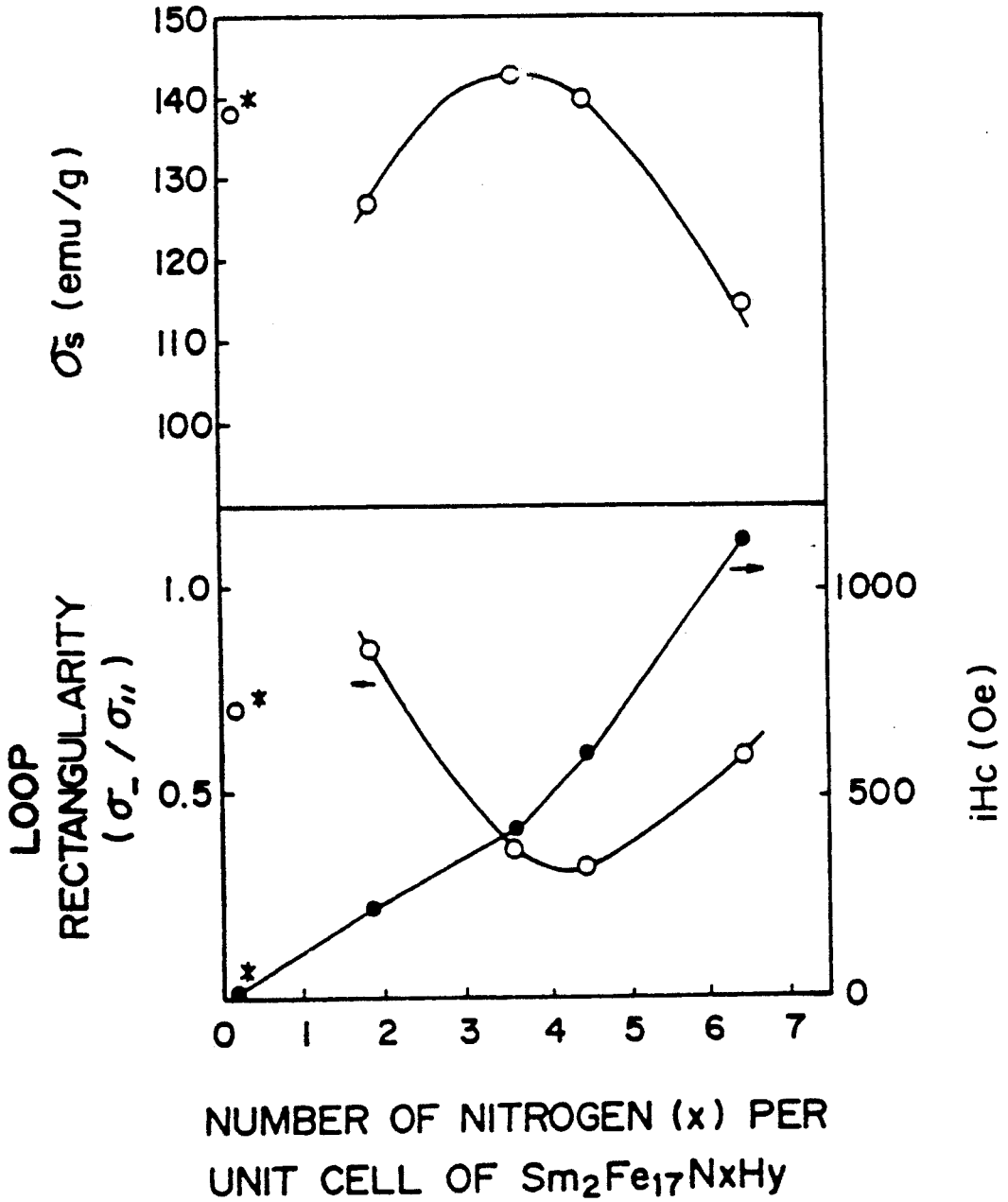

FIG. 9-(a)
( $P_{total} = P_{NH_3} + P_{H_2} = 1$ )
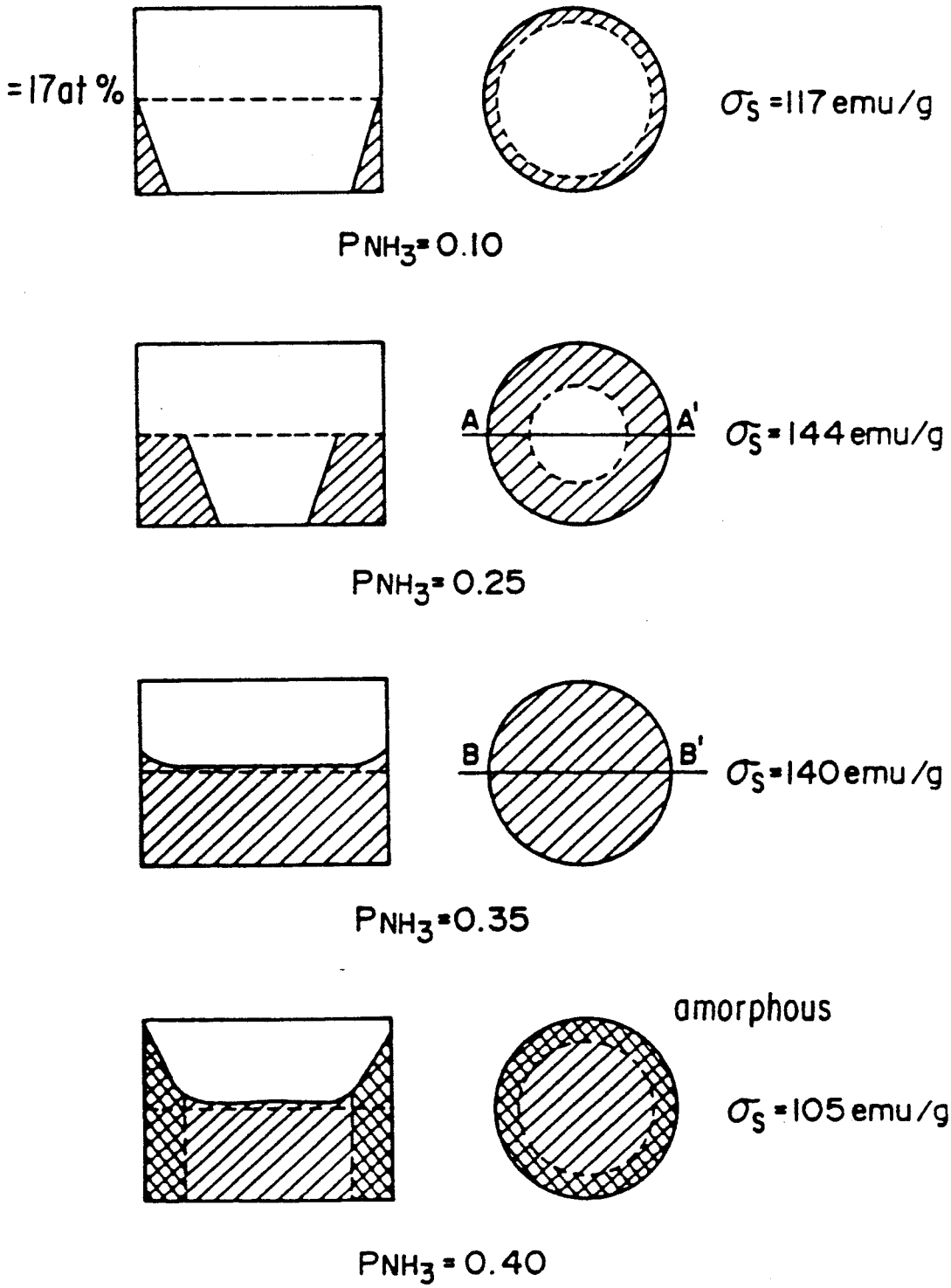

FIG. 9-(b)
($P_{NH_3}$ = 0.25 , $P_{H_2}$ = 0.75 )
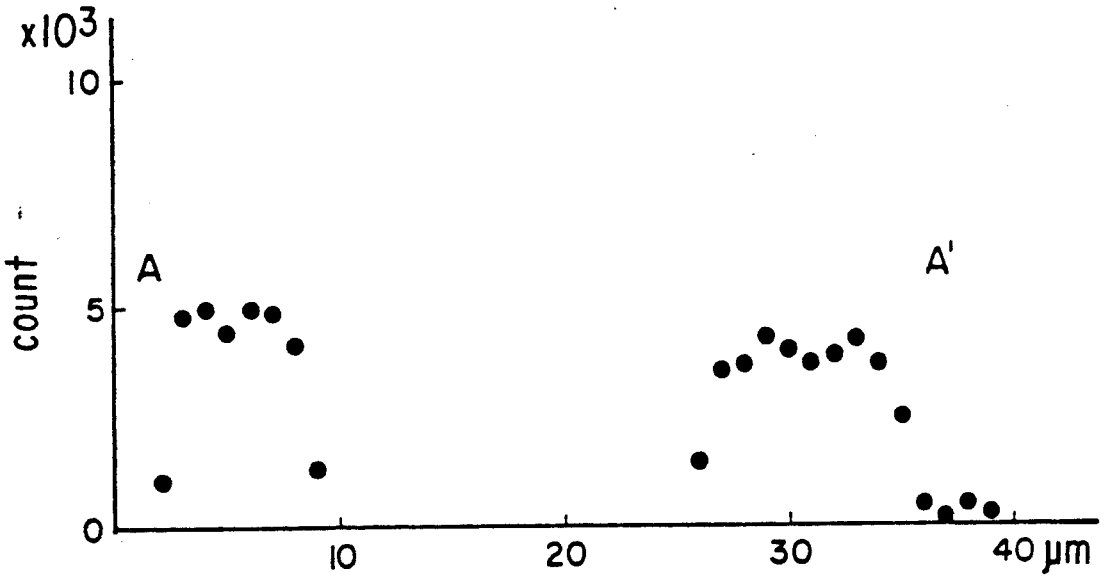
FIG. 9-(c)
($P_{NH_3}$=0.35 , $P_{H_2}$=0.65 )
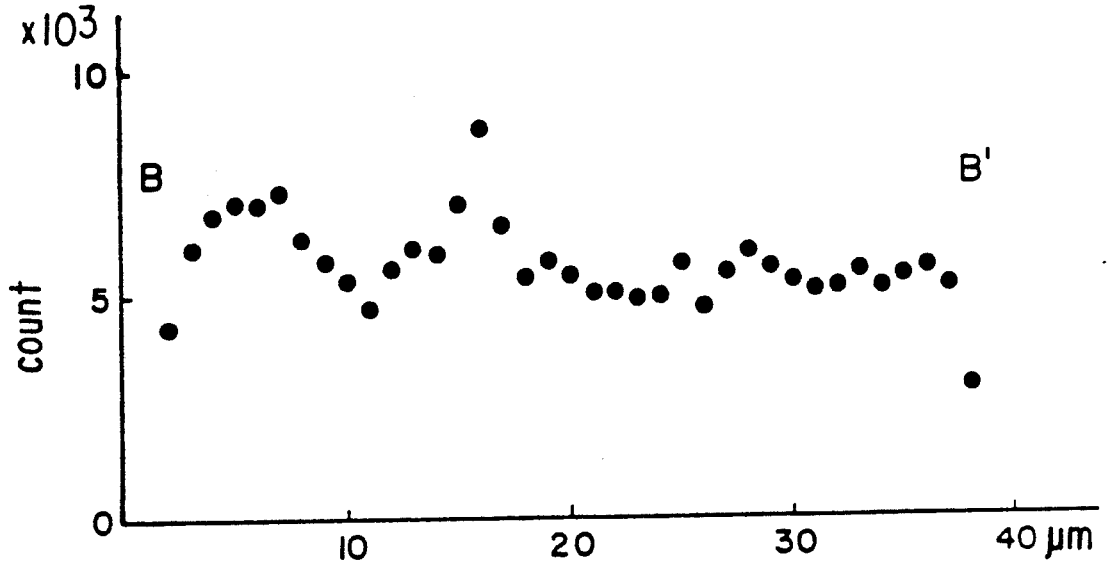

FIG. 13-(a)
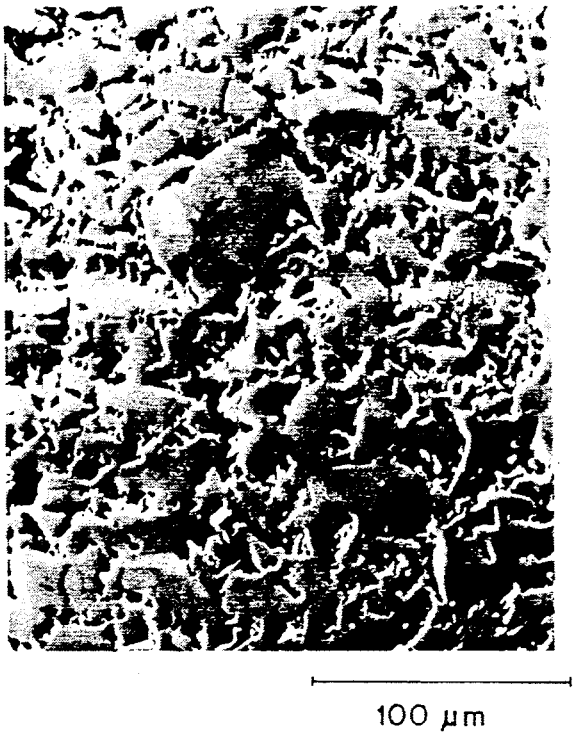
FIG. 13-(b)
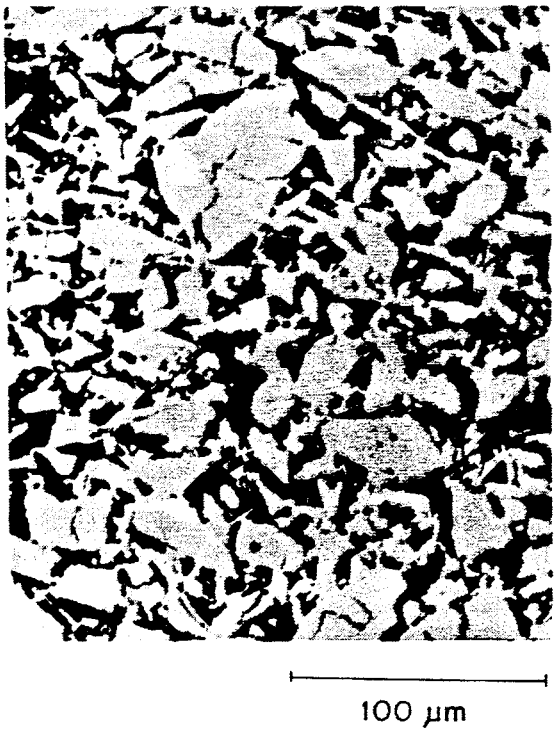

FIG. 13-(c)
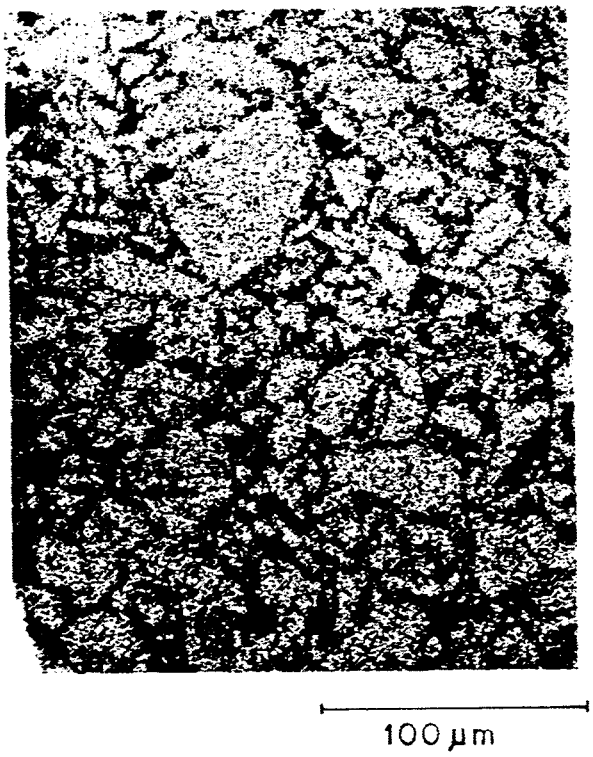
FIG. 13-(d)
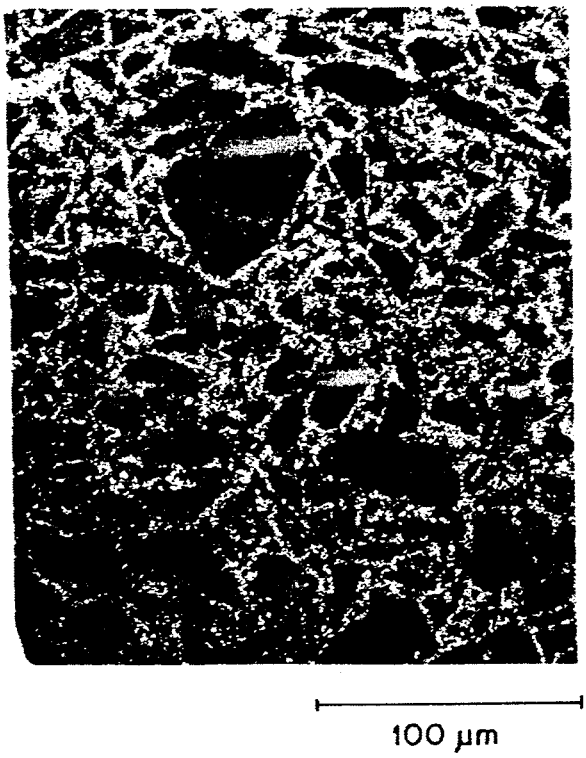

FIG. 14-(a)
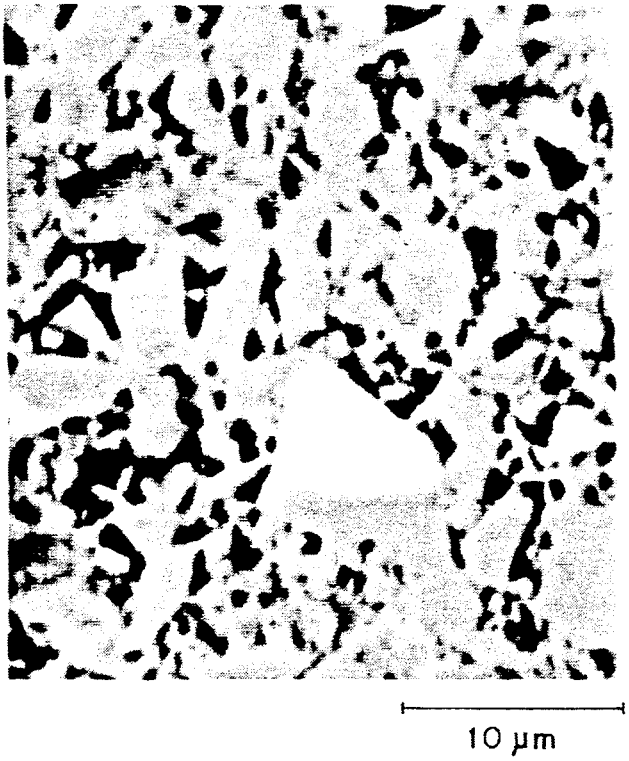
FIG. 14-(b)
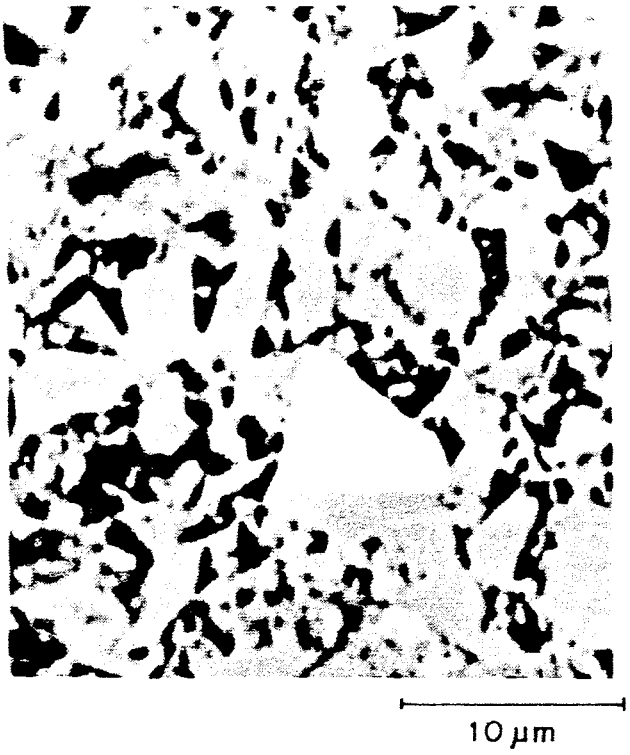

FIG. 14-(c)
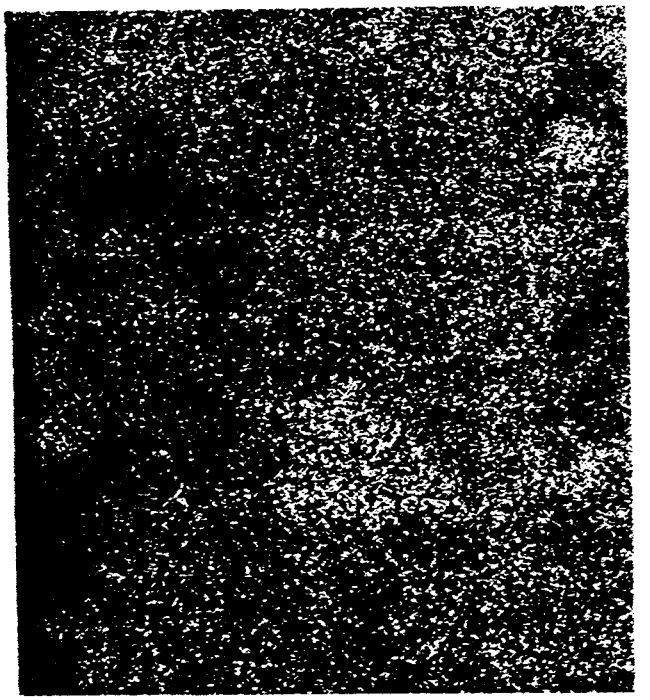
10 μm
FIG. 14-(d)
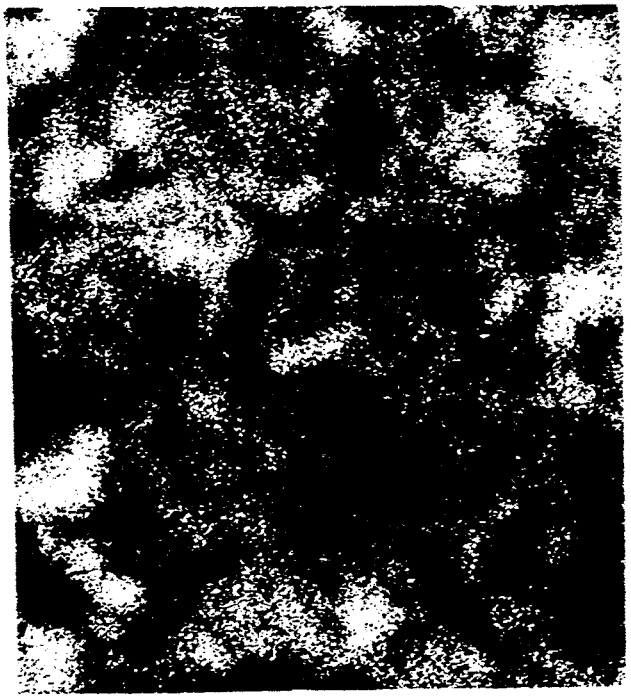
10 μm

FIG. 17-(a)
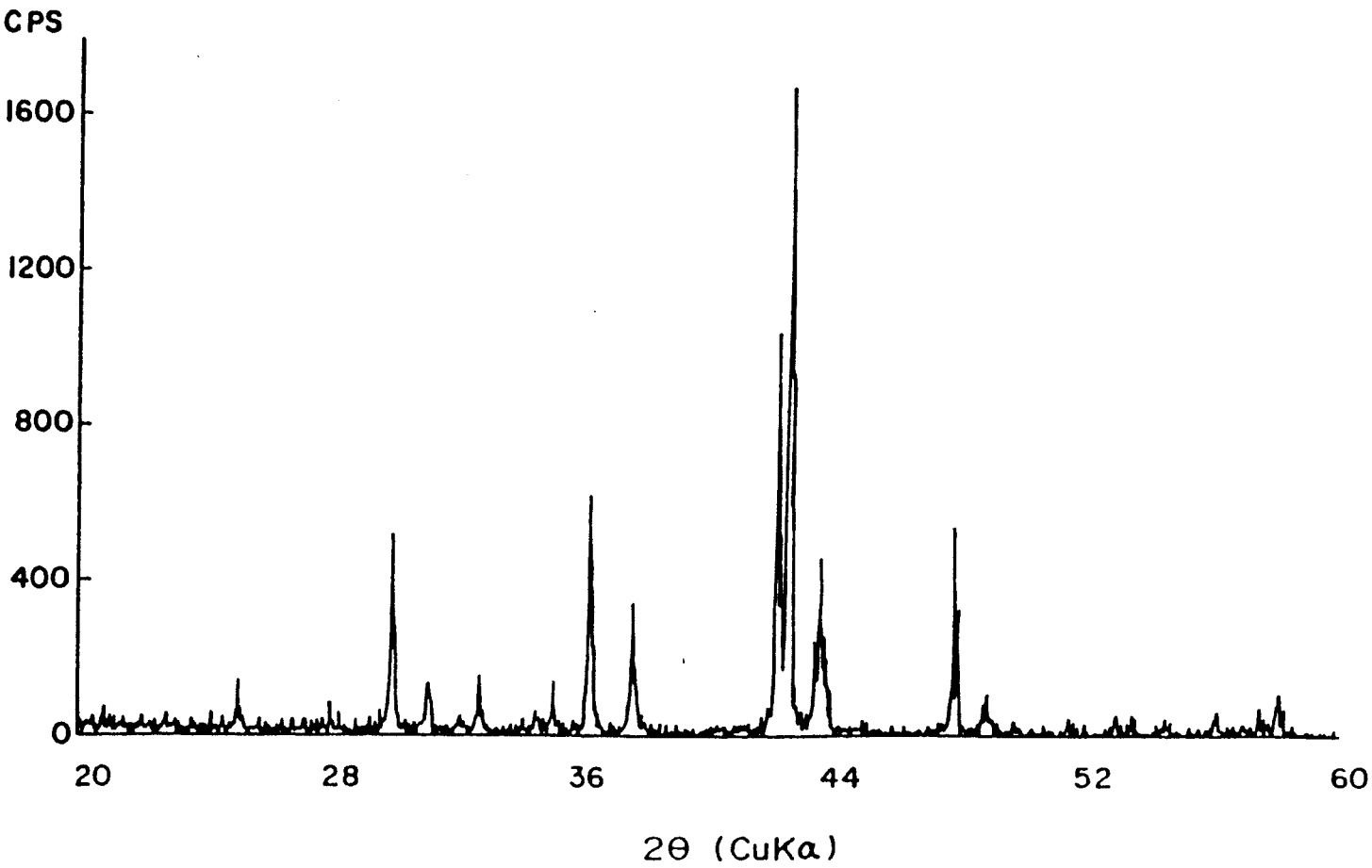

FIG. 17-(b)
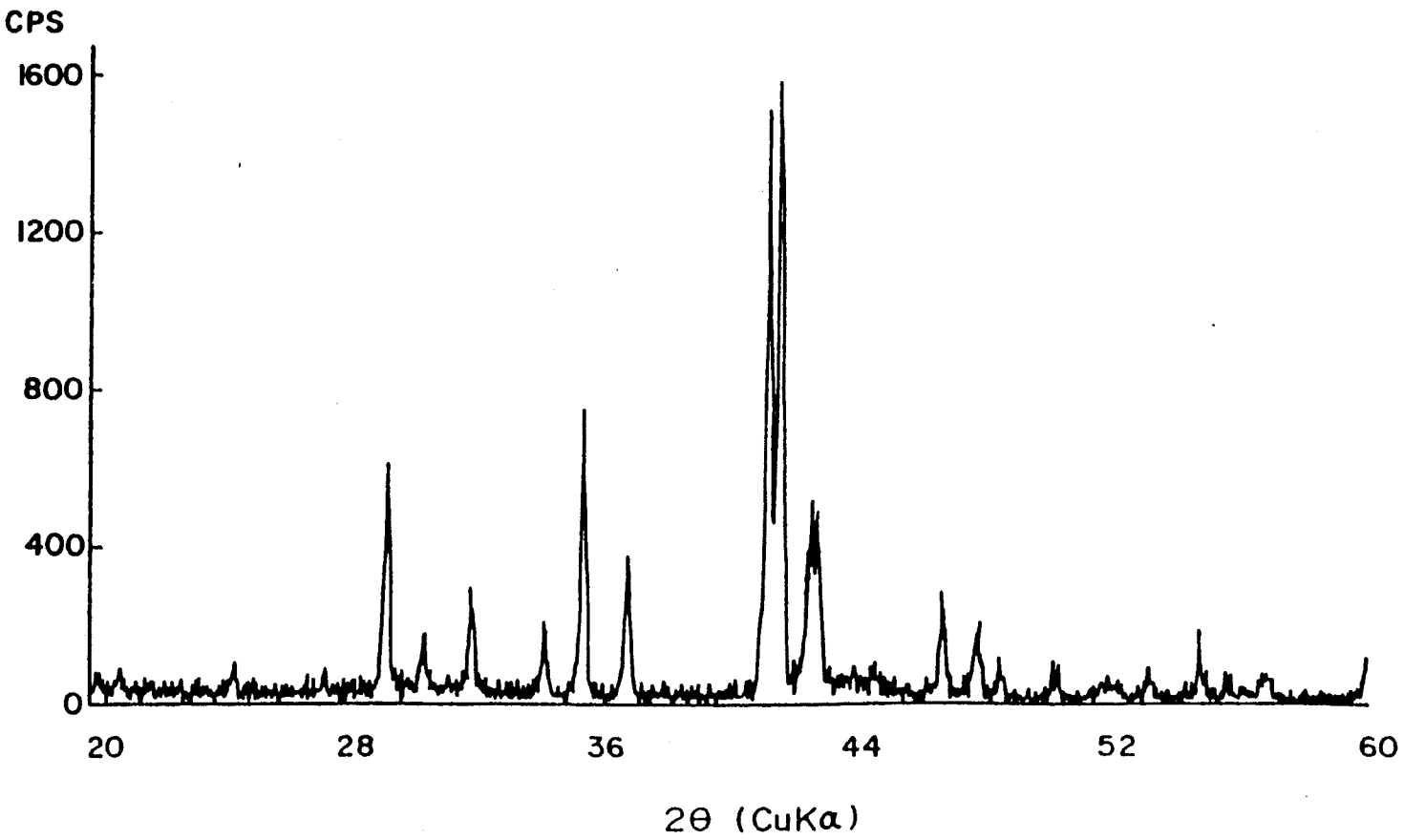

MAGNETIC MATERIALS CONTAINING RARE EARTH ELEMENT IRON NITROGEN AND HYDROGEN

CONTINUING APPLICATION DATA

This application is a continuation of U.S. patent application Ser. No. 07/323,910 filed Mar. 15, 1989, now abandoned.

BACKGROUND OF THE INVENTION

1. Field of the Invention

The present invention relates to magnetic materials comprising at least one rare earth element, iron, nitrogen and hydrogen and bonded or sintered magnets obtained therefrom and processes for preparing the same.

2. Description of the Prior Art

Magnetic materials and permanent magnets are one of the important electric and electronic materials employed in a wide range of from small magnets for various motors and actuators to large magnets for magnetic resonance imaging equipment. In view of recent needs for miniaturization and high efficiency, there has been an increased demand for rare earth permanent magnets of samarium-cobalt (Sm-Co) and neodymium-iron-boron (Nd-Fe-B) systems due to their high efficiency. The Sm-Co permanent magnets are now practically used and one composition of them having a high efficiency shows a high maximum energy product [herein "$(BH)_{max}$"] of 29.6 MGOe and a Curie temperature (herein "Tc") of 917° C. In order to develop a magnetic material containing less or no Sm and Co which are less abundant resources, permanent magnets of the Nd-Fe-B system are provided and the saturation magnetization (herein "$4\pi$Is" or "$\sigma$s") of one composition in single crystal reaches 16 KG with a $(BH)_{max}$ of about 40 MGOe, but the Tc is as low as 312° C. and the resistance to oxidation is not sufficient. Accordingly, the incorporation of Co with the Nd-Fe-B system is tried to increase the Tc but with a decreased intrinsic coersive force (herein "iHc"). Further, the incorporation of Co and Al or Ga with the Nd-Fe-B system is tried to give a permanent magnet having a Tc of 500° C. and a $(BH)_{max}$ of 35 to 40 but the resistance to oxidation is still not enough, and for practical purposes the treatment such as ion coating and plating is required.

Further, many studies are conducted on iron nitride having a high $4\pi$Is in the form of a thin film for magnetic recording media or magnetic head materials. However, iron nitride has a low iHc and is difficult to be used as a bulk permanent magnetic material. Thus, in order to increase an iHc, the incorporation of nitrogen as a third component with rare earth-iron (R-Fe) alloys is tried but sufficient magnetic properties have not been obtained. Also, the incorporation of hydrogen with the R-Fe alloys is studied and the increase in $4\pi$Is is observed but such R-Fe alloys containing hydrogen which can be used as permanent magnetic materials have not been obtained.

The magnetic properties of the magnetic materials, bonded magnets and sintered magnets include, herein, saturation magnetization (herein "$4\pi$Is" or "$\sigma$s"), residual magnetization (herein "Br"), intrinsic coercive force (Herein "iHc"), magnetic anisotropy, magnetic anisotropy energy (herein "Ea"), loop rectangularity (herein "Br/$4\pi$Is"), maximum energy product (herein "$(BH)_{max}$"), Curie temperature (herein "Tc") and rate of thermal demagnetization.

SUMMARY OF THE INVENTION

It is, therefore, an object of the present invention to provide magnetic materials having a high magnetic anisotropy and iHc as well as a high $4\pi$Is which can be used as a bulk permanent magnetic material.

Another object is to provide magnetic materials having a good resistance to oxidation and to deterioration of the magnetic properties.

A further object is to provide sintered magnets having high magnetic properties which do not require the annealing of the as sintered magnets.

Those and other objects will be apparent from the entire disclosure given hereunder.

More specifically, according to the present invention there are provided a magnetic material represented by the formula $$R_{60}Fe_{(100-\alpha-\beta-\gamma)}N_{\beta}H_{\gamma} \quad (I)$$

wherein

R is at least one rare earth element inclusive of Y, $\alpha$ is 5 to 20 atomic percent, $\beta$ is 5 to 30 atomic percent and $\gamma$ is 0.01 to 10 atomic percent, a magnetic material represented by the formula $$R_{\alpha}Fe_{(100-\alpha-\beta-\gamma-\delta)}N_{\beta}H_{\gamma}M_{\delta} \quad (II)$$

wherein

R, $\alpha$, $\beta$ and $\gamma$ is the same as defined above,

M is at least one additive selected from the group consisting of Sn, Ga, In, Bi, Pb, Zn, Al, Zr, Cu, Ti, Mo, Si, MgO, $Al_2O_3$, $Sm_2O_3$, $AlF_3$, $ZnF_2$, SiC, TiC, AlN and $Si_3N_2$, and $\delta$ is 0.1 to 40 atomic percent, a sintered magnet having a major phase formed of at least one magnetic material represented by formula (I), a sintered magnet consisting essentially of at least one magnetic material represented by formula (II) and having a two-phase microstructure wherein a major phase is formed of the magnetic material represented by formula (I) or a major phase is formed of a major amount of the magnetic material represented by formula (I) in the center portion of the grain and a minor phase is formed of a major amount of M in formula (II) and diffused in the grain boundaries of the major phase and a bonded magnet formed of particles of the magnet material of formula (I) or (II) maintained in a desired magnet shape by a binding agent interspersed therebetween.

DESCRIPTION OF THE DRAWINGS

FIGS. 2-(*a*) to 2-(*c*), FIGS. 3-(*a*) to 3-(*c*), FIGS. 4-(*a*) to 4-(*c*), FIGS. 5-(*a*) to 5-(*c*) and FIGS. 6-(*a*) to 6-(*c*) are X-ray powder diffraction patterns of the magnetic materials at each of the preparation steps i.e., (a) the starting alloys (b) the starting alloys after annealing and (c) the alloys after the absorption of nitrogen and hydrogen according to the present invention.

FIGS. 8-(*a*) to 8-(*e*) show variations of the number of the hydrogen absorbed, the lattice constants of a-axis and c-axis, the ratios of lattice constants of c-axis to a-axis, the half maximum line breadth of (204) and (300) reflections and the magnetic properties, respectively, with the increase in the number of the nitrogen absorbed per unit of $Sm_2Fe_{17}$ when the rhombohedral $Sm_2Fe_{17}$ alloy powder having an average particle diameter of 40 μm was contacted at 465° C. with a mixed gas of ammonia and hydrogen by varying the partial pressure of the ammonia from 0 to 0.5 atm and the partial pressure of the hydrogen from 1 to 0.5 atm with a total pressure of 1 atm to conduct the absorption of nitrogen and hydrogen in the alloy powder.

FIGS. 9-(*a*) to 9-(*c*) show distributions and concentrations of the nitrogen absorbed in the same rhombohedral $Sm_2Fe_{17}$ alloy powder as employed above by electron probe micro analysis. In FIG. 9-(*a*) the hatched portions schematically show the distribution of the nitrogen absorbed. From FIGS. 9-(*a*) and 9-(*c*) it can be understood that the concentration of the nitrogen absorbed is uniform and the σs is as high as 140 emu/g when a mixed gas of ammonia having a partial pressure of 0.35 and hydrogen having a partial pressure of 0.65 is employed in the absorption of nitrogen and hydrogen in the alloy powder.

As may be understood from FIGS. 8-(*a*) to 8-(*e*) and 9-(*a*) to 9-(*c*), high σs is exhibited when the c-axis lattice constants are in the range of 12.70 Å to 12.80 Å and the ratios of the lattice constants of c-axis to a-axis exhibiting high magnetic properties are in the range of 1.45 to 1.46. Further, the half maximum line breadth of (300) reflection relevant only to the a-b axis plane does not correlate to the amount of the nitrogen absorbed but that of (204) reflection is increased with increased amounts of the nitrogen absorbed. This fact shows the increase in the disorder or expansion of lattices in the c-axis direction with increased amounts of the nitrogen absorbed which clearly correlates to the improvement on the σs and iHc.

Figure 1:
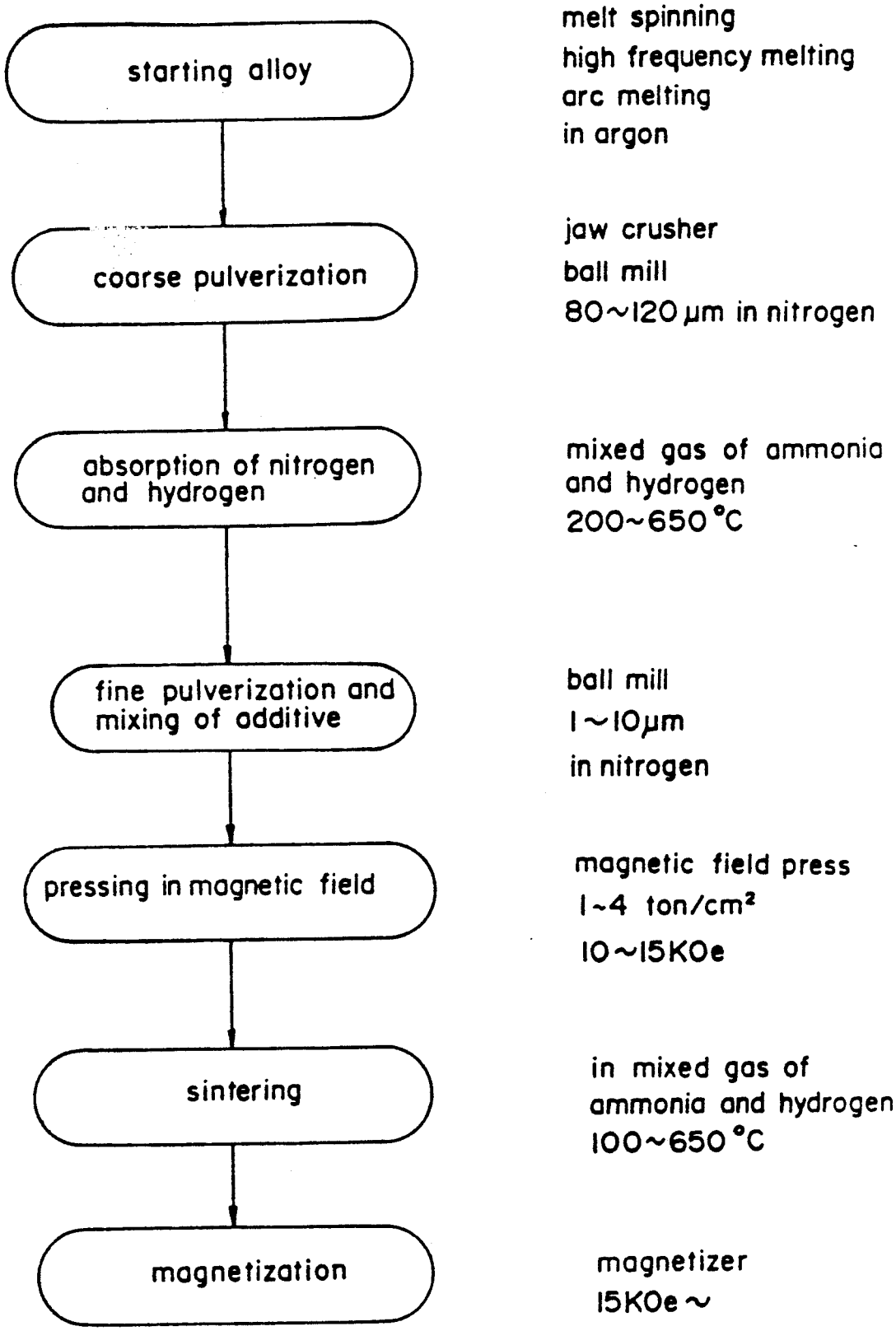
FIG. 1 is a flow chart showing one typical embodiment of the processes for making permanent magnets.
Figure 7:
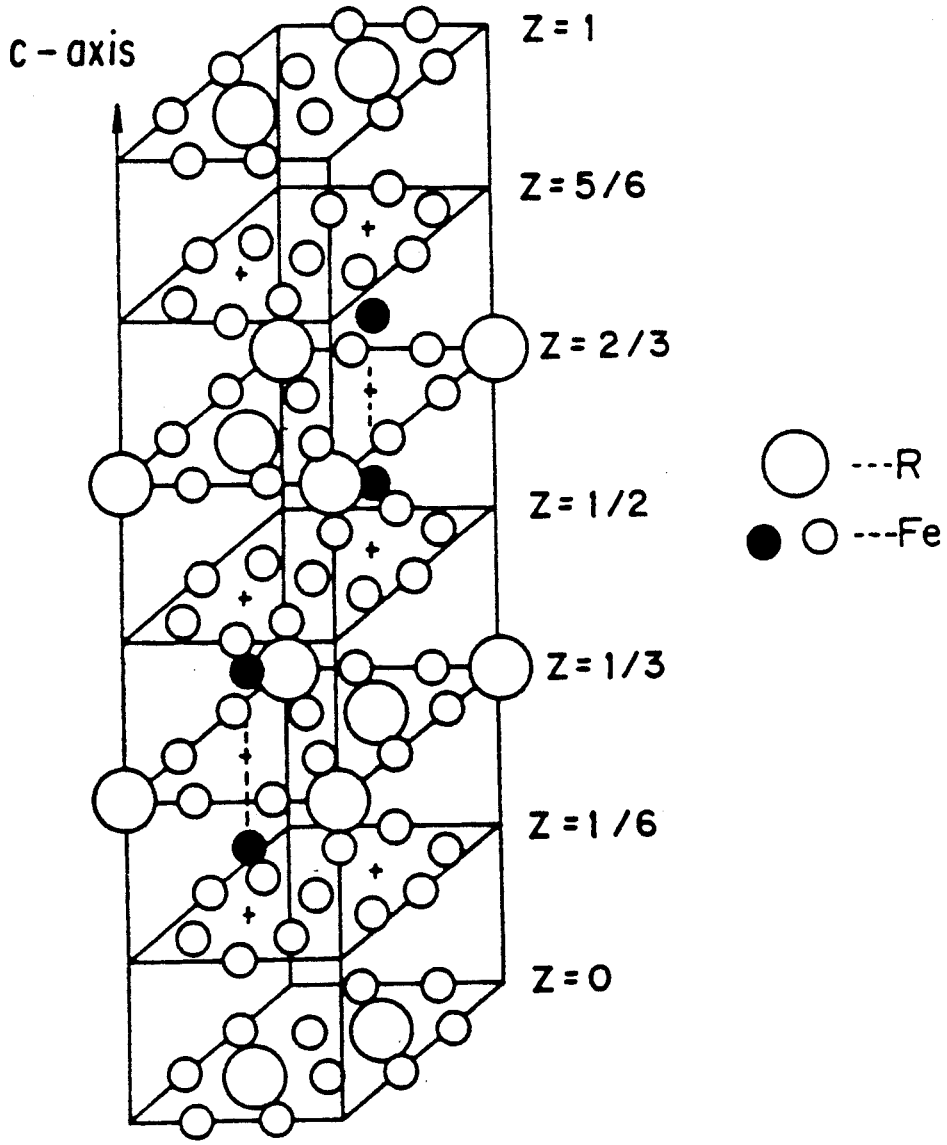
FIG. 7 shows a crystal structure of the starting rhombohedral $R_2Fe_{17}$ alloy wherein R is at least one rare earth element selected from the group consisting of Ce, Pr, Nd, Sm and Gd.
Figure 10:
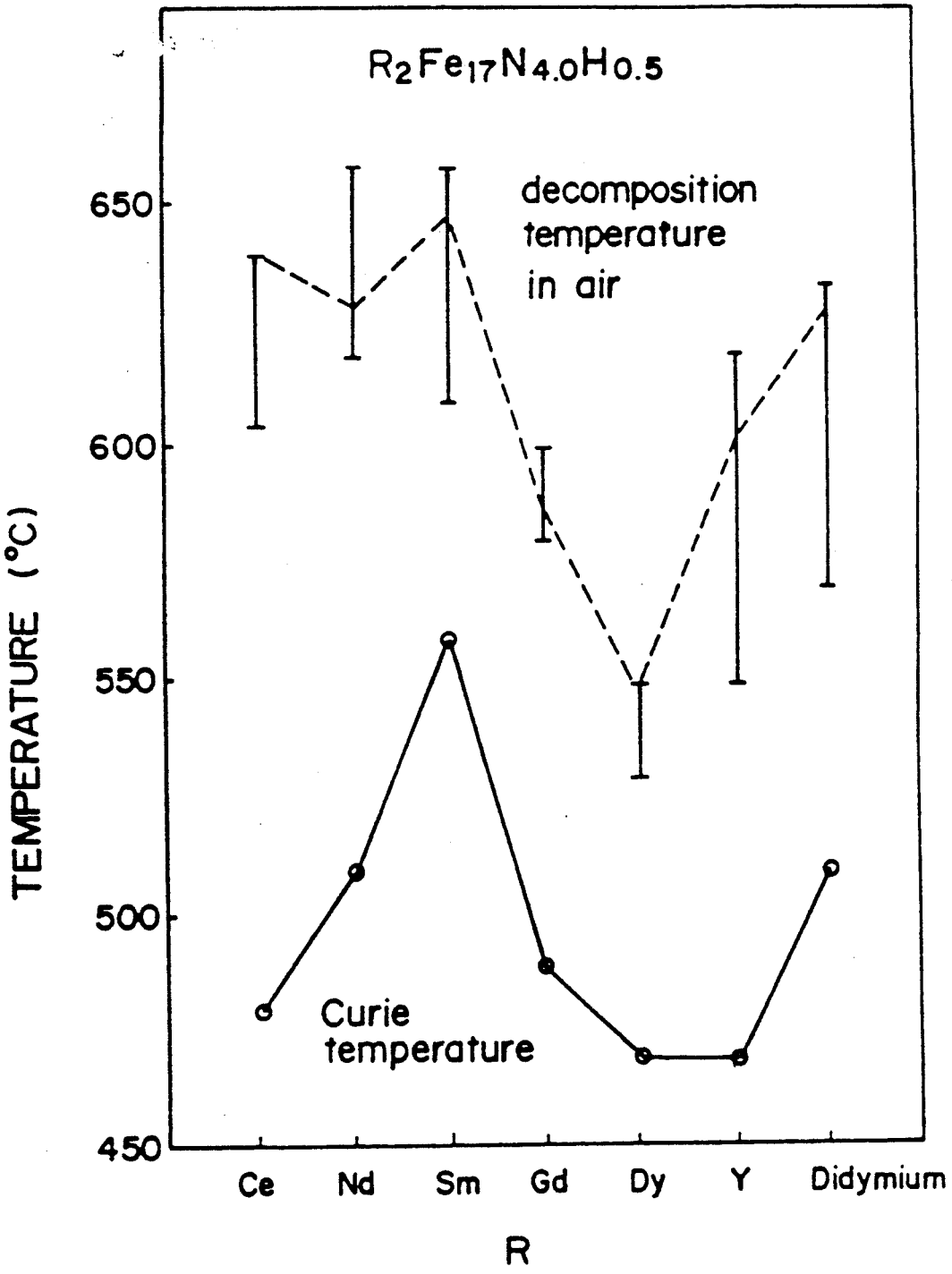

FIG. 10 shows Curie temperatures and decomposition temperatures in air of $R_2Fe_{17}N_{4.0}H_{0.5}$ wherein R is Ce, Nd, Sm, Gd, Dy, Y and didymium. The Curie temperatures of these magnetic materials are all above 470° C. and especially those of Nd and Sm are above 500° C. Also the decomposition temperatures in air of Ce, Nd and Sm are above 600° C. As for the Curie temperatures and decomposition temperatures, 5 samples were prepared and measured for each R and the mean value was employed. As for the decomposition temperatures, the errors in measurement were not small and the error lines were drawn in taking into account the errors.

Figure 11:
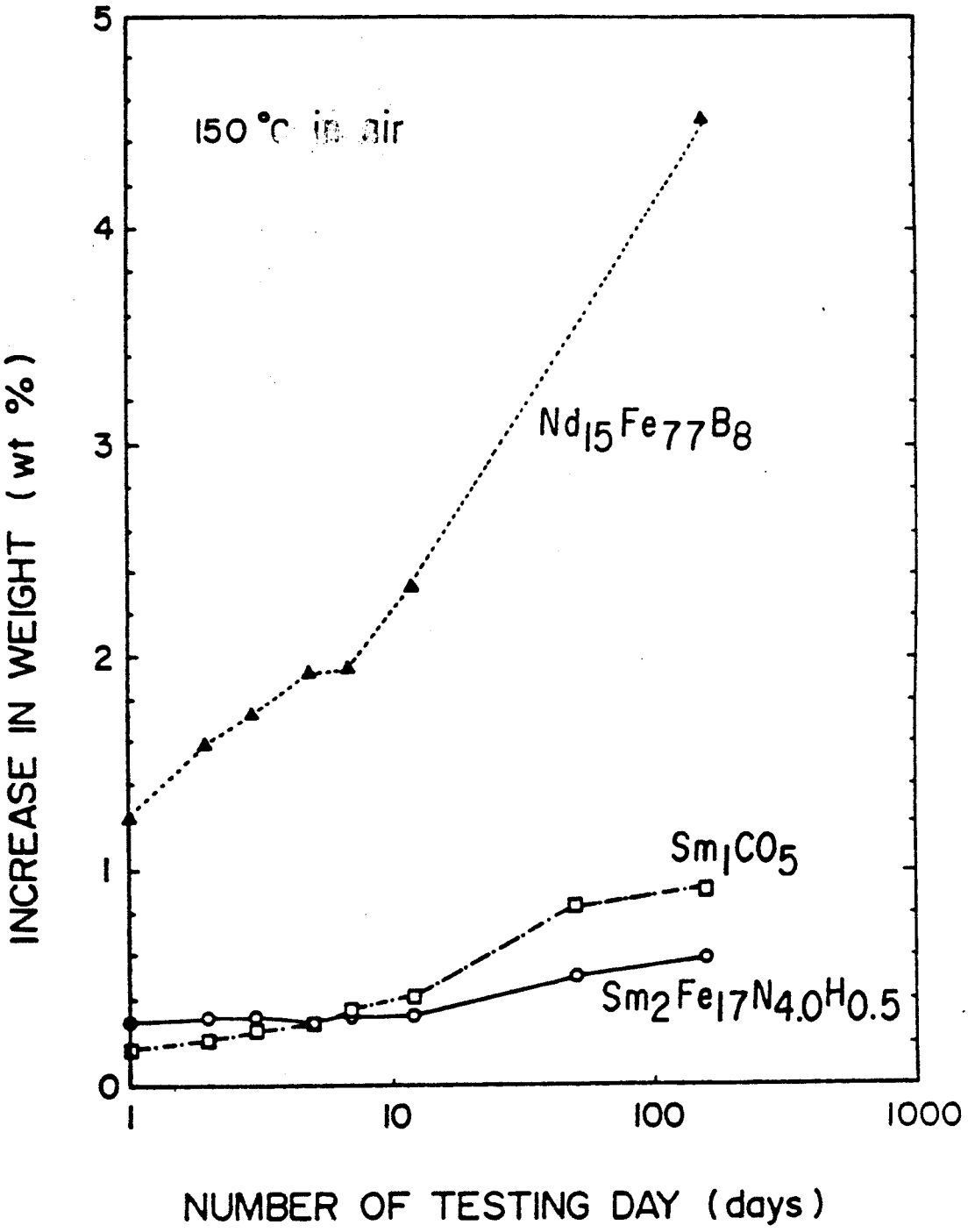

FIG. 11 shows the oxidation resistance in air at 150° C. of the $Sm_2Fe_{17}N_{4.0}H_{0.5}$ alloy powder having an average particle size of 40 m in terms of the increase in weight as a function of a period of time tested in comparison with the $Nd_{15}Fe_{77}B_8$ alloy powder (product of Sumitomo Special Metals Co., Ltd., "NEOMAX-35") and the $Sm_1Co_5$ alloy powder (product of Research Chemicals).

Figure 12:
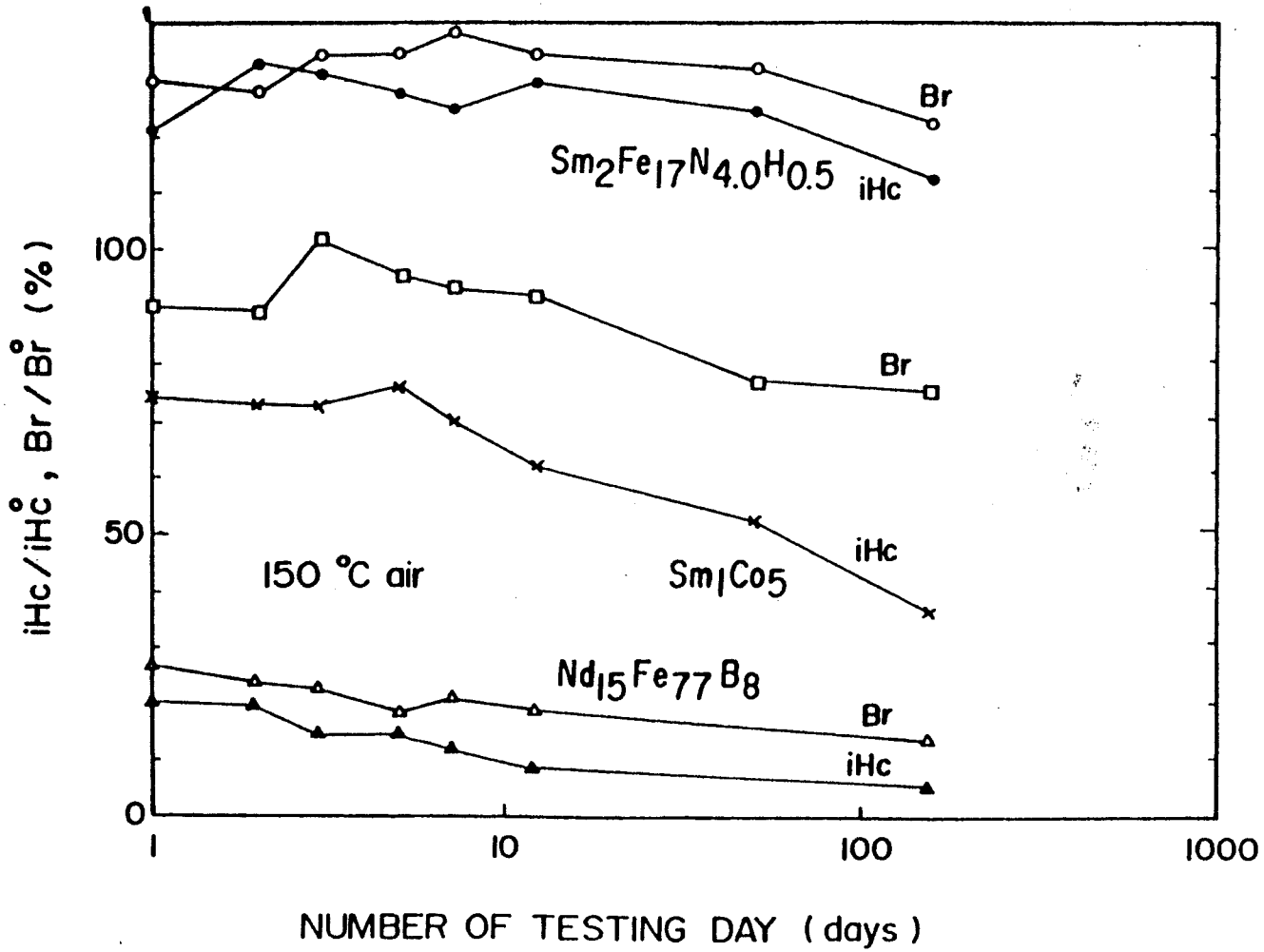

FIG. 12 shows the deterioration in air at 150° C. of the magnetic properties of the $Sm_2Fe_{17}N_{4.0}H_{0.5}$ alloy powder having an average particle size of 40 μm in terms of the ratios of the Br to the initial Br° and those of the iHc to the initial iHc° as a function of a period of time tested. As may clearly be understood from FIGS. 11 and 12 after the passing of 120 days, with the change in weight the weight of the $Nd_{15}Fe_{77}B_8$ alloy powder is increased by about 4.5% by weight and that of the $Sm_1Co_5$ alloy powder is increased by about 1% by weight. On the other hand, the weight of the $Sm_2Fe_{17}N_{4.0}H_{0.5}$ alloy powder is increased by only 0.6% by weight. With the magnetic properties the $Nd_{15}Fe_{77}B_8$ alloy powder maintains only about 10% of the magnetic properties and the $Sm_1Co_5$ alloy powder maintains about 60% of the Br and about 40% of the iHc. In contrast, the $Sm_2Fe_{17}N_{4.0}H_{0.5}$ alloy powder of the present invention has about 120% of the Br and about 110% of the iHc which are rather increased compared to the initials values due to the effect of annealing.

FIGS. 13-(*a*) to 13-(*d*) show the microstructure, by electron probe micro analysis, having a composition formula of $Sm_2Fe_{17}N_{4.0}H_{0.5}Zn_{4.7}$ at the initial stage of sintering prepared by mixing $Sm_2Fe_{17}N_{4.0}H_{0.5}$ alloy powder having an average particle size of 15 μm with 4.7 of Zn having an average particle size of 8 μm in a ball mill for one hour in a nitrogen atmosphere immediately before sintering and sintering the mixture by raising the temperature at a rate of about 10° C. per minute up to 440° C. and cooling the sintered mixture to 20° C. immediately after reaching 440° C. FIG. 13-(*a*) is a scanning electron micrograph of the heat treated body and FIG. 13-(*b*) is an X-ray composition micrograph of the heat-treated body. In these micrographs white regions are the $Sm_1Fe_3$ composition phase but most regions which are gray are uniform and can be identified by analysis as the $Sm_2Fe_{17}$ composition phase. FIGS. 13-(*c*) and (13)-*d* are Fe and Zn characteristic X-ray micrographs of the heat-treated body, respectively, and white spots correspond to the presence of Fe and Zn elements, respectively. Thus the additive of the present invention quickly diffuses into the grain boundaries and forms a reaction phase with the major phase.

FIG. 14-(*a*) to 14-(*d*) show the microstructure, by electron probe micro analysis; of the sintered body of a composition formula of $Sm_2Fe_{17}N_{4.0}H_{0.5}Zn_{4.7}$ having a $(BH)_{max}$ of 11.8 MGOe prepared by sintering a mixture of $Sm_2Fe_{17}N_{4.0}H_{0.5}Zn_{4.7}$ alloy powder obtained by further pulverizing the $Sm_2Fe_{17}N_{4.0}H_{0.5}Zn_{4.7}$ having an average particle size of 15 μm as employed above to an average particle size of 5 μm and the Zn powder as employed above at 480° C. for one hour. FIG. 14-(*a*) is a scanning electron micrograph of the sintered body, FIG. 14-(*b*) is an X-ray composition micrograph of the sintered body and FIGS. 14-(*c*) and 14-(*d*) are Fe and Zn characteristic X-ray micrographs of the sintered body, respectively. As may be observed from FIGS. 14-(*a*) to 14-(*d*), Zn is precipitated in the grain boundaries in the microstructure of the sintered body.

Figure 15:
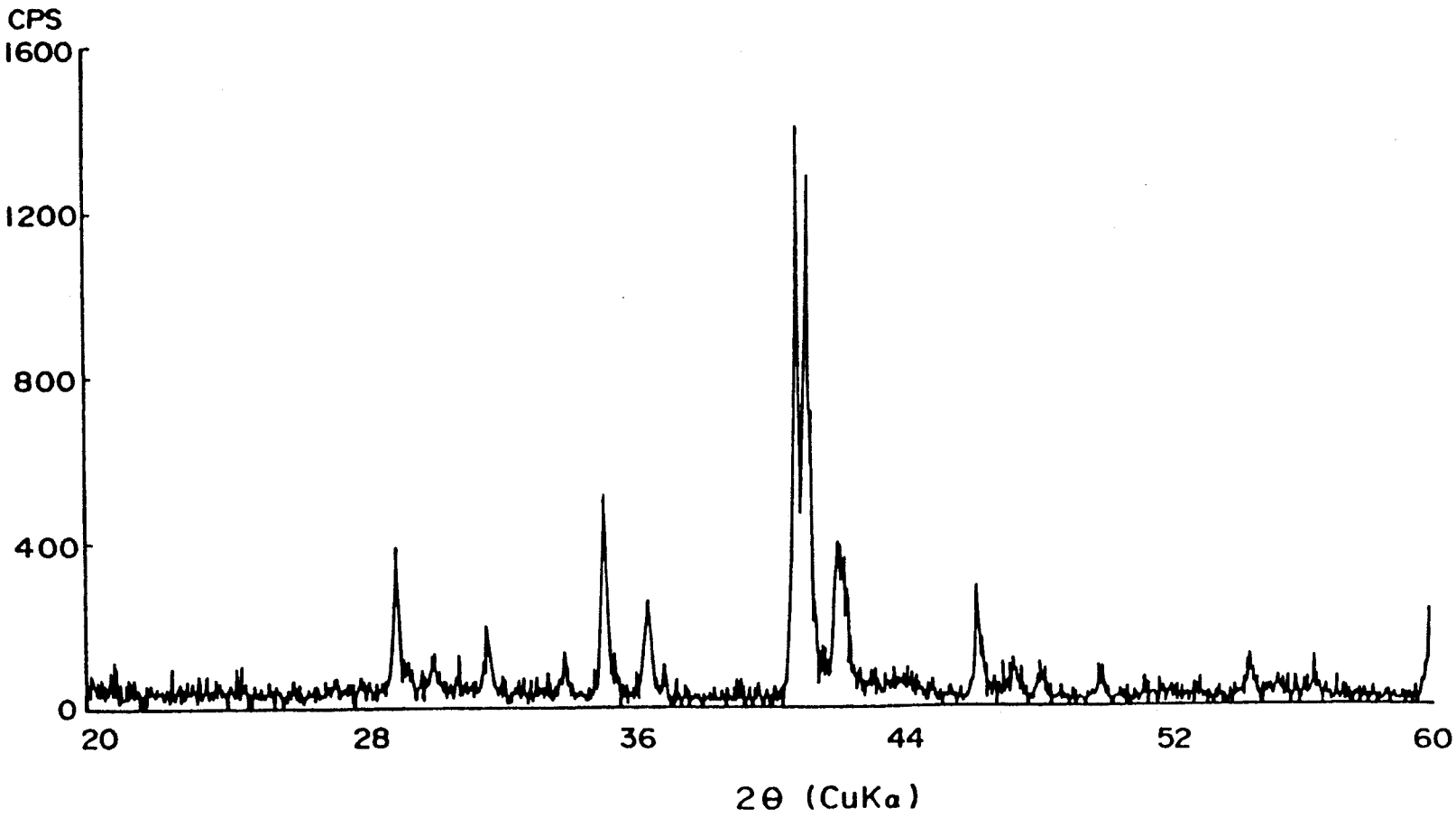

FIG. 15 is an X-ray powder diffraction pattern of the alloy powder of, by atomic percent, 8.3Sm-70.6Fe-18.0N-3.1H as obtained in Example 1 of the present invention.

Figure 16:
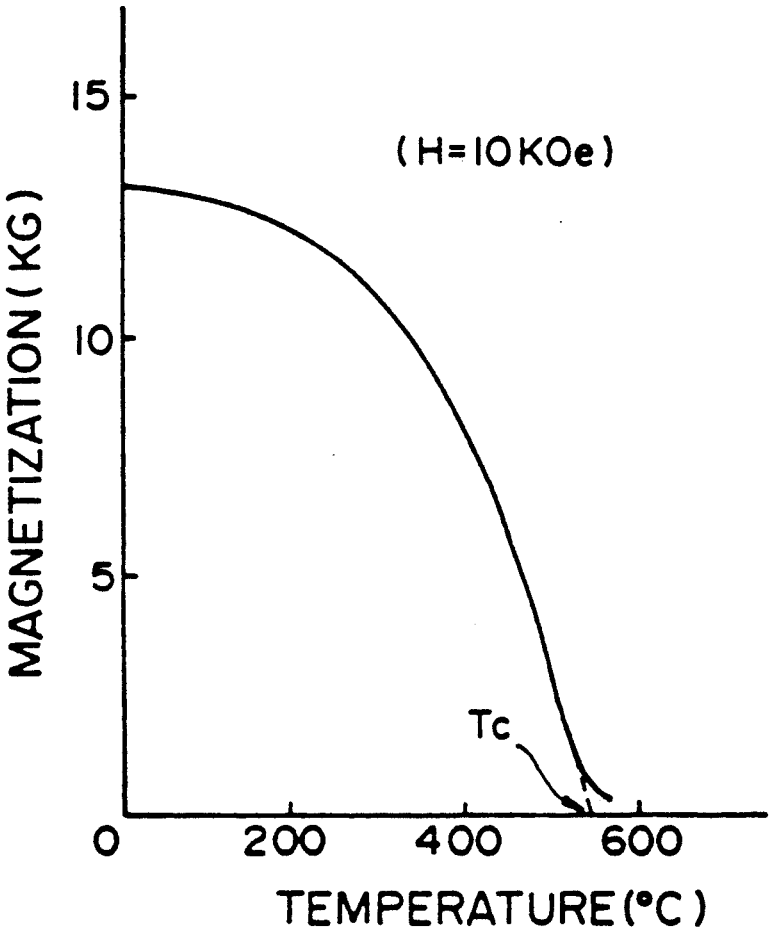

FIG. 16 is a magnetization versus temperature curve for the alloy powder of, by atomic percent, 8.3Sm-70.6Fe-18.0N-3.1H as obtained in Example 1 of the present invention.

FIGS. 17-(*a*) and 17-(*b*) are X-ray powder diffraction patterns of the starting alloy powder having a composition formula of $Sm_2F_{17}$ after the annealing and the alloy powder after the absorption of nitrogen and hydrogen, respectively, as obtained in Example 23 of the present invention.

Figure 18:
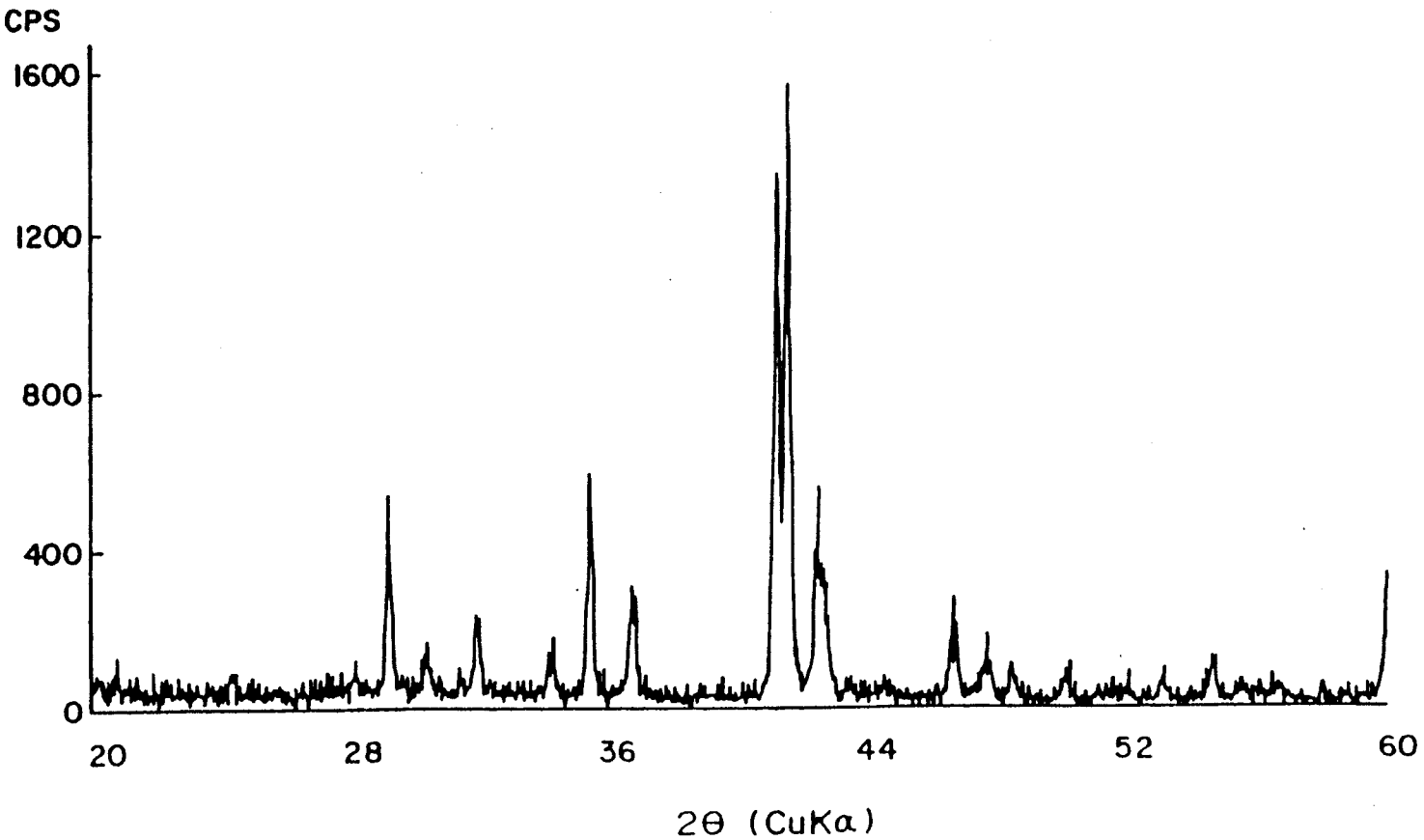

FIG. 18 is a X-ray powder diffraction pattern of the alloy powder of, by atomic present, 8.8Sm-69.9Fe- 18.3N-3.0H composition as obtained in Example 25 of the present invention.

Figure 19:
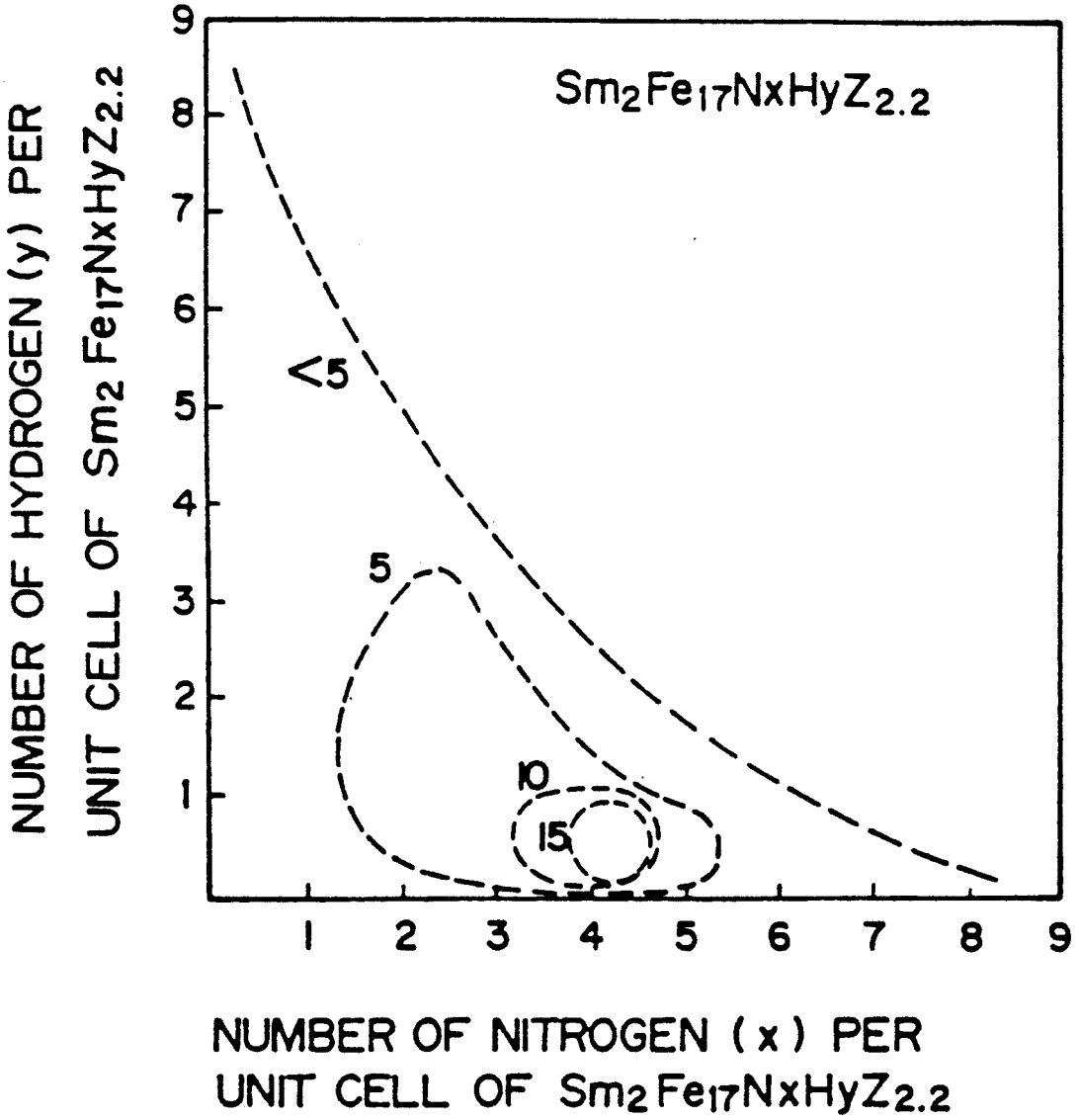

FIG. 19 shows the relation of numbers of the nitrogen and hydrogen per unit of $Sm_2Fe_{17}N_xH_yZn_{2.2}$ with the $(BH)_{max}$ of the sintered magnet as obtained in Example 31 of the present invention.

DETAILED DESCRIPTION OF PREFERRED EMBODIMENTS

The rare earth elements R which can be employed in the present invention include light and heavy rare earth elements including Y and may be employed alone or in combination. More specifically, R includes Nd, Pr, La, Ce, Tb, Dy, Ho, Er, Eu, Sm, Gd, Pm, Tm, Yb, Lu and Y and mixtures of two or more rare earth elements such as mischmetal and didymium. These rare earth elements R which can be employed in the present invention may not always be pure and may contain impurities which are inevitably entrained in the course of production. Of these rare earth elements R, preferred are Ce, Sm, didymium and Sm alloys such as Sm-Nd, Sm-Gd, Sm-Ce, Sm-Dy and Sm-Y.

The amount of R which can be employed in the present invention is typically 5 to 20 atomic percent, and a preferred amount of R is 8 to 9.5 atomic percent. When the amount of R is less than 5 atomic percent, the iHc is decreased. On the other hand, with amounts of R of more than 20 atomic percent, the 4 $\pi$Is is decreased.

The amount of nitrogen which can be employed in the present invention is typically 5 to 30 atomic percent, a preferred amount of nitrogen is 13 to 18 atomic percent. When the amount of nitrogen is less than 5 atomic percent, the magnetic anisotropy is decreased and as a result, the iHc is extremely decreased. On the other hand, amounts of nitrogen of more than 30 atomic percent decrease the iHc and the 4 $\pi$Is as well as the magnetic anisotropy which are not suitable for practical permanent magnets.

The amount of hydrogen which can be employed in the present invention is typically 0.01 to 25 atomic percent, a preferred amount of hydrogen is 2 to 5 atomic percent. When the amount of hydrogen is less than 0.01 atomic percent, the magnetic properties are low. On the other hand, amounts of nitrogen of more than 25 atomic percent decrease the iHc as well as the magnetic anisotropy and require a treatment under pressure for the absorption of hydrogen.

The major component of the magnetic materials of the present invention is iron and the amount of iron is typically 40 to 89.9 atomic percent, preferably 50 to 86 atomic percent. A more preferred amount of iron is 69 to 72 atomic percent since the magnetic materials of the present invention are prepared by the absorption of nitrogen and hydrogen in an alloy of the rhombohedral $R_2Fe_{17}$ structure wherein R is at least one rare earth element selected from the group consisting of Ce, Pr, Nd, Sm and Gd or of the hexagonal $R_2Fe_{17}$ structure wherein R is at least one rare earth element selected from the group consisting of Tb, Dy, Ho, Er, Eu, Tm, Yb, Lu and Y as the basic composition. However, even when R-rich phases or nonstoichiometric phases are present in a small amount in the magnetic material of the present invention, the decrease in the magnetic properties is small. Further, when sintered magnets are prepared, the presence of the R-rich phases in the grain boundaries in the microstructure rather increases the magnetic properties. On other hand, even when a small amount of $\alpha$-Fe phase precipitates in the sintered magnets due to excess amount of iron, the magnetic material can be employed for the preparation of sintered magnets depending on the amount of the $\alpha$-Fe phase.

In order to further improve the Curie temperatures and the temperature properties of the magnetic materials of the present invention the iron can be substituted by cobalt in an amount of at most 50 atomic percent of the iron.

Furthermore in order to improve the magnetic properties, the bonded magnets and the sintered magnets of the present invention, at least one additive M is incorporated with the magnetic material of formula (I) of the present invention.

Exemplary additives M include metals such as Sn, Ga, In, Bi, Pb, Zn, Al, Zr, Cu, Mo, Ti, Si, Ce, Sm and Fe, any alloys or mixtures thereof, oxides such as MgO, $Al_2O_3$ and $Sm_2O_3$; fluorides such as $AlF_3$, $ZnF_2$; carbides such as SiC and TiC; nitrides such as AlN and $Si_3N_2$; and any alloys or mixtures of the metals, the oxides, the fluorides, the carbides and the nitrides. Of these additives M, preferred are Zn, Ga, Al, In and Sn, any alloys or mixtures thereof; and any alloys or mixtures of at least one member selected from the group consisting of Zn, Ga, Al, In and Sn and at least one member selected from the group consisting of Si, Sic, $Si_3N_2$, MgO, $Sm_2O_3$ and TiC.

The amount of the additive M is typically 0.1 to 40 atomic percent and a preferred amount of the additive M is 5 to 15 atomic percent. When the amount of the additive is less than 0.1 atomic percent, the increase in iHc is small. On the other hand, when the amount of the additive M is more than 40 atomic percent, the decrease in 4$\pi$Is is remarkable.

(1) Preparation of Starting Alloy

Iron and at least one rare earth element are alloyed by high frequency melting, arc melting or melt spinning in an inert gas atmosphere such as argon to give a starting alloy. It is preferred that the amount of the rare earth element is 5 to 25 atomic percent and the amount of the iron is 75 to 95 atomic percent. When the amount of the rare earth element is less than 5 atomic percent, a large amount of $\alpha$-Fe phase is present in the alloy and accordingly, high iHc cannot be obtained. Also, when the amount of the rare earth is more than 25 atomic percent, high 4$\pi$Is cannot be obtained.

Cobalt and/or at least one additive M can also be alloyed together with the iron and the rare earth element in the preparation of the starting alloy.

When cobalt is alloyed with the rare earth element and iron, it is preferred that the amount of the cobalt does not exceed 50 atomic percent of the iron. When additive M is alloyed with the rare earth element and iron, it is preferred that the amount of the rare earth element is 5 to 25 atomic percent, that of the iron is 75 to 90 atomic percent and that of additive M is 0.1 to 50 atomic percent. Also when cobalt is alloyed with the additive M, rare earth element and iron, it is preferred that the amount of the cobalt does not exceed 50 atomic percent of the iron.

When the high frequency melting or the arc melting is employed, the iron tends to precipitate in the solidification of the alloy from a melt state, which causes decrease in the magnetic properties, particularly the iHc. Thus, annealing is effective for making such an iron phase disappear, rendering the alloy composition uniform and improving the crystallinity of the alloy. Thus the annealing is preferably conducted at a temperature of 500° C. to 1300° C. for one hour to two weeks. The alloys prepared by the high frequency melting or the arc melting are better in crystallinity and have higher $4\pi Is$ than those prepared by the melt spinning.

The alloys of the present invention can also be prepared by the melt spinning and the crystal size of the alloy according to this method are fine and can be about 0.2 μm depending upon the conditions employed. However, when the cooling rate is high, the alloy becomes amorphous and the $4\pi Is$ and iHc after the subsequent absorption of nitrogen and hydrogen do not so increase as by the high frequency melting or the arc melting. Thus in this case annealing is preferred.

(2) Coarse Pulverization

In order to uniformly carry out the subsequent absorption of nitrogen and hydrogen the starting alloy is coarsely pulverized in a jaw crusher, a stamp mill or coffee mill in an inert atmosphere such as nitrogen and argon to such an average particle size that has reactivity to nitrogen and hydrogen and does not cause the progress of oxidation, i.e., typically 40 μm to 300 μm.

Also the pulverization can be carried out by alternatingly repeating the absorption of hydrogen in the sarting alloy with hydrogen gas at a temperature of 200° C. to 400° C. and the desorption of the hydrogen absorbed in an inert atmosphere such as argon at 600° C. to 800° C. Since the starting alloy containing hydrogen becomes harder and the stretching of crystal lattices is caused by the alternating repetition of the absorption and desorption of hydrogen in the starting alloy, the pulverization can be spontaneously effected with the suppression of decrease in crystallinity to any desired particle size, as small as, for example, 4 μm, depending upon the number of the alternating repetition.

(3) Absorption of Nitrogen and Hydrogen in Starting Alloy

The methods for the absorption of nitrogen and hydrogen in the starting alloy which can be employed in the present invention include contacting the starting alloy powder with ammonia gas or a mixed gas of ammonia and at least one gas selected from the group consisting of hydrogen, helium, neon, argon and nitrogen at elevated temperatures at a pressure of 1 to 10 atm in one step; contacting the starting alloy powder with hydrogen gas or a mixed gas of hydrogen and at least one gas selected from the group consisting of helium, neon, argon and nitrogen at elevated temperatures to conduct the absorption of hydrogen and contacting the hydrogen-absorbed alloy powder with ammonia gas or a mixed gas of ammonia and at least one gas selected from the group consisting of hydrogen, helium, neon, argon and nitrogen at elevated temperature at a pressure of 1 to 10 atm to conduct the absorption of nitrogen in the hydrogen-absorbed alloy powder in two steps; and contacting the starting alloy powder with nitrogen gas, ammonia gas or a mixed gas of nitrogen or ammonia and at least one gas selected from the group consisting of helium, neon and argon at elevated temperatures at a pressure of 1 to 10 atm to conduct the absorption of nitrogen and contacting the nitrogen-absorbed alloy powder with hydrogen or a mixed gas of hydrogen and at least one gas selected from the group consisting of helium, neon, argon and nitrogen at elevated temperatures at a pressure of 1 to 10 atm to conduct the absorption of hydrogen in the nitrogen-absorbed alloy powder in two steps. Of these methods the one step method is preferred since the absorption of nitrogen and hydrogen can be completed in 10 to 20 minutes. In the two step methods it is easier to firstly conduct the absorption of hydrogen in the alloy powder and secondly conduct the absorption of nitrogen in the hydrogen-absorbed alloy powder.

The amounts of the nitrogen and hydrogen absorbed in the starting alloy can be controlled by the kind of the contacting gas selected or the mixing ratio of ammonia and hydrogen employed and the temperature chosen, the pressure applied and the contacting period of time employed. When the one step method is employed, it is preferred to use a mixed gas of ammonia and hydrogen. The mixing ratio of ammonia and hydrogen may vary depending upon the contacting conditions and it is preferred that the partial pressure of ammonia is 0.02 to 0.75 atm and the partial pressure of hydrogen is 0.98 to 0.25 atm with a total pressure of the mixed gas of 1 atm. The contacting temperature is typically 100° C. to 650° C. When the contacting temperature is below 100° C., the rate of the absorption of nitrogen and hydrogen is small. On the other hand, contacting temperatures above 650° C., iron nitride is formed to decrease the magnetic properties. The presence of oxygen in the contacting atmosphere decreases the magnetic properties and accordingly, it is necessary to decrease the partial pressure of oxygen as much as possible. Although a mixed gas containing a gas other than ammonia gas as the major constituent can be employed in the present invention, the rate of absorption is decreased. However, it is possible to conduct the absorption of nitrogen and hydrogen in the starting alloy, for example, with a mixed gas of hydrogen gas and nitrogen gas for a long period of time ranging from 5 to 50 hours.

(4) Fine Pulverization and Mixing of Additive M

The alloy powder after the absorption of nitrogen and hydrogen is further finely pulverized in a vibrating ball mill in an inert atmosphere such as nitrogen, helium, neon and argon typically to an average particle size of 1 to 10 μm.

In the preparation of a sintered magnet from the alloy powder containing at least one additive M, the effect of additive M is most remarkably exhibited when the additive M is added to the alloy powder after the absorption of nitrogen and hydrogen and the mixture is mixed and finely pulverized in a vibrating ball mill in an inert atmosphere such as nitrogen, helium, neon, argon to an average size of 1 to 10 μm. The conditions of the mixing and fine pulverization affect the final magnetic properties of the magnet. More specifically, in this step the alloy powder after the absorption of nitrogen and hydrogen undergoes the change in particle size and morphology as well as the mixing with additive M and as a result, the microstructure of the sintered magnet after the additive is allowed to react with the major phase and/or after the additive is dispersed in the grain boundaries undergoes the influence of the conditions in this step.

When the average particle size reaches about 0.2 μm, the additive easily reacts with the major phase at sintering and accordingly the magnetic properties do not much improve. Also, average particle sizes of smaller than about 0.2 μm easily undergo oxidation and their handling becomes difficult. On the other hand, when the average particle size reaches about 20 to 30 μm, a number of magnetic domains are gathered within each grain and resultedly the effect of additive M is small and the iHc cannot be improved by sintering.

The amount of additive M is typically 0.1 to 40 atomic percent. When the amount of additive M is 5 to 15 atomic percent, the magnetic properties, especially the $(BH)_{max}$ of the sintered magnet is improved. When the amount of additive M is 0.1 to 5 atomic percent, the decrease in the $4\pi Is$ is small and the iHc is improved to some extent compared to that of the alloy powder without additive M. On the other hand, amounts of the additive of 15 to 30 atomic percent give a sintered magnet having a comparatively high iHc and a good loop rectangularity and a decreased $4\pi Is$. When the amount of the additive is 30 to 40 atomic percent, the iHc of the sintered magnet is greatly increased but the magnetization is small and thus a special magnet is provided. Further when the amount of additive M is above 40 atomic percent, the $4\pi Is$ of the sintered magnet becomes too small for practical purposes.

(5) Molding of Alloy Powder in Magnetic Field

In the preparation of a sintered magnet it is necessary to mold the alloy powder as obtained above into a shaped article under pressure in a magnetic field, practically at a pressure of 1 to 4 ton/cm$^2$ in a magnetic field of 10 to 15 KOe before sintering. Since the alloy powder of the present invention has higher magnetic properties than conventional rare earth magnetic materials, a stronger magnetic field at the pressing is preferably employed. Also, the alloy powder as obtained above can be molded into a bonded magnet by mixing it with, as a binder agent, a thermoplastic resin such as polyamide, polybutylene terephthalate, polyphenylene sulfide as liquid crystal polymer and subjecting the mixture to injection-molding in a magnetic field; by mixing it with, as a binder agent, a thermosetting resin such as epoxy resin, plenolic resin and synthetic rubber and subjecting the mixture to compression-molding in a magnetic field; or compression-molding it in a magnetic field to give a shaped article, coating or impregnating the shaped article with, as a binder agent, the thermosetting resin or incorporating a solution of the thermoplastic resin with the shaped article and drying the shaped article thus obtained.

(6) Sintering

In order to prepare sintered magnets from the magnetic materials in the form of powder of the present invention sintering can be conducted by the conventional methods such as atmospheric heating, hot pressing and hot isostatic pressing. Of these methods, the hot pressing in a hot atmosphere which does not require a large apparatus as employed by the hot isostatic pressing and can improve the magnetic properties of the sintered magnet will now be described.

Since the magnetic material of the present invention can be obtained by the absorption of nitrogen and hydrogen in the alloy, desired magnetic properties cannot be obtained unless the sintered magnet maintains the predetermined amounts of nitrogen and hydrogen in its structure. Accordingly it is preferred to conduct the sintering in a mixed gas of ammonia and hydrogen or argon or nitrogen or a mixed gas of nitrogen and hydrogen or argon at a temperature of 100° C. to 650° C. typically for 30 minutes to 4 hours, preferably for 1 to 2 hours. Of these mixed gases, a mixed gas of ammonia and hydrogen is more preferred for controlling the nitrogen and hydrogen absorbed in the structure of the sintered magnet. However, when the sintering is conducted at a temperature of below 450° C., the magnetic material of the present invention is stable and thus any atmosphere of the sintering can be employed to give good magnetic properties of the sintered magnet. When the sintering temperature is above 650° C., in general, the decomposition of the magnetic material of the present invention progresses independently of the sintering atmosphere employed to precipitate $\alpha$-Fe phase and changes the amounts of the nitrogen and hydrogen initially absorbed.

The pressure of the hot pressing depends upon the material of the die employed and is sufficiently around 10 ton/cm$^2$.

Furthermore, when additive M is employed, the sintering conditions vary depending on the type of additive M employed. For example, when Zn having a melting point near 420° C. is employed as additive M, the dispersion of Zn in the grain boundaries becomes remarkable at a temperature near 420° C. but the magnetic properties is not much improved by this dispersion alone although amounts of Zn of 30 to 40 atomic percent increase the iHc with decreased $4\pi Is$, accordingly with not-improved final $(BH)_{max}$. However, when the sintering temperature is further raised above 420° C., the reaction of the major phase formed of an intermetallic compound represented by formula (I) as described above with Zn is brought about to give a reaction phase in the grain boundaries, and the $(BH)_{max}$ can be remarkably improved by optimalizing the amount of the reaction phase.

(7) Magnetization

Magnetization can be conducted by exposing the sintered body or the bonded magnet of the present invention to an external magnetic field. In the magnetization in order to obtain high magnetic properties it is important that the direction of the magnetic field is the same as that of easy magnetization of the sintered body or the bonded magnet. As the magnetic field, for example, a static magnetic field can be generated by an electromagnet or a pulsed magnetic field can be generated by a capacitor discharge magnetizer. The magnetic field strength for sufficiently conducting the magnetization is typically above 15 KOe and preferably above 30 KOe.

(8) Annealing

In the preparation of the bonded magnet and the sintered magnet of the present invention, annealing is effective. The crystallinity of magnetic materials could be said to have a close relation with the magnetic properties of the magnetic materials. In the magnetic materials of the present invention, as the crystallinity is nearer to completeness, i.e., as the disorder in crystal structure is less or the defect in crystals are less, the $4\pi Is$ and the magnetic anisotropy are more increased. Thus, when the crystallinity of the magnetic materials of the present invention is increased, the magnetic properties can further be improved. In the present invention annealing is a preferred means for increasing the crystallinity for practical purposes.

In the present invention when the annealing of the starting alloy is carried out before the absorption of nitrogen and hydrogen in the alloy, it is preferred to carry out the annealing at a temperature of 500° C. to 1300° C. in an inert gas atmosphere such as argon and nitrogen or in a hydrogen atmosphere for one hour to two weeks.

When the annealing of the alloy after the absorption of nitrogen and hydrogen is carried out, the annealing temperature is typically 100° C. to 650° C., preferably 150° C. to 500° C. When the annealing temperature is below 100° C., the effect of annealing does not appear. On the other hand, annealing temperatures above 650° C. tend to evaporate nitrogen and hydrogen. Any non-oxidizing atmosphere can be employed and the atmosphere containing hydrogen, argon, nitrogen or ammonia or air is more effective. When the annealing is carried out at a temperature below 450° C., air is effective as the annealing atmosphere.

The following examples are given to illustrate the present invention in greater detail.

In the present invention, the quantitative analysis of the rare earth element and the iron in the alloy powder of the present invention was conducted by dissolving the alloy powder in nitric acid and subjecting the solution obtained to inductively coupled plasma emission spectrometry by a spectrometer (manufactured by Seiko Instruments & Electronics Ltd.), and the quantitative analysis of the nitrogen and hydrogen absorbed was conducted by subjecting the alloy powder of the present invention to an inert gas fusion in impulse furnace-thermal conductivity analysis by an analyzer (manufactured by Horiba, Ltd., "EMGA-2000").

The $4\pi$Is, iHc, temperature dependency of magnetization and Curie temperature of the alloy powder of the present invention were measured by a vibrating sample magnetometer (manufactured by Toei Industry Co., Ltd.).

EXAMPLE 1

An alloy ingot of, by atomic percent, 10.5 Sm-89.5 Fe composition i.e., a composition formula of $Sm_2Fe_{17}$ was prepared by the arc melting of Sm having a purity of 99.9% by weight and Fe having a purity of 99.9% in a water-cooled copper boat in an argon atmosphere. The alloy ingot thus obtained was annealed at 1200° C. for 3 hours in an argon atmosphere, and then coarsely crushed in a jaw crusher in a nitrogen atmosphere and subsequently finely pulverized to an average particle size of 100 μm in a coffee mill in a nitrogen atmosphere.

The alloy powder thus obtained was placed in a tubular furnance and a mixed gas of ammonia gas having a partial pressure of 0.4 atm and hydrogen gas having a partial pressure of 0.6 atm was introduced into the tubular furnace and the temperature of the furnace was raised to 450° C. at a rate of 15° C./minute and kept at 450° C. while continuing the introduction of the mixed gas for 30 minutes to effect the absorption of nitrogen and hydrogen in the alloy powder, and then the temperature of the furnace was cooled to 20° C. at a rate of 15° C./minute in the mixed gas atmosphere to give alloy powder of, by atomic percent, 8.3Sm-70.6Fe-18.0N-3.1H composition.

FIG. 15 is an X-ray powder diffraction pattern by the radiation of Ni-filtered CuKα of this alloy powder.

Using copper powder as the binder, the alloy powder thus obtained was compression-molded in a magnetic field of 15 KOe under a pressure of 2 ton/cm$^2$. The molded article thus obtained was magnetized in a pulse magnetic field of 50 KOe and the magnetic properties were as follows;

| | |
|---|---|
| $4\pi$Is | 13.3 KG |
| Ea | $9.8 \times 10^6$ erg/g |
| iHc | 1100 Oe |

Thus the alloy powder is a magnetic material having a high $4\pi$Is and a high Ea.

When the alloy powder was further finely pulverized to an average particle size of 5 μm in a vibrating ball mill in a nitrogen atmosphere and then compression-molded using copper powder as the binder agent in the same manner as described above, the iHc was improved to be 5100 Oe.

FIG. 16 shows Curie temperature (Tc) of this alloy powder. Tc was 560° C. which was remarkably increased from Tc of 95° C. of the intermetallic compound having a composition formula of $Sm_2Fe_{17}$.

EXAMPLES 2 TO 4

The same procedures for obtained alloy powder containing nitrogen and hydrogen as in Example 1 were repeated except that the partial pressures of ammonia gas and hydrogen gas were changed to 0.1 atm and 0.9 atm; 0.2 atm and 0.8 atm; and 0.5 atm and 0.5 atm, respectively. As the result, alloy powder of, by atomic percent, 9.1Sm-76.9Fe-9.0N-5.0H, 8.7Sm-74.2Fe-13.1N-4.0H and 8.0Sm-67.8Fe-23.3N-0.9H compositions, respectively was obtained. The alloy powder compositions and their magnetic properties are shown in Table 1 below.

COMPARATIVE EXAMPLE 1

The same procedures for obtaining alloy powder as in Example 1 were repeated except using hydrogen gas alone at a pressure of 1 atm instead of the mixed gas. The magnetic properties of the hydrogen-absorbed alloy powder are shown in Table 1 below.

COMPARATIVE EXAMPLE 2

The same procedures for obtaining alloy powder as in Example 1 were repeated except that the partial pressures of the ammonia and the hydrogen in the mixed gas were changed to 0.6 atm and 0.4 atm, respectively. As the result, the alloy powder of, by atomic percent, 6.5Sm-55.0Fe-38.2N-0.3H composition was obtained. The magnetic properties of the alloy powder thus obtained are shown in Table 1 below.

COMPARATIVE EXAMPLE 3

The same procedures for obtaining alloy powder as in Example 1 were repeated except using nitrogen gas at a pressure of 1 atm alone instead of the mixed gas at 550° C. for 8 hours. The magnetic properties of the nitrogen-absorbed alloy powder are shown in Table 1.

TABLE 1

| | Alloy Powder Composition After Absorption of Nitrogen & Hydrogen (atomic %) | | | | Magnetic Properties | | | |
|---|---|---|---|---|---|---|---|---|
| | Sm | Fe | N | H | $4\pi$Is (KG) | Ea (erg/g) | iHc* (Oe) | iHc** (Oe) |
| Example No. | | | | | | | | |
| 1 | 8.3 | 70.6 | 18.0 | 3.1 | 13.3 | $9.8 \times 10^6$ | 1100 | 5100 |
| 2 | 9.1 | 76.9 | 9.0 | 5.0 | 13.2 | $5.9 \times 10^6$ | 450 | 2050 |
| 3 | 8.7 | 74.2 | 13.1 | 4.0 | 13.3 | $7.2 \times 10^6$ | 860 | 4200 |
| 4 | 8.0 | 67.8 | 23.3 | 0.9 | 12.6 | $3.4 \times 10^6$ | 690 | 2950 |
| Comparative Example | | | | | | | | |

TABLE 1-continued

| | Alloy Powder Composition After Absorption of Nitrogen & Hydrogen (atomic %) | | | | Magnetic Properties | | | |
|---|---|---|---|---|---|---|---|---|
| | Sm | Fe | N | H | 4πIs (KG) | Ea (erg/g) | iHc* (Oe) | iHc** (Oe) |
| No. | | | | | | | | |
| 1 | 9.5 | 80.6 | 0 | 9.9 | 12.6 | $10^5$> | 20 | 60 |
| 2 | 6.5 | 55.0 | 38.2 | 0.3 | 6.5 | $10^6$> | 150 | 180 |
| 3 | 8.6 | 72.9 | 18.5 | 0 | 11.3 | $10^5$> | 120 | 240 |

*average particle size: 100 μm
**average particle size: 5 μm

EXAMPLES 5 TO 7

The same procedures for obtaining alloy powder containing nitrogen and hydrogen and having an average particle size of 100 μm as in Example 1 were repeated except that as the starting alloys, 7.2Sm-92.8Fe, 14.4Sm-85.6Fe and 20.2Sm-79.8Fe were employed, respectively, instead of the 10.5Sm-89.5Fe. The alloy powder compositions and their magnetic properties after absorption of nitrogen and hydrogen are shown in Table 2.

TABLE 2

| Example | Alloy Powder Composition after Absorption of Nitrogen & Hydrogen (atomic %) | | | | Magnetic Properties | | |
|---|---|---|---|---|---|---|---|
| No. | Sm | Fe | N | H | 4πIs (KG) | Ea (erg/g) | iHc (Oe) |
| 5 | 6.1 | 79.5 | 12.2 | 2.2 | 13.6 | $4.3 \times 10^6$ | 290 |
| 6 | 11.9 | 70.6 | 13.0 | 4.5 | 12.9 | $5.1 \times 10^6$ | 490 |
| 7 | 16.1 | 63.7 | 16.5 | 3.7 | 11.6 | $2.7 \times 10^6$ | 250 |

EXAMPLE 8

The same procedures for obtaining alloy powder as in Example 1 were repeated except that the absorption of nitrogen and hydrogen in the alloy was carried out in a mixed gas of ammonia having a partial pressure of 0.05 atm and argon having a partial pressure of 0.95 atm with a total pressure of 1 atm at 490° C. for 5 minutes.

The magnetic properties of the alloy powder thus obtained are shown in Table 3 below.

EXAMPLE 9

The same procedures as in Example 8 were repeated except that the contact temperature and time with the mixed gas were changed to 450° C. and 20 minutes, respectively, in the absorption of nitrogen and hydrogen in the alloy powder.

The magnetic properties of the alloy powder thus obtained are shown in Table 3 below.

EXAMPLE 10

The same procedures for obtaining alloy powder as in Example 1 were repeated except that the absorption of nitrogen and hydrogen in the alloy was carried out in a mixed gas of ammonia having a partial pressure of 0.2 atm, hydrogen having a partial pressure of 0.3 atm and argon having a partial pressure of 0.5 atm with a total pressure of 1 atm at 450° C. for 30 minutes.

The magnetic properties of the alloy powder thus obtained are shown in Table 3 below.

EXAMPLE 11

About 1 g of the same starting alloy powder having an average particle size of 100 μm as in Example 1 was packed in a cylindrical stainless steel pressure resistant vessel having an inner diameter of 30 mm and a height of 150 mm. After the vessel was vacuumed, ammonia gas of 2 atom and hydrogen gas of 3 atm were filled in the vessel with a total pressure of 5 atm at 20° C. Then the vessel was placed in an electric furnace at 400° C. for 30 minutes to carry out the absorption of nitrogen and hydrogen in the alloy. The total pressure in the vessel at the heating at 400° C. was 7.2 atm. Then the vessel was cooled to 20° C. and the alloy powder was taken out of the vessel and subjected to analysis. The amount of nitrogen and hydrogen absorbed were 16.3 atomic percent and 7.8 atomic percent, respectively. The alloy powder compositions and their magnetic properties after the absorption of nitrogen and hydrogen are shown in Table 3.

TABLE 3

| Example | Alloy Powder Composition after Absorption of Nitrogen & Hydrogen (atomic %) | | | | Magnetic Properties | | |
|---|---|---|---|---|---|---|---|
| No. | Sm | Fe | N | H | 4πIs (KG) | Ea (erg/g) | iHc (Oe) |
| 8 | 8.0 | 67.6 | 24.35 | 0.05 | 12.0 | $3.8 \times 10^6$ | 310 |
| 9 | 8.7 | 73.5 | 17.3 | 0.5 | 13.6 | $9.6 \times 10^6$ | 720 |
| 10 | 8.5 | 72.4 | 16.8 | 2.3 | 13.2 | $8.5 \times 10^6$ | 660 |
| 11 | 8.0 | 67.9 | 16.3 | 7.8 | 13.0 | $7.1 \times 10^6$ | 530 |

EXAMPLE 12

The same procedures for obtaining alloy powder containing nitrogen and hydrogen and having an average article size of 100 μm as in Example 1 were repeated except that Ce, Nd, Pr, Gd, Dy and Y, each having a purity of 99.9% by weight and didymium were employed, respectively, instead of the Sm.

The alloy powder compositions and their magnetic properties before and after the absorption of nitrogen and hydrogen are shown in Table 4. The magnetic anisotropy was evaluated in terms of the ratio ($\sigma_\perp/\sigma_{||}$) of magnetization in the direction of hard magnetization ($\sigma_\perp$) to that in the direction of easy magnetization ($\sigma_{||}$) at 15 KOe.

As would be clear from Table 4, the σs and the iHc are improved after the absorption of nitrogen and hydrogen.

TABLE 4

| Run No. | Before Absorption of Nitrogen & Hydrogen: Alloy Powder Composition | Magnetic Properties: $\sigma_s$ (emu/g) | iHc (Oe) | $\sigma_\perp/\sigma$ at 15 KOe | After Absorption of Nitrogen & Hydrogen: Alloy powder Composition | Magnetic Properties: $\sigma_s$ (emu/g) | iHc (Oe) | $\sigma_\perp/\sigma$ at 15 KOe |
|---|---|---|---|---|---|---|---|---|
| 1 | 2Ce-17Fe | 18 | 0 | 0.923 | 2Ce-17Fe-3.8N-0.6H | 165 | 110 | 0.784 |
| 2 | 2Ce-15.6Fe | 12 | 0 | 0.918 | 2Ce-15.6Fe-4.2N-0.4H | 107 | 240 | 0.908 |
| 3 | 2Nd-17Fe | 100 | 30 | 0.925 | 2Nd-17Fe-3.5N-0.8H | 157 | 148 | 0.705 |
| 4 | 2Pr-17Fe | 95 | 30 | 0.927 | 2Pr-17Fe-3.6N-0.8H | 156 | 169 | 0.672 |
| 5 | 2Gd-17Fe | 70 | 20 | 0.927 | 2Gd-17Fe-3.3N-0.5H | 114 | 118 | 0.808 |
| 6 | 2Dy-17Fe | 62 | 22 | 0.737 | 2Dy-17Fe-3.5N-0.4H | 105 | 142 | 0.846 |

TABLE 4-continued

| Run No. | Before Absorption of Nitrogen & Hydrogen: Alloy Powder Composition | Magnetic Properties: $\sigma_s$ (emu/g) | iHc (Oe) | $\sigma_\perp/\sigma$ at 15 KOe | After Absorption of Nitrogen & Hydrogen: Alloy powder Composition | Magnetic Properties: $\sigma_s$ (emu/g) | iHc (Oe) | $\sigma_\perp/\sigma$ at 15 KOe |
|---|---|---|---|---|---|---|---|---|
| 7 | 2Er-17Fe | 80 | 20 | 0.931 | 2Er-17Fe-4.0N-0.3H | 122 | 143 | 0.889 |
| 8 | 2Y-17Fe | 90 | 0 | 0.832 | 2Y-17Fe-3.4N-0.3H | 150 | 108 | 0.870 |
| 9 | 2didym*-17Fe | 101 | 30 | 0.847 | 2didym*-17Fe-3.5N-0.6H | 143 | 126 | 0.670 |
| 10 | 2didym*-8Fe | 85 | 153 | 0.929 | 2didym*-8Fe-4.8N-0.4H | 99 | 415 | 0.921 |
| 11 | 2didym*-12Fe | 121 | 55 | 0.902 | 2didym*-12Fe-4.2N-0.5H | 132 | 180 | 0.919 |
| 12 | 1didym*-1Ce-17Fe | 80 | 30 | 0.926 | 1didym*-1Ce-17Fe-4.0N-0.3H | 116 | 210 | 0.906 |

*didym: didymium

EXAMPLES 13 TO 17

Alloy ingots were prepared by the high frequency melting of Sm, Dy, Y, Gd, Ce or Nd and Fe, each having a purity of 99.9% by weight in an argon atmosphere, followed by molding the melt in an iron mold. Then the alloy ingots were annealed at 1200° C. for 2 hours in an argon atmosphere to render the alloy compositions uniform. The starting alloy compositions thus obtained are shown in Table 5.

Then the alloys were finely pulverized to an average particle size of 100 μm in a coffee mill in a nitrogen atmosphere and subjected to the absorption of nitrogen and hydrogen in the alloy powder in the same manner as in Example 1 to give magnetic materials whose alloy compositions are shown in Table 5. Also the magnetic properties of the magnetic materials thus obtained are shown in Table 5.

TABLE 5

| Example No. | Starting Alloy Composition (atomic %) | Alloy Powder Composition after Absorption of Nitrogen & Hydrogen (atomic %) | Magnetic Properties: $4\pi$Is (KG) | Ea (erg/g) | iHc (Oe) |
|---|---|---|---|---|---|
| 13 | 7.2Sm-3.4Dy-89.4Fe | 5.7Sm-2.7Dy-70.4Fe-17.2N-4.0H | 12.6 | $8.8 \times 10^6$ | 960 |
| 14 | 6.6Sm-4.6Y-88.8Fe | 5.2Sm-3.6Y-70.1Fe-16.5N-4.6H | 13.5 | $9.0 \times 10^6$ | 850 |
| 15 | 8.0Sm-2.0Gd-90.0Fe | 6.3Sm-1.6Gd-70.7Fe-18.1N-3.3H | 13.2 | $9.2 \times 10^6$ | 730 |
| 16 | 5.5Sm-5.5Ce-89.0Fe | 4.3Sm-4.3Ce-69.0Fe-20.0N-2.4H | 14.5 | $6.8 \times 10^6$ | 590 |
| 17 | 7.0Sm-3.5Nd-89.5Fe | 5.4Sm-2.7Nd-69.4Fe-20.2N-2.3H | 14.7 | $7.2 \times 10^6$ | 570 |

EXAMPLE 18

The same starting alloy powder having an average particle size of 100 μm as obtained in Example 1 was placed in a tubular furnace and hydrogen gas having a pressure of 1 atm alone was introduced into the tubular furnace and the temperature of the furnace was raised to 450° C. at a rate of 15° C./minute and kept at 450° C. while continuing the introduction of hydrogen for one hour to effect the absorption of hydrogen alone in the alloy powder and then a mixed gas of ammonia gas having a partial pressure of 0.4 atm and hydrogen gas having a partial pressure of 0.6 atm with a total pressure of 1 atm was introduced into the tubular furnace kept at 450° C., instead of the hydrogen gas, for 30 minutes to effect the absorption of nitrogen in the hydrogen-absorbed alloy powder, and then the alloy powder was cooled to 20° C. at a rate of 15° C./minute in the same mixed gas atmosphere to give alloy powder of, by atomic percent, 8.3Sm-70.6Fe-17.5N-3.6H composition. The magnetic properties of the alloy powder thus obtained were as follows;

| | |
|---|---|
| $4\pi$Is | 13.2 KG |
| Ea | $8.9 \times 10^6$ erg/g |
| iHc | 780 Oe |

EXAMPLE 19

The same starting alloy powder having an average particle size of 100 μm as obtained in Example 1 was placed in a tubular furnace and nitrogen gas having a pressure of 1 atm alone was introduced into the tubular furnace and the temperature of the furnace was raised to 550° C. at a rate of 15° C./minute and kept at 550° C. which continuing the introduction of nitrogen for 8 hours to effect the absorption of nitrogen alone in the alloy powder and subsequently a mixed gas of hydrogen gas having a partial pressure of 0.5 atm and nitrogen gas having a partial pressure of 0.5 atm with a total pressure of 1 atm was introduced into the tubular furnace cooled to and kept at 450° C., instead of the nitrogen gas, for 30 minutes to effect the absorption of hydrogen in the nitrogen absorbed-alloy powder, and then the alloy powder was cooled to 20° C. at a rate of 15° C./minute in the same mixed gas atmosphere to give alloy powder of, by atomic percent, 8.4Sm-71.9Fe-15.6N-4.1H composition. The magnetic properties of the alloy powder thus obtained were as follows;

| | |
|---|---|
| $4\pi$Is | 12.6 KG |
| Ea | $4.5 \times 10^6$ erg/g |
| iHc | 390 Oe |

EXAMPLE 20

An alloy of, by atomic percent, 10.5Sm-89.5Fe composition was prepared by the high frequency melting of Sm and Fe each having a purity of 99.9% by weight in an argon atmosphere, followed by pouring the melt in an iron mold and then annealing the ingot thus obtained at 1250° C. for 3 hours in an argon atmosphere. The alloy thus obtained was coarsely crushed in a jaw crusher in a nitrogen atmosphere and finely pulverized in a coffee mill in a nitrogen atmosphere to an average particle size of 100 μm. This alloy powder is designated Powder A.

Then Powder A was sealed in an autoclave provided with a pressure valve and a pressure gauge. After the autoclave was vacuumed, a mixed gas of hydrogen gas and ammonia gas was introduced into the autoclave. The inner pressure of the autoclave was 9.0 atm with a partial pressure of the ammonia of 3.0 atm and a partial pressure of the hydrogen of 6.0 atm. Then the autoclave was heated in a heating furnace for 465° C. for 30 minutes to effect the absorption of nitrogen and hydrogen in the alloy powder and subsequently slowly cooled to 20° C. to give alloy powder of, by atomic percent, 8.3Sm-70.6Fe-16.5N-4.6H composition.

The magnetic properties of the alloy powder were as follows;

| | |
|---|---|
| 4 πIs | 13.1 KG |
| Ea | $9.6 \times 10^6$ erg/g |
| iHc | 1050 Oe |

EXAMPLE 21

Powder A as obtained in Example 20 was placed at the position whose temperature was 550° C. in a tubular furnace having such a temperature distribution that the temperature of the center of the furnace was 1500° C. and the temperature was rapidly decreased in the direction of both ends of the furnace with the temperatures of one end equal to 20° C. Then a mixed gas of nitrogen has having a partial pressure of 0.7 atm and ammonia gas having a partial pressure of 0.3 was rapidly circulated in the furnace with a total pressure of 1 atm for 24 hours in such a direction that the mixed gas firstly passed the center of the furnace and secondly contacted Powder A to carry out the absorption of nitrogen and hydrogen in the alloy powder, and subsequently the alloy powder was slowly cooled to 20° C. in the atmosphere of the mixed gas to give alloy powder of, by atomic percent, 8.4Sm-71.4Fe-15.6N-4.6H composition.

The magnetic properties of the alloy powder were as follows;

| | |
|---|---|
| 4 πIs | 11.8 KG |
| Ea | $7.3 \times 10^6$ erg/g |
| iHc | 570 Oe |

EXAMPLE 22

An alloy ingot having a composition formula of $Sm_2Fe_{10}$ was prepared by the high frequency melting in the same manner as in Example 20. The alloy ingot thus prepared was pulverized in a coffee mill in a nitrogen atmosphere and sieved to give alloy powder having an average particle size of less than 74 μm. This powder was dispersed in methylethyl ketone, spread on a stainless steel plate having a diameter of 15 cm and dried in air to give a target.

Using the target thus prepared radio frequency-sputtering was carried in a sputtering device (manufactured by ULVAC Co., "SH-450") to give a thin film of Sm-Fe having a thickness of 0.8 μm on an alumina substrate having a thickness of 0.48 mm and an area of 3.81 cm×3.81 cm under the following conditions;

| | |
|---|---|
| Distance between Substrate and Target | 8 cm |
| Sustrate temperature | 600° C. to 650° C. |

-continued

| | |
|---|---|
| Atomosphere & Pressure | Argon about 40 mTorr |
| Radio Frequency Power | 350 W |

The X-ray diffraction by the radiation of Ni-filtered CuKα of the thin film thus obtained was measured and a peak assignable to $Sm_2O_3$ in the region of 2θ being 25° to 35°, a peak assignable to $Sm_2Fe_{17}$ in the region of 2θ being 40° to 43° and a peak showing α-Fe phase at 2θ being about 45° were observed, respectively.

The thin film was sealed in a quartz tube and heated in an argon atmosphere at 800° C. for one hour and subsequently sealed in a tubular furnance. Then a mixed gas of ammonia gas having a partial pressure of 0.35 atm and hydrogen gas having a partial pressure of 0.65 atm with a total pressure of 1 atm was introduced into the tubular furnace and the temperature of the tubular furnace was raised to 450° C. at a rate of 15° C./minute and kept at 450° C. while continuing the introduction of the mixed gas for 15 minutes to effect the absorption of nitrogen and hydrogen in the thin film, and then the temperature of the tubular furnace was cooled to 20° C. at a rate of 15° C./minute in the mixed gas atmosphere to give a magnetic film having a composition formula of $Sm_2Fe_{11}N_1H_{0.1}$.

When the X-ray diffraction by the radiation of Ni-filtered CuKα of the magnetic film was measured, only the peak assignable to $Sm_2Fe_{17}$ was shifted to a lower angle although the shifted width of angle was the same as the alloy powder after the absorption of nitrogen and hydrogen of Example 1. The direction of easy magnetization was that parallel to the substrate and the direction of hard magnetization was that perpendicular to the substrate. The magnetic properties of the thin films of Sm-Fe and $Sm_2Fe_{11}N_1H_{0.1}$ are shown in Table 6.

TABLE 6

| | Magnetic Properties | | |
|---|---|---|---|
| Alloy Film | (BH) max (MGOe) | iHc (KOe) | Br (KG) |
| Sm—Fe sputtered film | 0.1 | 150 | 6.5 |
| $Sm_2Fe_{11}N_1H_{0.1}$ magnetic film | 0.2 | 300 | 5.0 |

EXAMPLE 23

An alloy ingot having a composition formula of $Sm_2Fe_{17}$ was prepared by the arc melting of Sm having a purity of 99.9% by weight and Fe having a purity of 99.9% by weight in a water-cooled copper boat in an argon atmosphere. The alloy ingot thus obtained was annealed at 900° C. for 7 days in an argon atmosphere and then coarsely crushed in a jaw crushed in a nitrogen atmosphere and subsequently finely pulverized to an average particle size of 105 μm in a coffee mill in a nitrogen atmosphere.

Then the alloy powder thus obtained was further finely pulverized to an average particle size of 4.6 μm in a vibrating mill in a nitrogen atmosphere and subsequently subjected to annealing at 900° C. for 6 hours in an argon atmosphere.

FIG. 17-(*a*) is an X-ray powder diffraction pattern by the radiation of Ni-filtered CuKα of this alloy powder after annealing. It can be observed that the peak is sharp and the crystallinity is sufficiently high.

The alloy powder obtained after annealing was placed in a tubular furnace and a mixed gas of ammonia gas having a partial pressure of 0.4 atm and hydrogen gas having a partial pressure of 0.6 atm with a total pressure of 1 atm was introduced into the tubular furnace and the temperature of the tubular furnace was raised to 450° C. at a rate of 15° C./minute and kept at 450° C. while continuing the introduction of the mixed gas for 30 minutes to effect the absorption of nitrogen and hydrogen in the alloy, and then the alloy powder was cooled to 20° C. at a rate of 15° C./minute in the same mixed gas to give an alloy powder of, by atomic percent, 8.3Sm-70.5Fe-18.3N-2.9H composition.

FIG. 17-(*b*) is an X-ray powder diffraction pattern by the radiation of Ni-filtered CuKα line of this alloy powder.

The magnetic properties of the alloy powder thus obtained were as follows;

| | |
|---|---|
| 4 πIs | 13.8 KG |
| Ea | 11.4 × $10^6$ erg/g |
| iHc | 6800 Oe |

The alloy powder thus obtained is a magnetic material having a high Ea as well as a high 4πIs.

When the annealing as described above was not carried out in the above described procedures, there is obtained an alloy of, by atomic percent, 8.3Sm-71.0Fe-17.8N-2.9H composition whose magnetic properties were as follows;

| | |
|---|---|
| 4 πIs | 11.6 KG |
| Ea | 6.5 × $10^6$ erg/g |
| iHc | 1540 Oe |

EXAMPLE 24

An alloy ingot of, in atomic percent, 10.2Sm-1.0Dy-88.8Fe was prepared by the arc melting of Sm, Dy and Fe, each having a purity of 99.9% by weight in a water-cooled copper boat in an argon atmosphere. The alloy ingot thus obtained was annealed at 1200° C. for 2 hours in an argon atmosphere, and then coarsely crushed in a jaw crusher in a nitrogen atmosphere and subsequently finely pulverized to an average particle size of 117 μm in a coffee mill in a nitrogen atmosphere.

The alloy powder thus obtained was further finely pulverized to an average particle size of 3.8 μm in a jet mill in a nitrogen atmosphere and subsequently subjected to the same annealing as in Example 23, followed by carrying out the absorption of nitrogen and hydrogen in the alloy powder in the same manner as in Example 23 to give an alloy powder of, by atomic percent, 8.0Sm-0.8Dy-70.0Fe-18.5N-2.7H whose magnetic properties were as follows;

| | |
|---|---|
| 4 πIs | 13.9 KG |
| Ea | 11.2 × $10^6$ erg/g |
| iHc | 6830 Oe |

EXAMPLE 25

An alloy ingot having a composition formula of $Sm_2Fe_{15.9}$ was prepared by the arc melting of Sm having a purity of 99.9% by weight and Fe having a purity of 99.9% by weight in a water-cooled copper boat in an argon atmosphere. The alloy ingot thus obtained was annealed at 900° C. for 7 days in an argon atmosphere, and then coarsely crushed in a jaw crusher in a nitrogen atmosphere and subsequently finely pulverized to an average particle size of 110 μm in a coffee mill in a nitrogen atmosphere.

The alloy powder thus obtained which is designated Powder B was placed in a tubular furnace and hydrogen gas having a pressure of 1 atom alone was introduced into the tubular furnace and the temperature of the tubular furnace was raised to 300° C. at a rate of 15° C./minute and kept at 300° C. while continuing the introduction of the hydrogen gas for 30 minutes to carry out the absorption of hydrogen in the alloy. The amount of hydrogen absorbed was 1.23 hydrogen atom per Sm atom.

The alloy powder thus obtained was further finely pulverized in a vibrating ball mill in a nitrogen atmosphere to an average particle size of 3.8 μm.

Then the alloy powder was placed in a tubular furnace and a mixed gas of ammonia gas having a partial pressure of 0.4 atom and hydrogen gas having a partial pressure of 0.6 atm with a total pressure of 1 atm was introduced into the tubular furnace at and the temperature of the tubular furnace was raised to 450° C. at a rate of 15° C./minute and kept at 450° C. while continuing the introduction of the mixed gas 30 minutes to effect the absorption of nitrogen and hydrogen in the alloy, and then the alloy powder was cooled to 20° C. at a rate of 15° C./minute in the same mixed gas atmosphere to give an alloy powder of, by atomic percent, 8.8Sm-69.9Fe-18.6N-2.7H composition whose magnetic properties were as follows;

| | |
|---|---|
| 4 πIs | 13.5 KG |
| Ea | 10.9 × $10^6$ erg/g |
| iHc | 5600 Oe |

The alloy powder thus obtained is a magnetic material having a high Ea as well as a high 4πIs.

FIG. 18 is an X-ray powder diffraction pattern by the radiation of Ni-filtered Cukα of this alloy powder.

EXAMPLE 26

Powder B as obtained in Example 25 was placed in a tubular furnace and hydrogen gas at a pressure of 1 atm was introduced into the tubular furnace and the temperature of the tubular furnace was raised to 300° C. at a rate of 15° C./minute and kept at 300° C. while continuing the introduction of the hydrogen gas for 10 minutes to effect the absorption of hydrogen in the alloy (i.e., hydrogen absorption procedure) and then the introduction of the hydrogen was stopped and the temperature of the tubular furnace was raised to 700° C. at a rate of 15° C./minute in an argon atmosphere to effect the desorption of hydrogen in the alloy (i.e., hydrogen desorption procedure). The fine pulverization of the alloy powder was conducted by alternatingly repeating the hydrogen absorption procedure and the hydrogen desorption procedure until the average particle size reached 4.1 μm.

Then the absorption of nitrogen and hydrogen in the alloy was carried out under the same conditions as in Example 25 to give alloy powder of, by atomic percent, 8.8Sm-69.9Fe-18.3N-3.0H composition.

The X-ray powder diffraction pattern by the radiation of Ni-filtered CuKα of the alloy powder was similar to that of FIG. 18.

The magnetic properties of the alloy powder were as follows;

| | |
|---|---|
| 4 πIs | 13.6 KG |
| Ea | 11.3 × $10^6$ erg/g |
| iHc | 6200 Oe |

Separately the absorption of nitrogen and hydrogen in Power B as obtained in Example 25 was carried out under the same conditions as in Example 25 and then the alloy powder thus obtained was finely pulverized to an average particle size of 3.7 μm in a vibrating ball mill in a nitrogen atmosphere to give alloy powder of, by atomic percent, 8.8Sm-70.4Fe-18.0N-2.8H composition.

The magnetic properties of the alloy powder thus obtained were as follows;

| | |
|---|---|
| 4 πIs | 11.2 KG |
| Ea | 7.8 × $10^6$ erg/g |
| iHc | 4800 Oe |

When Power B as obtained in Example 25 was finely pulverized to an average particle size of 3.7 m in a vibrating ball mill in a nitrogen atmosphere and then the absorption of nitrogen and hydrogen in the alloy powder was carried out in the same manner as in Example 25 to give alloy powder of, by atomic percent, 8.9Sm-70.7Fe-17.7N-2.7H composition.

The magnetic properties of the alloy powder were as follows;

| | |
|---|---|
| 4 πIs | 12.0 KG |
| Ea | 7.6 × $10^6$ erg/g |
| iHc | 2200 Oe |

EXAMPLE 27

Using an apparatus for carrying out the quenching of alloy melt by ejecting the alloy melt on to a rotating copper roll having a diameter of 25 cm and a width of 2 cm, a starting alloy of, by atomic percent, 10.5Sm-89.5Fe composition. The melting of Sm and Fe, each having a purity of 99.9% by weight before quenching was effected by packing the Sm and Fe in a quartz nozzle by the high frequency melting in an argon atmosphere and the ejecting pressure was 1 Kg/$cm^2$ with the distance between the roll and nozzle of 1 mm. The rotating speed of the roll was varied as shown in Table 7 and the thin samples thus obtained were pulverized to an average particle size of about 30 μm in a coffee mill in a nitrogen atmosphere and then the absorption of nitrogen and hydrogen in the alloy powder was carried out in the same manner as in Example 1.

The alloy powder compositions thus obtained and their magnetic properties are shown in Table 7.

TABLE 7

| Run No. | Alloy Powder Composition (atomic %) | Rotating Speed of Roll (r.p.m.) | Magnetic Properties 4πIs (KG) | iHc (Oe) |
|---|---|---|---|---|
| 1 | 8.3Sm-70.9Fe-17.6N-3.2H | 500 | 11.8 | 2080 |
| 2 | 8.3Sm-70.6Fe-17.8N-3.3H | 1500 | 10.6 | 2650 |
| 3 | 8.3Sm-70.7Fe-17.5N-3.5H | 3000 | 10.1 | 3530 |
| 4 | 8.4Sm-71.9Fe-16.8N-2.9H | 6000 | 10.3 | 330 |

As would be observed, when the starting alloy is prepared by the melt spinning, magnetic powder materials having very high iHc (except the rotating speed of 6000 r.p.m.) can be obtained in the present invention. By the analysis by X-ray powder diffraction, when the rotating speed of the roll is in the range of 500 to 3000 r.p.m. in the preparation of starting alloys by the melt spinning, the starting alloys obtained are crystalline. On the other hand, when the rotating speed of the roll is 6000 r.p.m. in the preparation of a starting alloy by the melt spinning, the starting alloy obtained is amorphous which might render the iHc not so high.

EXAMPLE 28

The same alloy powder having an average particle size of 100 μm after the absorption of nitrogen and hydrogen as obtained in Example 1 was subjected to annealing under the conditions as shown in Table 8.

The magnetic properties of the alloy powder after annealing are shown in Table 8. As would be clear from Table 8, the annealing under these conditions is effective for improving the magnetic properties. The change in the alloy powder compositions before and after the annealing could not be observed.

TABLE 8

| Run No. | Annealing Conditions Temperature (°C.) | Time (hour) | Atmosphere | Magnetic Properties 4πIs (KG) | Ea (erg/g) | iHc (Oe) |
|---|---|---|---|---|---|---|
| 1 (Example 1) | — | — | — | 13.3 | 9.8 × $10^6$ | 1100 |
| 2 | 150 | 24 | hydrogen | 13.5 | 9.9 × $10^6$ | 1150 |
| 3 | 300 | 1 | hydrogen | 13.8 | 10.1 × $10^6$ | 1220 |
| 4 | 450 | 1 | hydrogen | 14.3 | 10.5 × $10^6$ | 1500 |
| 5 | 150 | 24 | air | 13.6 | 10.0 × $10^6$ | 1280 |
| 6 | 300 | 1 | argon | 13.9 | 10.2 × $10^6$ | 1250 |
| 7 | 150 | 24 | ammonia (0.4*) hydrogen (0.6*) | 13.4 | 9.9 × $10^6$ | 1120 |
| 8 | 450 | 1 | ammonia (0.4*) hydrogen (0.6*) | 13.5 | 10.0 × $10^6$ | 1140 |

*partial pressure (atm)

EXAMPLE 29

The alloys having the compositions as shown in Table 9 were prepared by the arc melting of Sm, Fe and Co, each having a purity of 99.9% by weight in a water-cooled boat in an argon atmosphere, and then coarsely crushed in a jaw crusher in a nitrogen atmosphere and subsequently finely pulverized to an average particle size of 100 μm in a coffee mill in a nitrogen atmosphere.

The alloy powder thus obtained was placed in a tubular furnace and a mixed gas of ammonia gas having a partial pressure of 0.67 atm and hydrogen gas having a partial pressure of 0.33 atm with a total pressure of 1 atm was introduced into the tubular furnace and the temperature of the tubular furnace was raised to 470° C. at a rate of 15° C./minute and kept at 470° C. while continuing the introduction of the mixed gas for 60 minutes to effect the absorption of nitrogen and hydrogen in the alloy and the alloy powder was cooled to 20° C. at a rate of 15° C./minute in the same mixed gas to give alloy powder having the compositions shown in Table 9.

The magnetic properties of the alloy powder are shown in Table 9.

When the starting alloy of Run No. 1 was finely pulverized to an average particle size of 4.6 μm in a vibrating mill instead of the coffee mill in a nitrogen atmosphere, the iHc of the alloy powder after the adsorption of nitrogen and hydrogen was 5700 Oe and Tc of the alloy powder after the adsorption of nitrogen and hydrogen was 590° C. The rates of thermal demagnetization of this alloy powder were 99.2% at 100° C. of the value at 20° C., 98.1% at 150° C. and 98.6% at 200° C., respectively. Thus it could be said that the addition of Co improves the thermal property of the alloy of the present invention.

TABLE 9

| Run No. | Starting Alloy Composition (atomic %) | Alloy Powder Composition after Absorption of Nitrogen & Hydrogen (atomic %) | Magnetic Properties 4πIs (KG) | Ea (erg/g) | iHc (Oe) |
|---|---|---|---|---|---|
| 1 | 10.5Sm-80.5Fe-9.0Co | 8.3Sm-63.3Fe-7.1Co-17.9N-3.4H | 13.9 | $9.3 \times 10^6$ | 1130 |
| 2 | 10.5Sm-62.6Fe-26.9Co | 8.1Sm-49.0Fe-21.0Co-18.2N-3.6H | 13.8 | $8.9 \times 10^6$ | 1080 |
| 3 | 10.5Sm-44.5Fe-45.0Co | 8.3Sm-35.2Fe-35.6Co-17.6N-3.3H | 12.1 | $8.6 \times 10^6$ | 980 |

EXAMPLE 30

About 1 g of the same alloy powder having an average particle size of 5 μm and an iHc of 5100 Oe as obtained in Example 1 was packed in a WC mold having a rectangular hole of 5 mm×10 mm for hot pressing, oriented in a magnetic field of 15 KOe and pressed under a pressure of 1 ton/cm$^2$. Then the mold was fixed in a hot-pressing device and subjected to hot-pressing under the conditions shown in Table 10 to effect the sintering of the alloy powder.

The magnetic properties of the sintered body thus obtained are shown in Table 10.

TABLE 10

| Run No. | Hot-Pressing Conditions: Temperature (°C.) | Pressure (ton/cm$^2$) | Atmosphere | Time (hour) | Magnetic Properties: 4πIs (KG) | iHc (KOe) | $(BH)_{max}$ (MG Oe) |
|---|---|---|---|---|---|---|---|
| 1 | 450 | 5 | nitrogen (1 atom) | 1 | 7.5 | 5.3 | 4.1 |
| 2 | 450 | 10 | ammonia (0.2 atm*) hydrogen (0.8 atm*) | 1 | 8.2 | 5.5 | 4.9 |
| 3 | 500 | 10 | ammonia (0.2 atm*) hydrogen (0.8 atm*) | 2 | 9.1 | 6.0 | 6.0 |
| 4** | 450 | 10 | ammonia (0.2 atm*) hydrogen (0.8 atm*) | 1 | 8.0 | 6.2 | 5.2 |

*partial pressure
**The same alloy powder having an average particle size of 4.6 μm and an iHc of 5700 Oe as obtained in Example 27, Run No. 1.

EXAMPLE 31

The same alloy having a composition formula of $Sm_2Fe_{17}$ and an average particle size of 105 μm as obtained in Example 23 was subjected to the absorption of nitrogen and hydrogen in a mixed gas of ammonia and hydrogen with various partial pressures to give alloy powder. To the alloy powder thus obtained 2.2 of Zn per unit cell of $Sm_2Fe_{17}N_xH_y$ was added and the mixture was finely pulverized in a vibrating ball mill for one hour in nitrogen atmosphere to give alloy powder having an average particle size of 5 μm and a composition formula of $Sm_2Fe_{17}N_xH_yZn_{2.2}$ as shown in FIG. 19.

Then the alloy powder was molded into a plate of 5 mm×10 mm×2 mm by a uniaxial magnetic press in a magnetic field of 15 KOe under a pressure of 1 ton/cm$^2$ and the plate was sintered in a mixed gas of ammonia having a partial pressure of 0.2 atm and hydrogen having a partial pressure of 0.8 atm with a total pressure of 1 atm at 480° C. for 2 hours under a pressure of 10 ton/cm$^2$. The sintered body thus obtained was magnetized in a magnetic field of about 60 KOe to give a sintered magnet.

The results are set forth in FIG. 19 which clearly shows a close relation of the amounts of nitrogen and hydrogen absorbed with $(BH)_{max}$ as the magnetic property. When x is around 4.0 and y is around 0.5, $(BH)_{max}$ is highest, and even when x is varied from 3.0 to 5.0 and y is varied from 0.1 to 1.0, $(BH)_{max}$ is comparatively high.

EXAMPLE 32

The same alloy having a composition formula of $Sm_2Fe_{17}$ and an average particle size of 105 μm as obtained in Example 23 was subjected to the absorption of nitrogen and hydrogen in the same manner as in Example 23 to give alloy powder having a composition formula of $Sm_2Fe_{17}N_{4.0}H_{0.5}$. To the alloy powder thus obtained Zn was added in an amount of 2.2 per unit cell of $Sm_2Fe_{17}N_{4.0}H_{0.5}$ and the mixture was finely pulverized in a vibrating mill for one hour in a nitrogen atmosphere to give alloy powder having an average particle size of 5 μm and a composition formula of $Sm_2Fe_{17}N_{4.0}H_{0.5}Zn_{2.2}$.

The alloy powder thus obtained was molded into a plate of 10 mm×5 mm×2 mm by a uniaxial magnetic field press in a magnetic field of 15 KOe under a pressure of 1 ton/cm² and the plate was sintered in a mixed gas of ammonia having a partial pressure of 0.2 atm and hydrogen having a partial pressure of 0.8 atm with a total pressure of 1 atm at 470° C. under a pressure of 10 ton/cm² for a period of time shown in Table 11.

The magnetic properties of the sintered bodies thus obtained are shown in Table 11.

TABLE 11

| Magnetic Properties | | Alloy Powder before Sintering | Sintered Body Sintering Time (hour) 1 | 2 | 4 |
|---|---|---|---|---|---|
| iHc | (Oe) | 3000 | 4800 | 6700 | 5300 |
| 4πIs | (KG) | 11.5 | 10.6 | 10.0 | 9.0 |
| Loop Rectangularity | (Br/4πIs) | 0.780 | 0.900 | 0.914 | 0.870 |
| $(BH)_{max}$ | (MGOe) | — | 12.0 | 15.0 | 8.0 |

EXAMPLE 33

To the same alloy powder having a composition formula of $Sm_2Fe_{17}N_{4.0}H_{0.5}$ as obtained in Example 32 Zn was added in an amount of 2 and 7 per unit cell of $Sm_2Fe_{17}N_{4.0}H_{0.5}$, respectively, and the mixtures were finely pulverized in a vibrating ball mill in a nitrogen atmosphere for 4 hours and 1 hour, respectively, and the alloy powder was molded into plates and in the same manner as in Example 32 to give sintered bodies.

The magnetic properties of the sintered bodies thus obtained are shown in Table 12.

TABLE 12

| Magnetic Properties | | $Sm_2Fe_{17}N_{4.0}H_{0.5}Zn_2$ Pulverization (4 hrs.) Alloy Powder before Sintering | Sintered Body | $Sm_2Fe_{17}N_{4.0}H_{0.5}Zn_7$ Pulverization (1 hr.) Alloy Powder before Sintering | Sintered Body |
|---|---|---|---|---|---|
| iHc | (Oe) | 4500 | 10800 | 3000 | 11700 |
| 4πIs | (KG) | 10.6 | 9.0 | 8.9 | 7.7 |
| Rectangularity | (Br/4πIs) | 0.80 | 0.92 | 0.77 | 0.95 |
| $(BH)_{max}$ | (MGOe) | — | 9.8 | — | 9.4 |

EXAMPLE 34

An alloy of, by atomic percent, 10.6Sm-77.8Fe-11.6Zn composition was prepared by high frequency melting of Sm, Fe and Zn, each having a purity of 99.9% by weight. The alloy thus obtained was annealed at 900° C. for 24 hours and then the annealed alloy was crushed and finely pulverized to an average particle size of 100 μm and subjected to the adsorption of nitrogen and hydrogen in the alloy in the same manner as in Example 1. The magnetic properties of the finely pulverized alloy powder are set forth in Table 13.

Then the alloy powder was further finely pulverized in a vibrating ball mill to an average particle size of about 6 μm in a nitrogen atmosphere. The magnetic properties of the alloy powder thus obtained are set forth in Table 13.

Then the powder having an average particle size of about 6 μm was compression-molded by a uniaxial magnetic field press in a magnetic field of 15 KOe under a pressure of 1 ton/cm² to form a plate of 10 mm×5 mm×2 mm. Then the plate was sintered by the hot-pressing in a WC mold at 470° C. under a pressure of 12 ton/cm² for 90 minutes in an atmosphere of ammonia having a partial pressure of 0.2 atom and hydrogen having a partial pressure of 0.8 atm with a total pressure of 1 atm. The magnetic properties of the sintered body thus obtained are set forth in Table 13.

It could be understood that the addition of Zn in the preparation of a magnet is effective in the present invention.

TABLE 13

| Run No. | 8.7Sm-63.8Fe-9.5 Zn-15.3N-2.7H | Magnetic Properties iHc (Oe) | 4πIs (KG) | Br (KG) | $(BH)_{max}$ (MG Oe) |
|---|---|---|---|---|---|
| 1 | 100 μm powder | 440 | 11.2 | — | — |
| 2 | 6 μm powder | 2000 | 10.8 | — | — |
| 3 | after hot-pressing | 4200 | 9.6 | 8.4 | 10.3 |

EXAMPLE 35

To the same alloy powder of, by atomic percent, 8.3Sm-63.3Fe-7.1Co-17.9N-3.4H composition having an average particle size of 4.6 μm as obtained in Example 29, 10 atomic percent of Zn having an average particle size of 8 μm were added and mixed in an alumina mortar in a nitrogen atmosphere for 20 minutes.

The alloy powder thus obtained was molded and sintered by the hot pressing in the same manner as in Example 34 to give a sintered body.

The magnetic properties of the sintered body were as follows;

| | |
|---|---|
| Br | 8.8 KG |
| iHc | 6.9 KOe |
| $(BH)_{max}$ | 10.3 MGOe |

EXAMPLE 36

To the same alloy powder having a composition formula of $Sm_2Fe_{17}N_{4.0}H_{0.5}$ as obtained in Example 32 the additives as set forth in Table 14 were added and the mixtures were finely pulverized in a vibrating ball mill for one hour in a nitrogen atmosphere, molded and sintered for 2 hours in the same manner as in Example 32 to give sintered magnets.

The magnetic properties of the sintered magnets thus obtained are shown in Table 14.

TABLE 14

| Run No. | Additive Amount (atomic %) | Magnetic Properties Br (KG) | iHc (KOe) | Loop Rectangularity (Br/4πIs) | $(BH)_{max}$ (MG Oe) |
|---|---|---|---|---|---|
| 1 | Sn (10) | 9.1 | 6.7 | 0.870 | 13.5 |
| 2 | Ga (10) | 9.1 | 5.5 | 0.844 | 12.4 |
| 3 | In (10) | 10.0 | 4.5 | 0.893 | 12.3 |
| 4 | Pb (10) | 7.1 | 2.0 | 0.703 | 4.2 |
| 5 | Bi (10) | 7.8 | 1.8 | 0.755 | 3.7 |
| 6 | In (5) Zn (5) | 9.3 | 6.2 | 0.902 | 14.7 |
| 7 | Ga (5) Zn (5) | 9.2 | 6.4 | 0.912 | 14.8 |

TABLE 14-continued

| Run No. | Additive Amount (atomic %) | Magnetic Properties Br (KG) | iHc (KOe) | Loop Rectangularity (Br/4πIs) | $(BH)_{max}$ (MG Oe) |
|---|---|---|---|---|---|
| 8 | Sn (5) Zn (5) | 9.4 | 6.0 | 0.902 | 13.2 |
| 9 | La (8.6) Cu (1.4) | 8.6 | 3.5 | 0.851 | 8.5 |
| 10 | Al (10) | 9.4 | 5.8 | 0.879 | 12.3 |
| 11 | Ce (10) | 8.6 | 4.0 | 0.830 | 10.0 |
| 12 | Zr (10) | 8.8 | 4.0 | 0.840 | 10.5 |
| 13 | Ti (10) | 8.5 | 3.9 | 0.820 | 9.1 |
| 14 | Cu (10) | 7.8 | 3.8 | 0.831 | 8.0 |
| 15 | Sm (10) | 8.8 | 4.1 | 0.869 | 10.0 |
| 16 | Al (8.3)-Cu (1.7) | 8.3 | 3.2 | 0.847 | 8.1 |
| 17 | Sm (7.3)-Fe (2.7) | 9.1 | 5.0 | 0.885 | 12.5 |
| 18 | MgO (10) | 9.0 | 3.5 | 0.827 | 8.7 |
| 19 | $AlF_3$ (10) | 8.8 | 3.6 | 0.822 | 8.4 |
| 20 | SiC (10) | 9.2 | 3.8 | 0.831 | 9.2 |
| 21 | AlN (10) | 8.7 | 3.8 | 0.828 | 8.5 |
| 22 | Zr (3.2)-Zn (8.4) | 9.0 | 6.2 | 0.920 | 13.5 |
| 23 | Cu (4.5)-Zn (8.2) | 10.1 | 4.0 | 0.907 | 12.0 |
| 24 | Mo (3.0)-Zn (8.4) | 9.5 | 4.1 | 0.915 | 11.7 |
| 25 | Sm (2.0)-Zn (8.5) | 8.2 | 7.0 | 0.916 | 12.6 |
| 26 | Si (9.6)-Zn (7.8) | 8.8 | 6.2 | 0.933 | 14.2 |
| 27 | MgO (6.9)-Zn (8.0) | 9.3 | 8.1 | 0.915 | 14.7 |
| 28 | $Al_2O_3$(2.9)-Zn (8.4) | 8.8 | 5.3 | 0.915 | 12.2 |
| 29 | $Sm_2O_3$ (0.9)-Zn (8.6) | 8.5 | 5.8 | 0.926 | 12.1 |
| 30 | $AlF_3$ (8.4)-Zn (8.3) | 8.4 | 5.5 | 0.916 | 12.7 |
| 31 | $ZnF_2$ (2.8)-Zn (8.4) | 8.4 | 5.3 | 0.911 | 10.7 |
| 32 | SiC (6.9)-Zn (8.0) | 8.1 | 5.7 | 0.930 | 11.0 |
| 33 | Tic (4.9)-Zn (8.2) | 8.6 | 6.0 | 0.927 | 12.9 |
| 34 | AlN (6.9)-Zn (8.0) | 8.6 | 6.0 | 0.912 | 11.9 |
| 35 | $Si_3N_2$ (2.6)-Zn (8.4) | 9.0 | 6.3 | 0.935 | 14.1 |
| 36 | Zn (8.6) | 9.1 | 6.3 | 0.910 | 13.0 |
| 37 | None | 9.1 | 2.8 | 0.826 | 7.7 |

EXAMPLE 36

To the same alloy powder having a composition formula of $Sm_2Fe_{17}N_{4.0}H_{0.5}$ as obtained in Example 32, 7.0 and 11.5 of Zn per unit cell of $Sm_2Fe_{17}N_{4.0}H_{0.5}$ having an average particle size of 8 μm were added, respectively, mixed in a nitrogen atmosphere for 30 minutes, molded into a plate in the same manner as in Example 32 and sintered by the hot pressing in a mixed gas of ammonia having a partial pressure of 0.35 atm and hydrogen having a partial pressure of 0.65 atm with a total pressure of 1 atm at 465° C. for one hour to give sintered magnets.

The magnetic properties of the sintered magnets thus obtained were shown in Table 15.

TABLE 15

| Magnetic Properties | Sintered Magnet $Sm_2Fe_{17}N_{4.0}N_{0.5}Zn_{7.0}$ | $Sm_2Fe_{17}N_{4.0}H_{0.5}Zn_{11.5}$ |
|---|---|---|
| iHc | 5 | 10 |
| 4 πIS | 4.3 | 3.6 |

These results show that the presence of the non-magnetic phase of Zn in the grain boundaries in a large amount incrases remarkably the iHc and that on the other hand, the decrease in the 4πIs is proportional to the volume ratio of the non-magnetic phase of Zn to the alloy powder.

EXAMPLE 37

The same alloy powder having a composition formula of $Sm_2Fe_{17}N_{4.0}H_{0.5}$ and an average particle size of 105 μm as obtained in Example 32 was finely pulverized to an average particle size of about 0.2 μm in a vibrating ball mill in a nitrogen atmosphere, and 2 g of the alloy powder thus obtained was mixed with 0.4 g of an epoxy adhesive (product of Konishi Co., "Bondquick 5") in a mortar to give viscous powder. Then the viscous powder was placed in a ceramic vessel of 10 mm×5 mm×5 mm and hardened in a magnetic field of 15 KOe at 20° C. for about one hour to give a bonded magnet (a). Separately the same alloy powder as described above was compression-molded in a magnetic field of 15 KOe under a pressure of 10 ton/cm² to give a molded article having a weight of 0.5 g. Then the molded article was impregnated with 5% by weight of polyisoprene dissolved in toluene and sufficiently dried to give a bonded magnet (b).

The magnetic properties of these bonded magnets (a) and (b) are shown in Table 16.

TABLE 16

| Sample | Magnetic Properties Br (KG) | iHc (Oe) | $(BH)_{max}$ (MG Oe) |
|---|---|---|---|
| Starting Alloy Powder | — | 7000 | — |
| Bonded Magnet (a) | 3.5 | 8400 | 2.5 |
| Bonded Magnet (b) | 8.1 | 4500 | 10.0 |

What is claimed is:

1. A magnetic material represented by the formula $$R_\alpha Fe_{(100-\alpha-\beta-\gamma)}N_\beta H_\gamma$$

wherein

R is at least one rare earth element inclusive of Y,

α is 5 to 20 atomic percent,

β is 5 to 30 atomic percent,

γ is 0.01 to 10 atomic percent and the magnetic material has a crystal structure selected from the group of a rhombohedral crystal structure and a hexagonal crystal structure.

2. The magnetic material of claim 1, wherein the magnetic material has a rhombohedral crystal structure.

3. The magnetic material of claim 1, wherein the magnetic material has a hexagonal crystal structure.

4. A magnetic material represented by the formula $$R_\alpha Fe_{(100-\alpha-\beta-\gamma-\delta)}N_\beta H_\gamma M_\delta$$

wherein

R is at least one rare earth element inclusive of Y,

α is 5 to 20 atomic percent,

β is 50 to 30 atomic percent,

γ is 0.01 to 10 atomic percent,

δ is 0.1 to 40 atomic percent,

M is at least one additive selected from the group consisting of Sn, Ga, In, Bi, Pb, Zn, Al, Zr, Cu, Mo, Ti, Si, MgO, $Al_2O_3$, $Sm_2O_3$, $AlF_3$, $ZnF_2$, SiC, TiC, AlN and $Si_3N_2$.

5. The magnetic material of claim 1 or claim 4, wherein R is at least one rare earth element selected from the group consisting of Nd, Pr, La, Ce, Tb, Dy, Ho, Er, Sm, Eu, Gd, Pm, Tm, Yb, Lu and Y.

6. The magnetic material of claim 1 or claim 4, wherein Fe is substituted by Co in an amount not exceeding 50 atomic percent of Fe.

7. The magnetic material of claim 1 or claim 4, wherein $\alpha$ is 8 to 9.5 atomic percent.

8. The magnetic material of claim 1 or claim 4 wherein $\beta$ is 13 to 18 atomic percent.

9. The magnetic material of claim 1 or claim 4, wherein $\gamma$ is 2 to 5 atomic percent.

10. The magnetic material of claim 1 or claim 4, wherein the amount of Fe is 50 to 86 atomic percent.

11. The magnetic material of claim 10, wherein the amount of Fe is 69 to 72 atomic percent.

12. The magnetic material of claim 4, wherein $\delta$ is 5 to 15 atomic percent.

13. The magnetic material of claim 5, wherein R is Ce.

14. The magnetic material of claim 5, wherein R is Sm.

15. The magnetic material of claim 5, wherein R is didymium.

16. The magnetic material of claim 5, wherein R is one Sm alloy selected from the group consisting of Sm-Nd, Sm-Ce, Sm-Dy, Sm-Gd and Sm-Y.

17. The magnetic material of claim 4, wherein M is Zn.

18. The magnetic material of claim 4, wherein M is Ga.

19. The magnetic material of claim 4, wherein M is Al.

20. The magnetic material of claim 4, wherein M is In.

21. The magnetic material of claim 4, wherein M is Sn.

22. The magnetic material of claim 4, wherein M is at least one additive selected from the group consisting of Zn, Ga, Al, In and Sn and at least one additive selected from the group consisting of Si, SiC, $Si_3N_2$, MgO, $Sm_2O_3$ and TiC.

* * * * *

UNITED STATES PATENT AND TRADEMARK OFFICE

CERTIFICATE OF CORRECTION

PATENT NO. : 5,186,766

DATED : February 16, 1993

INVENTOR(S) : Iriyama et al

It is certified that error appears in the above-identified patent and that said Letters Patent is hereby corrected as shown below:

ON THE TITLE PAGE:

IN THE ABSTRACT, line 2, (in Formula I),

"$R_{60}Fe_{(100-\alpha-\beta-\gamma)}N_\beta H_\gamma$" should read

--$R_\alpha Fe_{(100-\alpha-\beta-\gamma)}N_\beta H_\gamma$--.

Signed and Sealed this

Ninth Day of November, 1993

*Attest:*

*Attesting Officer*

BRUCE LEHMAN

*Commissioner of Patents and Trademarks*